US005198328A

United States Patent [19]

Shiba et al.

[11] Patent Number: 5,198,328

[45] Date of Patent: Mar. 30, 1993

[54] SILVER HALIDE COLOR PHOTOGRAPHIC LIGHT-SENSITIVE MATERIAL

[75] Inventors: Keisuke Shiba; Tadashi Ogawa, both of Kanagawa, Japan

[73] Assignee: Fuji Photo Film Co., Ltd., Kanagawa, Japan

[21] Appl. No.: 749,368

[22] Filed: Aug. 23, 1991

Related U.S. Application Data

[62] Division of Ser. No. 504,214, Apr. 4, 1990, Pat. No. 5,057,405.

[30] Foreign Application Priority Data

Apr. 4, 1989 [JP] Japan ..... 1-84013
Jun. 5, 1989 [JP] Japan ..... 1-141141

[51] Int. Cl.[5] ..... G03C 7/00

[52] U.S. Cl. ..... 430/363; 430/945; 430/374; 430/944; 430/376; 430/523; 430/963; 430/505; 430/506; 430/508; 430/545; 430/538; 430/561

[58] Field of Search ..... 430/363, 945, 374, 944, 430/376, 523, 963, 505, 506, 508, 545, 538, 561

[56] References Cited

U.S. PATENT DOCUMENTS 4,619,892 10/1986 Simpson et al. ..... 430/363
4,665,813 5/1987 Sack et al. ..... 430/523
4,705,745 11/1987 Kitchin et al. ..... 430/505
4,770,978 9/1988 Matsuzaka et al. ..... 430/363
4,898,773 2/1990 Dethiefs et al. ..... 430/523
5,057,405 10/1991 Shiba et al. ..... 430/505

FOREIGN PATENT DOCUMENTS 0157749 6/1990 Japan ..... 430/363

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide color photographic material comprising a support having thereon at least three photosensitive layers containing a silver chloride emulsion or a silver chlorobromide emulsion having an average silver chloride content of at least 96 mol % and containing substantially no silver iodide, said at least three photosensitive layers comprising a cyan coupler-containing layer, a magenta coupler-containing layer and a yellow coupler-containing layer, wherein said at least three photosensitive layers each has different spectral sensitivity peak in the photosensitive wavelength regions of 650 to 690 nm, 720 to 790 nm and 770 to 850 nm, respectively, and the total coating weight of silver halide is not more than 0.78 g/m$^2$ in terms of silver, and the above-disclosed material wherein the support is a reflective support comprising a base paper impregnated with a synthetic polymer through the surface of the base paper, and a white pigment-containing water-resistant resin layer coated on the base paper.

11 Claims, 3 Drawing Sheets

SILVER HALIDE COLOR PHOTOGRAPHIC LIGHT-SENSITIVE MATERIAL

This is a divisional of application No. 07/504,214 filed Apr. 4, 1990, now U.S. Pat. No. 5,057,405.

FIELD OF THE INVENTION

This invention relates to a silver halide color photographic material for rapidly recording and reproducing an original color picture (negative or positive) gradated or soft image information by scanning exposure, and a method for forming an image thereon. More particularly, the present invention relates to a color photographic material having a high photosensitivity suitable for scanning exposure and a rapid color development processability, and which inexpensively provides an image of high quality, and a method for forming a color image thereon and to a color photographic material having excellent surface smoothness and uniform light reflection characteristics, and in particular, to a color photographic material having improved conveyability in an automatic processor and which is free from edge staining during a rapid color development stage.

BACKGROUND OF THE INVENTION

The preparation of hard copies from soft information using communication circuitry has been widely practiced with the recent development of information handling techniques and storage and image processing techniques. Furthermore, print photographs of very high quality are provided relatively easily and inexpensively with the development of silver halide photographic materials and development systems that are compact, rapid and simple (e.g., miniature laboratory system). Therefore, there is a large demand to prepare hard copies having a high picture quality, both easily and inexpensively from print photographs.

Conventional methods for preparing hard copies from soft information sources include methods using electric signals or electromagnetic signals, methods which do not employ a photosensitive material such as ink jet systems, and methods using photosensitive materials (e.g., silver halide photosensitive materials or electrophotographic materials). Furthermore, color reproduction techniques include reproduction apparatus based on electrophotographic techniques, laser printers, heat-developing dye diffusion systems using silver halide and pictrography (trade mark of the Fuji Photo Film Co., Ltd.) using an LED.

The methods using a photosensitive material includes means for recording comprising an optical system which emits light corresponding to the image data. Additionally, these methods allow for high resolution or binary recording as well as multi-gradation recording, and advantageously provide an image of high quality. Particularly, the methods using a silver halide color photosensitive materials are advantageous, because the image is chemically formed, as compared with systems using electrophotographic materials.

JP-A-55-13505 (the term "JP-A" as used herein means an "unexamined published Japanese patent application") discloses a color image recording system using a color photographic material, which operates by controlling yellow, magenta and cyan color image formation with three light beams each having different emission wavelengths, such as light beams of green color, red color and infrared.

JP-A-61-137149 discloses a color photographic material comprising at least three silver halide emulsion layers containing conventional color couplers provided on a support, wherein at least two layers are sensitized to the emission wavelength of a laser beam in the infrared region (without exposure to visible light) and also discloses the basic conditions thereof.

JP-A-63-197947 discloses a full color recording material wherein at least three layers of the photosensitive layer units containing color couplers are provided on a support, at least one layer of which is spectrally sensitized to have a maximum wavelength sensitivity longer than about 670 nm that is sensitive to a LED or semiconductor laser beam, such that a color image can be obtained by light scanning exposure and color development. Furthermore, a high-sensitivity, stable spectral sensitizing method and a method for using dyes are also disclosed therein.

When a semiconductor laser is used for the scanning exposure, the exposure device can advantageously be made to be compact and inexpensive. S. H. Baek, et al. reported a semiconductor laser output controlling mechanism of the continuous scanning type for printers and the basic conditions for the operation thereof on pages 245–247 of the preliminary manuscript for the fourth Nonimpact Printing (NIP) International Conference (SPSE) (Mar. 23, 1988).

The methods for preparing hard copies from soft information sources by using a silver halide color photosensitive material are advantages in that a stable image of high quality is obtained as compared with nonsensitive recording methods and methods using electrophotographic materials. However, when using a silver halide photosensitive material, it is difficult to carry out color development in a rapid and simple manner commensurate to the rate of the scanning exposure.

Therefore, in order to be practically used in a scanning exposure system, the color development of the full color recording material must be completed in 90 seconds or less to be adaptable to the writing speed of an output device using a semiconductor laser beam.

A silver iodobromide emulsion, a silver bromide emulsion and a silver chlorobromide emulsion are known as silver halide emulsion for use in a silver halide photographic material that is suitable for writing (exposure) with a laser beam. Among them, silver halide emulsions having a high silver chloride content are preferred for fast development. However, the above-described patent publications are silent with respect to the case of use a silver chloride emulsion or a silver chlorobromide emulsion having a high silver chloride content, and particularly, a silver chloride content of at least 96 mol %. Additionally, it has been found that the desired rapid processing is not achieved when color photosensitive materials described in the above noted patent publications are used. Furthermore, it has been found that the above-described rapid in color development can not be achieved simply by using a silver halide emulsion having a high silver chloride content of at least 96 mol %.

A silver halide color photographic material which can be subjected to rapid, simple, continuous color development processing, which is suitable for scanning exposure and which is able to provide an image having high quality is highly desired.

Exposure devices using a semiconductor laser for scanning exposure are compact and inexpensive. However, it has been found that the light emission intensity and light emitting wavelength region of semiconductor lasers are unstable in comparison with gas lasers. Particularly, the latitude of modulation of the emission intensity as a function of input current of a semiconductor laser beam having a relatively short wavelength is considerably narrow. Further improvements in silver halide photographic materials are therefore needed to reproduce an image of excellent quality. Firstly, the spectral sensitization wavelength region of each layer of differing color sensitivity must be sufficiently wide (e.g., 40 to 60 nm), and the overlapping of the sensitization wavelength region of each layer of differing color sensitivity is preferably low (e.g., a logarithmic difference of sensitivity of layers of differing color sensitivity at the dominant sensitivity wavelength of at least 0.50 ). Secondly, it is necessary that a stable latent image be obtained with an exposure time of from $10^{-4}$ to $10^{-8}$ seconds, and that the exposure region has a sufficiently linear gradation in a photographic characteristic curve of 0.5 or more, and preferably 1.0 or more (represented by logarithm). Accordingly, a silver halide color photographic material is desired which meets the requirements of the simplicity and rapid color development, and which provides good stability, sensitivity, color separation and gradation.

Furthermore in order to attain rapid simple color development as described above, the photosensitive materials must be thin and must be sufficiently flexible to be easily conveyed through processor. Particularly, when a scanning exposure system employing a laser beam is used, the photosensitive material must have a smooth surface and uniform light reflection characteristics. Furthermore, the production cost must be minimized.

Generally, a substrate obtained by coating both sides of base paper with polyethylene is used as a support for the photographic paper. To obtain supports having a smooth surface, various proposals have been advanced. For example, JP-A-60-67940 discloses a pulp for preparing a base paper for a support, wherein the void volume of pores having a pore size of not greater than 0.4 μm is not less than 0.04 ml/g. JP-A-60-69649 discloses the use of a wood pulp having an average fiber length of 0.4 to 0.9 mm, an average fiber width of not less than 13.5 μm and an average fiber thickness of not greater than 4 μm. JP-A-61-275752 discloses the use of a mixture of natural pulp containing from 5 to 60% of a hydrophobic fiber. JP-A-61-284762 discloses dehydrating conditions for obtaining a wetted paper from a pulp slurry using a two sheet wire paper machine. Furthermore, the applied pressure of a machine calender is used to increase the density of a base paper used as a support for a photographic paper, wherein the base paper is calendered between metallic rollers. In addition, the base paper is coated with a polyolefin such as polyethylene generally by an extrusion coating method. Namely, the polyolefin is molten at a high temperature and cast on the surface of the base paper to thereby coat the base paper with the polyolefin. Attempts have been made to thicken the coated polyolefin layer or to increase the pressing pressure during the polyolefin coating in order to improve the smoothness of the support.

However, the above-described techniques used to smoothen the water-resistant resin layer provided on the surface of the support are not satisfactory with respect to the degree of smoothness required for rapid processing, particularly when a scanning exposure system comprising a laser beam as the light source is employed. In addition, these techniques are disadvantageous with respect to cost. Furthermore, when the above described techniques are employed to increase the density of a base paper for a thin support blackening or paper denting tends to occur, and edge staining tends to occur in the rapid color development stage.

SUMMARY OF THE INVENTION

An object of the present invention is to provide a silver halide color photographic material comprising a cyan coupler, a magenta coupler and a yellow coupler in each photosensitive layer which can be subjected to rapid, simple, and continuous color development processing commensulate to scanning exposure speed.

A second object of the present invention is to provide a method for forming a color image of high quality by color developing the color photographic material of the invention after scanning exposure.

A third object of the present invention is to provide a silver halide color photographic material having a spectral sensitivity adaptable to a scanning exposure speed, and which is rapidly color developed to provide a high quality print, and is sufficiently thin and flexible to be easily conveyed through processor.

A fourth object of the present invention is to provide a color photographic material which does not have the problems of edge staining or unevenness of exposure in a rapid simple color development stage.

Other objects of the present invention will become apparent from the following detailed description and Examples.

The present inventors have investigated the characteristic features of color coupler-in-emulsion type color photographic materials for scanning exposure, and particularly for a scanning exposure system using a semiconductor laser beams. As a result, it has been found that the objects of the present invention are achieved by providing the following material and method.

(1) A silver halide color photographic material comprising a support having thereon at least three photosensitive layers containing a silver chloride emulsion or a silver chlorobromide emulsion having an average silver chloride content of at least 96 mol % and containing substantially no silver iodide, said at least three sensitive layers comprising a cyan coupler-containing layer, a magenta coupler-containing layer and a yellow coupler-containing layer, wherein said at least three sensitive layers each has different spectral sensitivity peak in the wavelength regions of 650 to 690 nm, 720 to 790 nm and 770 to 850 nm, respectively, and the total coating weight of silver halide is not more than 0.78 $g/m^2$ in terms of silver.

(2) A silver halide color photographic material comprising a support having thereon at least three silver halide photosensitive layers containing a silver chloride emulsion or a silver chlorobromide emulsion having an average silver chloride content of at least 96 mol % and containing substantially no silver iodide, said at least three photosensitive layers comprising a cyan coupler-containing layer, a magenta coupler-containing layer and a cyan coupler-containing layer, said support is a reflective support comprising a base paper impregnated with a synthetic polymer and which is coated with a water-resistant resin layer containing a white pigment, said at least three sensitive layers each has different spectral sensitivity peak in the wavelength regions of 650 to 690 nm, 720 to 790 nm and 770 to 850 nm, respectively, and the total coating weight of silver halide is not more than 0.78 g/m$^2$ in terms of silver.

(3) A method for forming a color image comprising exposing a silver halide color photographic material as described in the above item 1 or 2, with at least three scanning laser beams each having different light-emitting wavelengths in the wavelength regions of 650 to 690 nm, 720 to 790 nm and 770 to 850 nm, wherein the average exposure time per one picture element of the photographic material is not longer than $10^{-4}$ seconds, and then subjecting the exposed photographic material to processing comprising color developing and drying within 20 seconds after completion of the scanning exposure, wherein the color development time does not exceed 30 seconds, the total processing time excluding drying time is not longer than 90 seconds, and the drying time is not longer than 30 seconds.

DETAILED DESCRIPTION OF THE INVENTION

The beam output mechanism for use in the present invention is illustrated below.

Examples of semiconductor lasers for use in the present invention include those containing $In_{1-x}Ga_xP$ (650 to 700 nm), $GaAs_{1-x}P_x$ (610 to 900 nm), $Ga_{1-x}Al_xAs$ (690 to 900 nm), etc. as the light-emitting material: The color photographic material of the present invention may also be exposed with a YAG laser wherein a Nb:YAG crystal is excited with a light-emitting $GaAs_xP_{(1-x)}$ diode. Preferably, semiconductor lasers are selected from among those emitting beams of about 670, 680, 750, 780, 810 and 830 nm.

Preferably, each of the yellow coupler-containing photosensitive layer, the magenta coupler-containing photosensitive layer and the cyan coupler-containing photosensitive layer of the color photographic material of the present invention has a spectral sensitivity adapted to a combination of the following three kinds of wavelength laser beams.

Example-1

Oscillating wavelength
660 to 680 nm (AlGaInP)
730 to 770 nm (GaAlAs)
790 to 830 nm (GaAlAs)

Example-2

Oscillating wavelength
660 to 680 nm (AlGaInP)
760 to 790 nm (GaAlAs)
810 to 850 nm (GaAlAs)

Example 3

Oscillating wavelength
660 to 680 nm (AlGaInP)
730 to 770 nm (GaAlAs)
810 to 850 nm (GaAlAs)
and the like.

The output apparatus described in Japanese Patent Application No. 63-226552 can be used in the present invention.

A first embodiment of the reproduction apparatus which can be used in the present invention is illustrated below in reference to FIG. 1.

Figure 1:
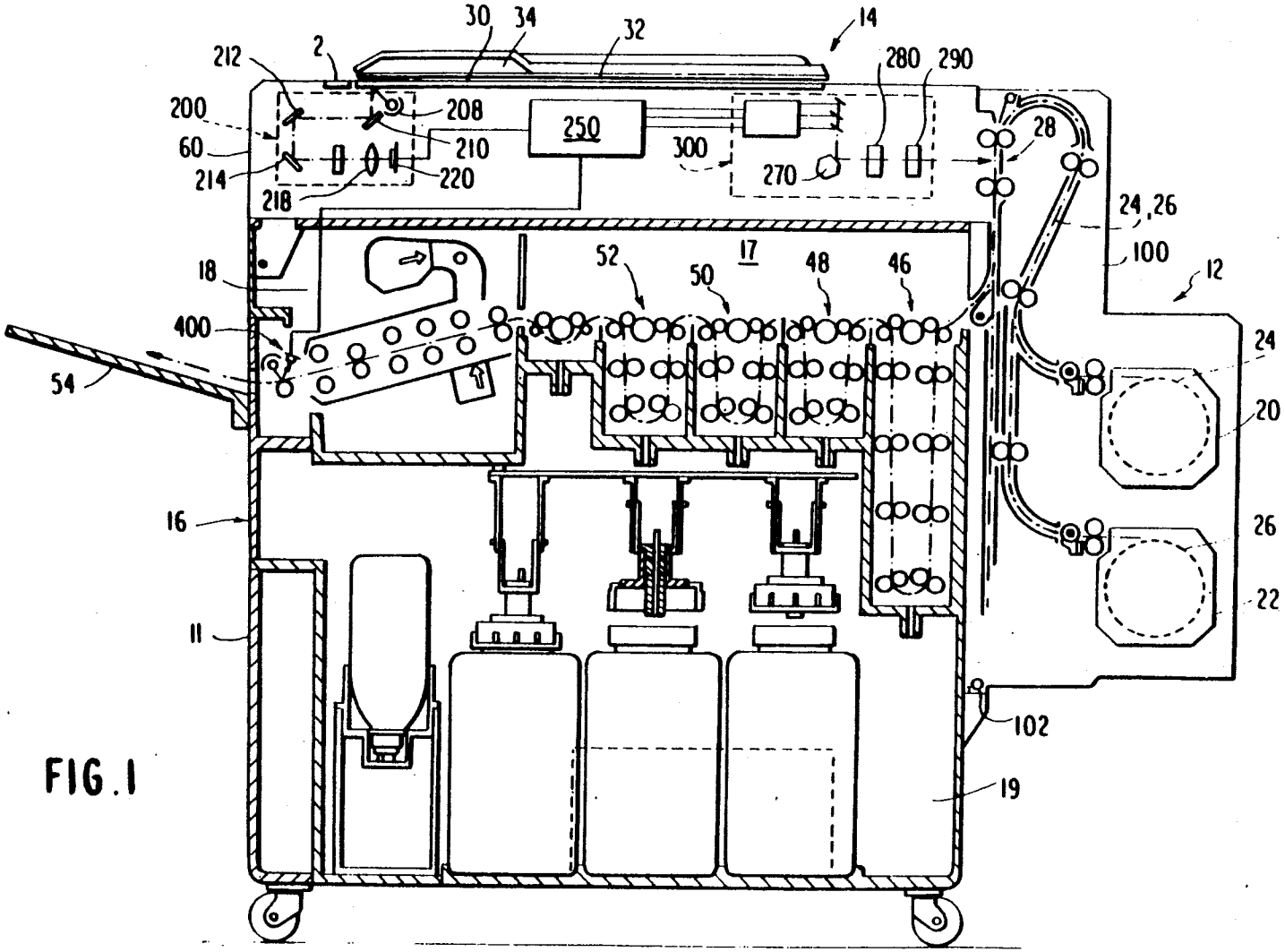
FIGS. 1 and 2 each is a cross-sectional view of a reproduction apparatus. In the apparatus of FIG. 2 slit-form processing tanks are used.

FIG. 1 is a cross-sectional view of a reproduction apparatus for use in the present invention.

The main body 11 of the reproduction apparatus of the present invention has a photographic material feed unit 12 on the right side thereof, an exposure unit 14 at the upper part and a processing unit 16 at the lower part. The exposure unit 14 has an image readout device 200, an image processing device 250 and an exposure device 300. The processing unit 16 has a processing part 17 at the right upper part thereof, a drying part 18 at the left upper part thereof and a stock solution reservoir 19 at the lower part thereof, said reservoir 19 keeping supply bottle for replenishing processing solution.

The photographic material feed unit 12 of the silver salt photographic color reproduction apparatus includes magazines 20 and 22 which can be loaded at the upper and lower parts thereof. Photographic materials 24 and 26 are placed in the form of a roll within each of these magazines, and are taken out from the top thereof and fed to the photographic material feed unit 12. For example, photographic material 24 is suitable for us in the reproduction of original color photographs, and photographic material 26 is suitable for use in the reproduction of original color prints.

The photographic material 24 or 26 taken out from the magazine 20 or 22 is passed through the photographic material feed unit 12 and fed to the exposure part 28 where the image of the color original 32 on a transparent stand 30 for the original provided above the exposure unit 14 is exposed. The color original 32 is closely pressed against stand 30 for the original by means of press 34 and illuminated by light from light source 208 within the image readout device 200 The image of the color original 32 is reflected by a plurality of mirrors 210, 212 and 214, passed through image forming lens 218, and read out by CCD sensor 220. The image read out is subjected to processing such as color correction and gradation conversion in the image processing device 250, and the photographic material 24 or 26 in exposure part 28 is exposed by exposure device 300.

When pre-scan or white balance is retouched, the original image or an image from a white color plate is inputted into the CCD sensor 220 through mirrors 210, 212 and the lens 218 to determine conditions for correcting the exposure In the processing unit 16, developing tank 46, bleaching-fixing tank 48 and rinsing tanks 50 and 52 are arranged for continuous processing within processing part 17. Development, bleaching-fixing and rinsing are carried out by processing solutions charged into these tanks, and the resulting photographic material 24 or 26 is fed to drying part 18.

In drying part 18, the rinsed photographic material 24 or 26 is dried and delivered to a draw-off tray 54.

The image processing device for use in the present invention is connected to the exposure device of the reproduction apparatus and is also connected to the image readout device and a discharge sensor 400. Accordingly, color correction processing is made by inputting the signals of hue, chrome and lightness of the image receiving paper, or color gradation conversion processing (look up table system) is conducted on the basis of the previously inputted color gradation characteristics of the color photographic material, to thereby conduct the exposure. The exposure part and the processing part are substantially interlocked.

For the processing part in accordance with the present invention, the processing mechanism of a miniature laboratory can be used. For example, the processing part may comprise a processing tank wherein the processing solution are introduced into spaces surrounded without substantially exposed to the air, or may comprise a slit-form processing tank or may be wholly or partly composed of a multi-chamber tank formed by inserting contraction parts into the processing passages of development stage, desilverization stage, rinsing and/or stabilization stage as described in JP-A-63-235939 (the term "JP-A" as used herein means an "unexamined published Japanese patent application"), JP-A-63-235940 and Japanese Patent Application No. 63-292188.

In the reproduction apparatus in accordance of the present invention, gradation conversion processing can be incorporated into the image processing device, or the amount of silver halide used in the color photographic material is reduced to improve the color photographic material to thereby allow the desilverization stage in the processing part to be omitted or simplified.

Figure 2:
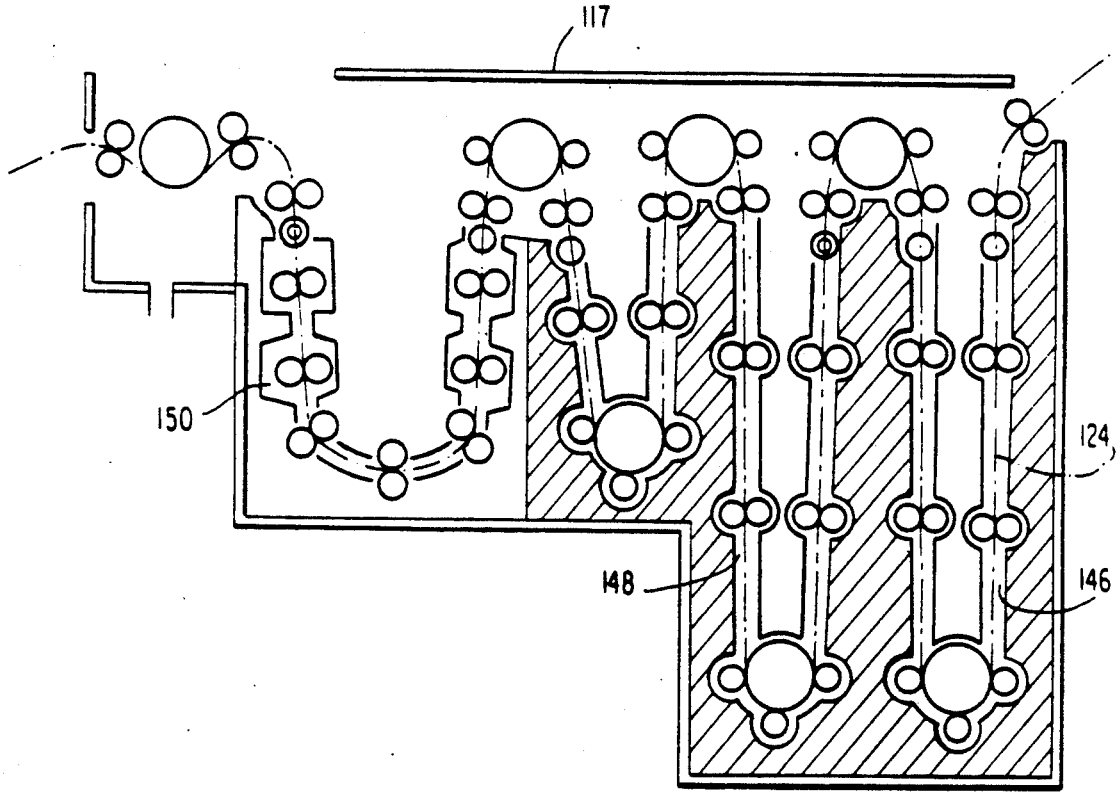

FIG. 2 shows an embodiment wherein slit-form processing tanks are used in the processing part of the reproduction apparatus.

The processing part 117 is provided with a slit-form development tank 146, a slit-form bleaching-fixing tank 148, a multi-chamber rinsing or stabilization tank 150 and a draining part. Replenisher is introduced through the inlet of the tank or through a replenishing port in the vicinity of an outlet in the conveying direction of the photographic material, or opposite direction thereof. For the development tank and the bleaching-fixing tank, replenisher is introduced from the inlet side, while for the rinsing or stabilization tank, replenisher is introduced from the outlet side. Film 124 is processed in the processing part.

The slit-form processing tank for use as the processing tank in accordance with the present invention means that when a passage in the processing tank through which the photographic material is passed is cut at right angles to the progress of the photographic material, the cross section of the slit is such that the thickness of the slit is much smaller in comparison with the width of the slit (the width direction of the photographic material). The cross section of the slit form may be a rectangle or in the shape of an ellipse.

The shape of the processing tank having such a slit-form passage is preferably defined by the following formula:

$$V/L \leqq 20$$

wherein V is the volume ($cm^3$) of the processing solution in the processing tank, and L is the length (cm) of the central passage (processing passage) of the photographic material from the surface of the solution at the inlet of the photographic material in the processing tank to the surface of the solution at the outlet thereof. Most preferably $V/L \leqq 10$.

The slit-form processing tank is characterized in that the ratio of the amount of the solution charged to the length of the passage is small. Since the amount of processing solution in the processing tank is small, the exchange of the solution in the processing tank by the replenishment of the processing solution is hastened. Namely, the residence time of the solution in the processing tank is shortened to prevent exhausting with the processing solution the passage of time. However, it is practically preferred that the lower limit of V/L is 0.1, and particularly 0.5.

In the processing tank, V is preferably 10,000 to 100 $cm^3$, more preferably 5,000 to 200 $cm^3$, most preferably, 1,000 to 300 $cm^3$ and L is preferably 300 to 10 cm, more preferably 200 to 20 cm, most preferably 100 to 30 cm.

When processing is carried out by using the slit-form processing tank, it is preferred to use a processing tank wherein the area S ($cm^2$) (hereinafter referred to as area of opening or opening area) of a liquid surface brought into contact with air is small in comparison with the volume ($cm^3$) of the liquid. Preferably, V and S are such that $$S/V \leqq 0.05$$

It is particularly preferred that $S/V \leqq 0.01$. Namely, a smaller S/V value means that the processing solution undergoes less oxidation by contact with air, the amount of the solution evaporated is smaller and the solution remains stable over a longer period of time. However, the lower limit is practically 0.0005, and particularly 0.001.

The first feature of the color photographic material of the present invention is the halogen composition of silver halide emulsion of the silver halide photosensitive layers. The silver halide grains have such a halogen composition that at least 96 mol % of the entire silver halide constituting silver halide grains is silver chloride. The silver halide contains substantially no silver iodide. The term "contains substantially no silver iodide" as used herein means that the content of silver iodide is not greater than 1.0 mol %. A silver iodide amount of not more than 0.9 mol % may be adsorbed on the surfaces of grains, in particular, by the anionic salt formation of sensitizing dyes, or by the use of adsorption accelerators of the sensitizing dyes. Inorganic silver salt such as silver rhodanide may also be included in the silver halide emulsion of the present invention. A preferred silver halide composition is silver chlorobromide having a silver chloride content of from 96 to 99.9 mol % based on the entire silver halide constituting the silver halide grains. Also, the silver halide is preferably composed of the pure silver chloride.

The silver halide grains of the present invention preferably have localized phases as described below. When the silver halide grains of the present invention are silver chlorobromide grains, the grains have preferably localized silver bromide phases having different silver bromide contents at least in the interiors of grains or on the surfaces thereof. When the silver halide grains of the present invention are pure silver chloride grains, the grains have preferably localized phase of different metal ions other than silver ion, such as Ir ion, Rh ion or Fe ion, in different amounts.

When the silver halide grains of the present invention are silver chlorobromide grains, the grains preferably have localized phases having a silver bromide content of at least 15 mol %. The arrangement of localized phases having a silver bromide content higher than that of the surrounding areas is not particularly restricted. The localized silver bromide phases may be present in the interior of the silver halide grains or on the surfaces or subsurfaces thereof, or in both the interior and on the surfaces or subsurfaces thereof. The localized phase may exist in the interiors of a grain or on the surface thereof in such layer structure that silver halide grain is surrounded by the layer(s). Alternatively, the localized phases may be present as discontinuously isolated structures. In a preferred embodiment the localized phases having a silver bromide content higher than that of the surrounded areas of at least 15 mol % are formed by local epitaxial growth on the surfaces of the silver halide grains.

The localized phases have preferably a silver bromide content exceeding 15 mol %. However, when the silver bromide content is too high, pressure applied to the photographic material, tends to impart unfavorable properties to the photographic material. For example, desensitization may result, or the sensitivity and gradation may be greatly changed by variation in the composition of the processing solution. When these factors are taken into consideration, the localized phases preferably have a silver bromide content in the range of from 20 to 60 mol %, and most preferably 30 to 50 mol %, wherein the balance of the silver halide is silver chloride. The silver bromide content of the localized phase can be determined by X-ray diffractometry (e.g., as described in *New Experimental Chemical Lecture* 6, *Structural Analysis,* edited by Nippon Chemical Society, and published by Maruzen or by the XPS method (e.g., as described in *Surface Analysis, Application of IMA, Auger Electron, Photoelectron Spectral,* edited by Kodansha). The localized phases preferably constitute from 0.1 to 20%, and more preferably from 0.5 to 7% of silver based on the total amount of silver contained in the silver halide grains of the present invention.

The interface between the localized phase having such a high silver bromide content and other phase may constitute a distinct phase interface, or may be an area where the halogen composition gradually changes.

The localized phases having such a high silver bromide content can be formed by various methods. For example, the localized phases can be formed by a single jet process or a double jet process wherein a soluble silver salt and a soluble halogen salt are reacted. The localized phases may be formed by a conversion method, including a step where previously formed silver halide is converted into a silver halide having a smaller solubility product. Alternatively, the localized phases may be formed by adding fine grains of silver bromide which recrystallize on the surfaces of silver chloride grains.

In the silver halide grain having discontinuous isolated localized phases on the surfaces thereof, the grain substrate of the grain and the localized phases exist substantially on the same grain surface, and hence they function simultaneously in each process of exposure and development. Therefore, such grains are advantageous for providing high sensitivity, latent image formation, rapid processability, and for particularly providing a balance of gradation and the effective utilization of silver halide. Red to infrared-sensitized high silver chloride content emulsions conventionally are disadvantageous with regard to high sensitivity, stabilization of sensitivity and stability of the latent image. However, the properties of the high silver chloride content emulsion can be remarkably improved on the whole, by providing the above described localized phases. Furthermore, the rapid development feature of the high silver chloride content emulsion is maintained by providing the localized phases.

An anti-fogging agent, sensitizing dye, etc. may be adsorbed on the silver halide grains or the grains are chemically-sensitized in such a manner that the grain substrate and the localized phases function separately to facilitate rapid development, while inhibiting the occurrence of fogging.

The silver halide grains of the present invention preferably are in the form of, for example, a hexahedron or tetradecahedron having a (100) plane. The localized phases often exist on the corners of the hexahedron or in the vicinity thereof, or on the surface of the (111) plane. Such discontinuous isolated localized phases on the surfaces of the silver halide grains can be formed by a halogen conversion method wherein bromide ion is introduced into an emulsion containing substrate silver halide grains, while controlling pAg, pH, temperature and time. Preferably, the bromide ion is introduced at a low concentration. For example, an organohalogen compound or a halogen compound which is covered with capsule membrane of a semipermeable film may be used for the purpose. The localized phases can be formed by a method wherein silver ion and halide ion are introduced into an emulsion containing substrate grains, while controlling pAg, etc., to grow silver halide at a local site, or a method wherein fine particles of silver halide such as fine particles of silver iodobromide, silver bromide, silver chlorobromide or silver iodochlorobromide are incorporated into the grain substrate by recrystallization. If desired, a small amount of a solvent for silver halide may be used in forming the localized phases. Furthermore, the CR-compounds described in European Patents 273430 and 273429, Japanese Patent Application Nos. 62-86163, 62-86165, and 62-152330 and JP-A-1-6941 may be used. The end point of the formation of the localized phases is readily determined by observing the form of silver halide during the course of ripening while comparing this observed form with the form of the silver halide grain substrate. The silver halide composition of the localized phase can be determined by XPS (X-ray Photo-Electron Spectroscopy) using, for example, an ESCA 750 type spectrometer manufactured by Shimazu-du Pont K.K. More specifically, the measuring method is described in *Surface Analysis,* written by Someno and Yasumori edited by Kodansha, (1977). The composition can also be determined by calculation from the manufacturing formulation. The silver halide composition, for example, the silver bromide content of the localized phases on the surfaces of the silver halide grains of the present invention can be measured with an accuracy of about 5 mol % in an aperture of about 0.1 to 0.2 μm in diameter by EDX (Energy Dispersive X-ray Analysis), using an EDX spectrometer equipped with a transmission type electron microscope. Further the measuring method is concretely described in *Electron Beam Microanalysis,* written by Hiroyoshi Soejima, published by Nikkan Kogyo Shinbunsha (1987).

The grains of the silver halide emulsions of the present invention preferably have a mean size (an average of the diameter of the spheres calculated in terms of the volume of grains) not exceeding 2 μm, but not less than 0.1 μm, and more preferably not exceeding 1.4 μm, but not less than 0.15 μm.

The grain size distribution is preferably narrow. Monodisperse emulsions are preferred, and monodisperse emulsions having a regular form are preferred. The emulsion preferably has such a grain size distribution such that at least 85%, and particularly at least 90% (in terms of the number of grains or the weight of grains) of all of the grains consist of grains having a grain size within ±20% of the mean grain size.

The silver halide emulsion of the present invention can be prepared by any of the methods described in P. Glafkides, *Chimie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). Namely, the acid process, the neutral process and the ammonia process can be used. The acid process is particularly preferred. A soluble silver salt and a soluble halogen salt can be reacted in accordance with the single jet process, the double jet process or a combination thereof. The double jet process is preferred to obtain monodisperse grains which are preferably used in the present invention. A reverse mixing method, in which grains are formed in the presence of an excess of silver ion, can also be used. A controlled double jet process wherein the silver ion concentration in the liquid phase, in which the silver halide is formed is kept constant, can also be used. By using the controlled double jet process, a monodisperse silver halide emulsion suitable for use in the present invention and having a regular crystal form and a narrow grain size distribution is obtained. The silver halide grains for use in the present invention are preferably prepared using the double jet process.

When physical ripening is carried out in the presence of a conventional solvent (e.g., ammonia, potassium thiocyanate or thioethers and thione compounds as described in U.S. Pat. No. 3,271,157, JP-A-51-12360, JP-A-53-82408, JP-A-53-144319, JP-A-54-100717 or JP-A-54-155828) for silver halide, monodisperse silver halide emulsions having a regular crystal form and a narrow grain size distribution are obtained.

Soluble silver salt is removed from the emu'sion thus prepared after physical ripening by noodle washing, flocculation precipitation, or ultrafiltration.

The silver halide emulsion of the present invention may be subjected to chemical sensitization such as selenium sensitization, reduction sensitization, noble metal sensitization, etc., singly or in combination thereof. Namely, a sulfur sensitization method using a sulfur containing compound which reacts with silver ion or active gelatin (e.g., thiosulfates, thiourea compounds, mercapto compounds, rhodanine compounds, etc.), a reduction sensitization method using a reducing substance (e.g., stannous salts, amine salts, hydrazine derivatives, formamidine sulfinic acid, silane compounds, etc.) and a noble metal sensitization method using a metallic compound (e.g., gold complex salts, complex salts of VIII group metals of the Periodic Table such as Pt, Ir, Pd, Rh, Fe, etc. of the Periodic Table, etc.) can be used singly or in a combination. It is preferred that a complex salt of a metal of the Group VIII metals such as Ir, Rh, Fe, etc. of the Periodic Table be used in either one or both of the grain substrate and the localized phase or be distributed to both of them. Sulfur sensitization or selenium sensitization is particularly preferred for the monodisperse silver chlorobromide emulsion of the present invention. Hydroxyazaindene compounds are preferably present during the chemical sensitization.

In the color photographic material of the present invention, the reciprocity law failure characteristics thereof are preferably small at high illuminance. Namely, the photosensitivity is high and the resulting latent image is stable when exposure is conducted for $10^{-4}$ to $10^{-8}$ seconds, and particularly $10^{-6}$ to $10^{-8}$ seconds. For the purpose of improving these characteristics, metal ions of the Group VIII metals such as Ir, Rh, Fe, etc. of the Periodic Table or complex salts thereof are preferably incorporated into the silver halide grains of the present invention. When the silver halide grains of the present invention have localized phases, both high sensitivity and the stabilization of the resulting latent image is achieved by varying the content of Ir ion or a complex salt thereof, combining the Ir ion with another metal ion such as Rh ion or a complex ion thereof, and incorporating these metal ions in the substrates of the silver halide grains or the localized phases thereof. The content of the Group VIII metal in the silver halide grains is in the range of from $10^{-9}$ to $10^{-2}$ mol, and preferably from $10^{-8}$ to $10^{-3}$ mol per mol of silver halide. The Group VIII metal can be incorporated into the silver halide grains, for example, by the method described in JP-A-1-183647.

In the color photographic material of the present invention, silver halide grains have an average silver chloride content at least 96 mol % or silver chloride grains are spectrally sensitized to be compatible with the wavelength distribution of the scanning exposure light beams. Particularly, silver halide grains of the present invention having an average silver chloride content of at least 96% are preferably subjected to infrared sensitization of high sensitivity and preservability.

In the present invention, the use of spectral sensitizing dyes is important. Examples of the spectral sensitizing dyes for use in the present invention include cyanine dyes, merocyanine dyes and complex merocyanine dyes. In addition thereto, complex cyanine dyes, holopolar cyanine dyes, hemicyanine dyes, styryl dyes and hemioxonol dyes can be used. Examples of the cyanine dyes include a simple cyanine dye, a carbocyanine dye and a dicarbocyanine dye. Particularly, dyes selected from among sensitizing dyes represented by general formulae (I), (II), (II)' and (III) described below can be used for red to infrared sensitization. These sensitizing dyes are chemically relatively stable, are firmly adsorbed onto the surfaces of the silver halide grains, and have high resistance to desorption by the dispersion of couplers present in the emulsion.

The silver halide sensitive layers of the present invention comprise at least three sensitive layers. At least one sensitive layer, and more preferably at least two sensitive layers thereof are selectively spectrally sensitized using at least one sensitizing dye selected from the group consisting of compounds represented by general formulae (I), (II), (II)' and (III) to be compatible with the wavelength of semiconductor laser beam in any one of the wavelength regions of 650 to 690 nm, 720 to 790 nm and 770 to 850 nm.

The description "selectively spectrally sensitized to be compatible with the wavelength of a semiconductor laser beam in any one of the wavelength regions of 660 to 690 nm, 720 to 790 nm and 770 to 850 nm" as used herein, means that the dominant wavelength of the laser beam is within any of the above-described wavelength regions, and spectral sensitization is made so that the sensitivity of other sensitive layer at said dominant wavelength is practically lower by at least 0.5 (logarithmic expression) than the sensitivity of the subject sensitive layer (which is spectral-sensitized so as to be adaptable to the dominant wavelength of the laser beam) at said dominant wavelength of said laser beam. For this reason, it is preferred that the principal sensitivity wavelength of each sensitive layer is set such that the principle sensitivity wavelengths of the sensitive layers differ by at least 30 nm from each other according to the dominant wavelength of the semiconductor laser beam employed. The spectral sensitizing dyes for use in the present invention preferably have a high sensitivity at the dominant wavelength, and a sharp spectral sensitivity distribution. The laser beam is characterized herein as having a "dominant wavelength" because although a laser beam is originally coherent light, there is practically same incoherency therein.

The sensitizing dyes represented by the general formulae (I), (II), (II)' and (III) are described below.

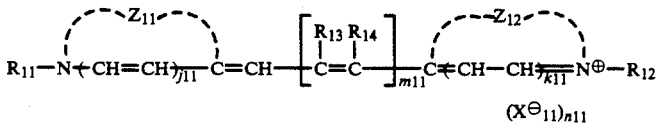

(I)

In this formula, $Z_{11}$ and $Z_{12}$ each represent a group of atoms which is required to form a heterocyclic ring.

The heterocyclic ring is preferably 5- or 6-membered rings which may further contain, at least one of a nitrogen atom, a sulfur atom, an oxygen atom, a selenium atom or a tellurium atom as hetero-atom (and the ring may be bound with a condensed ring and it may be substituted with at least one substituent).

Actual examples of the aforementioned heterocyclic nuclei include a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a naphthoxazole nucleus, a imidazole nucleus, a benzimidazole nucleus, a naphthimidazole nucleus, a 2-or 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus and a naphthotellurazole nucleus.

$R_{11}$ and $R_{12}$ each represent an alkyl group, an alkenyl group, an alkynyl group or an aralkyl group. These groups and the groups described hereinafter (in the definition for formulae (II), (II)' and (III)) include groups which have substituent groups. For example, "alkyl groups" include both unsubstituted and substituted alkyl groups, and these groups may be linear chain, branched or cyclic groups. The alkyl group and the alkenyl group each (unsubstituted or before substitution; the same hereinafter) preferably has from 1 to 8 carbon atoms.

Furthermore, actual examples of substituent groups for substituted alkyl, alkenyl, alkynyl and aralkyl groups include halogen atoms (for example, chlorine, bromine, fluorine), cyano groups, alkoxy groups, substituted and unsubstituted amino groups, carboxylic acid groups, sulfonic acid groups and hydroxyl groups. The alkyl groups may be substituted with one, or with a plurality, of these groups.

The vinylmethyl group is an example of an alkenyl group.

Benzyl and phenethyl are examples of aralkyl groups.

Moreover, $m_{11}$ represents an integer of 2 or 3.

$R_{13}$ represents a hydrogen atom, and $R_{14}$ represents a hydrogen atom, a lower alkyl group (having from 1 to 4 carbon atoms; the same hereinafter) or an aralkyl group, or it may be joined with $R_{12}$ to form a 5-or 6-membered ring. Furthermore, in those cases where $R_{14}$ represents a hydrogen atom, $R_{13}$ may be joined with another $R_{13}$ group to form a hydrocarbonyl or heterocyclic ring. These rings are preferably 5- or 6-membered rings containing at least one of N, O and S atoms (the same hereinafter). Moreover, $j_{11}$ and $k_{11}$ represent 0 or 1, $X\ominus_{11}$ represents an acid anion, such as $Cl^-$, $Br^-$, $I^-$, $SCN^-$ and p-toluenesulfonic acid anion, and $n_{11}$ represents 0 or 1.

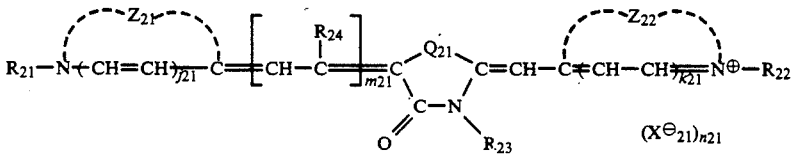

(II)

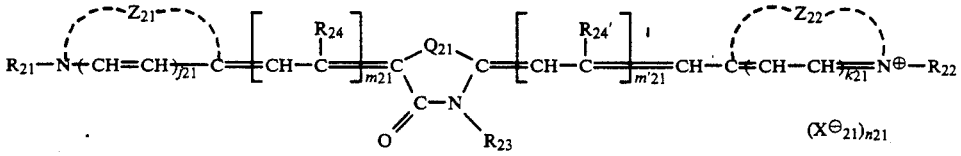

(II)'

In this formula, $Z_{21}$ and $Z_{22}$ have the same significance as $Z_{11}$ and $Z_{12}$, respectively. $R_{21}$ and $R_{22}$ have the same significance as $R_{11}$ and $R_{12}$, respectively, and $R_{13}$ represents an alkyl group, an alkenyl group, an alkynyl group or an aryl group (for example, substituted or unsubstituted phenyl group). Moreover, $m_{21}$ represents an integer of 2 or 3. $R_{24}$ represents a hydrogen atom, a lower alkyl group or an aryl group, or $R_{24}$ may be joined with another $R_{24}$ group to form a hydrocarbyl or heterocyclic ring. These rings are preferably 5- or 6-membered rings. $R'_{24}$ and $m'_{21}$ have the same significance as $R_{24}$ and $m_{21}$, respectively. The alkyl and alkenyl groups each preferably has from 1 to 8 carbon atoms.

$Q_{21}$ represents a sulfur atom, an oxygen atom, a selenium atom or an $>N—R_{25}$ group, and $R_{25}$ has the same significance as $R_{23}$. Moreover, $j_{21}$, $k_{21}$, $x_{21}\ominus$ and $n_{21}$ have the same significance as $j_{11}$, $k_{11}$, $X_{11}\ominus$ and $n_{11}$, respectively.

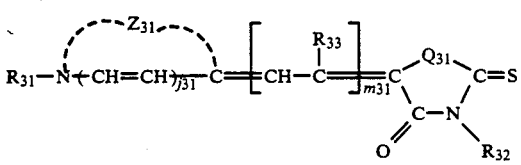

(III)

In this formula, $Z_{31}$ represents a group of atoms which is required to form a heterocyclic ring. Actual examples of this ring include, in addition to those described in connection with $Z_{11}$ and $Z_{12}$, a thiazolidine, a thiazoline, a benzothiazoline, a naphthothiazoline, a selenazolidine, a selenazoline, a benzoselenazoline, a naphthoselenazoline, a benzoxazoline, a naphthoxazoline, a dihydropyridine, a dihydroquinoline, a benzimidazoline and a naphthoimidazoline nuclei.

$Q_{31}$ has the same significance as $Q_{21}$. $R_{31}$ has the same significance as $R_{11}$ or $R_{12}$, and $R_{32}$ has the same significance as $R_{23}$. Moreover, $m_{31}$ represents 2 or 3. $R_{33}$ has the same significance as $R_{24}$, or it may be joined with another $R_{33}$ group to form a hydrocarbyl or heterocyclic ring. Moreover, $j_{31}$ has the same significance as $j_{11}$.

Sensitizing dyes in which the heterocyclic nucleus formed by $Z_{11}$ and/or $Z_{12}$ in general formula (I) is a naphthothiazole nucleus, a naphthoselenazole nucleus, a naphthoxazole nucleus, a naphthoimidazole nucleus, or a 4-quinoline nucleus are preferred. The same is true of $Z_{21}$ and/or $Z_{22}$ in general formula (II) and also $Z_{31}$ in general formula (III). Furthermore, the sensitizing dyes in which the methine chain forms a hydrocarbonyl ring or a heterocyclic ring are preferred.

Sensitization with the M-band of the sensitizing dye is used for infrared sensitization, and so in general, the spectral sensitivity distribution is broader than sensitization with the J-band. Consequently, the provision of a colored layer by incorporating a dye is in a colloid layer on the photosensitive surface side of the prescribed . photosensitive layer and correction of the spectral sensitivity distribution is desirable. Such a colored layer effectively prevents color mixing by a filter effect.

Compounds which have a reduction potential of −1.00 (V vs. SCE) or below are preferred for the sensitizing dyes for red-infrared sensitization reduction potential of −1.10 or below are preferred. Sensitizing dyes which have these characteristics are effective for providing high sensitivity and especially for stabilizing the photographic speed and the latent image.

The measurement of reduction potentials can be carried out using phase discrimination type second harmonic alternating current polarography. This can be carried out by using a dropping mercury electrode for the active electrode, a saturated calomel electrode for the reference electrode and platinum for the counter electrode.

Furthermore, the measurement of reduction potentials with phase discrimination type second harmonic alternating current voltammetry using platinum for the active electrode has been described in *Journal of Imaging Science,* Vol. 30, pages 27–45 (1986).

Preferably, they are used in combination with a compound selected from the group consisting of the compounds represented by formulae (IV), (V), (VI) and (VII) or a compound selected from the group consisting of the condensates of formaldehyde with compounds represented by formulae (VIII-a), (VIII-b) and (VIII-c) described in Japanese Patent Application No. 63-310211 (U.S. patent application Ser. No. 07/448,176 filed on Dec. 8, 1989.

Examples of the sensitizing dyes represented by the formulae (I), (II), (III) and (III)′ are shown below.

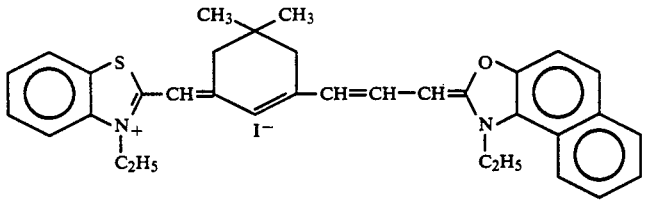

(V-1)

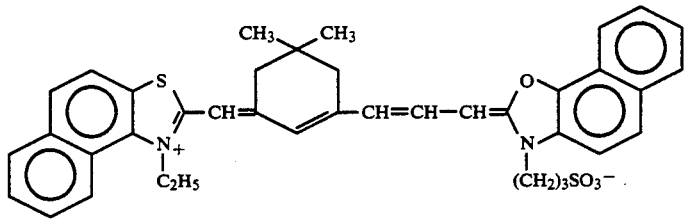

(V-2)

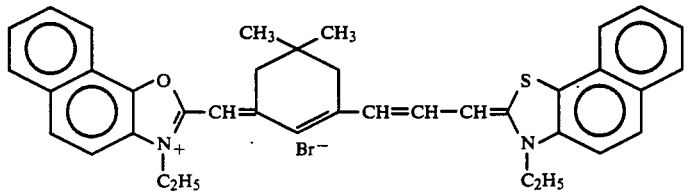

(V-3)

-continued
(V-4)
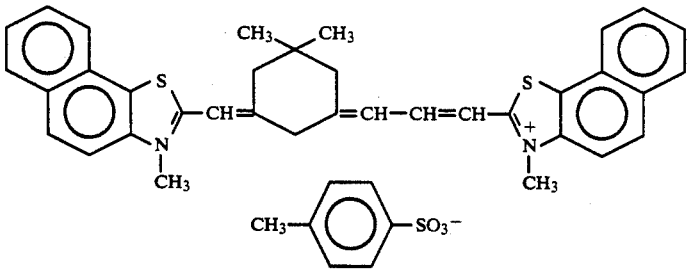
(V-5)
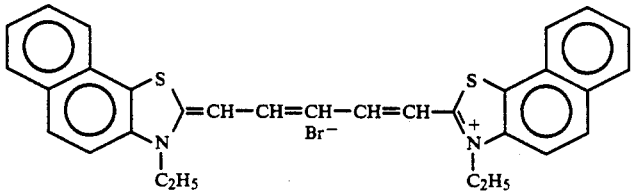
(V-6)
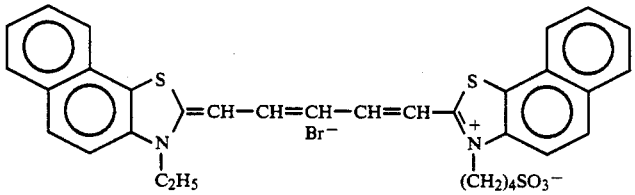
(V-7)
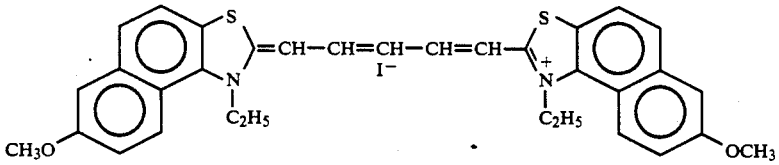
(V-8)
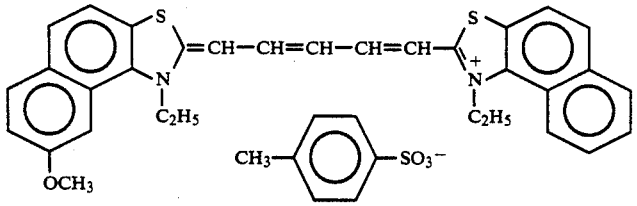
(V-9)
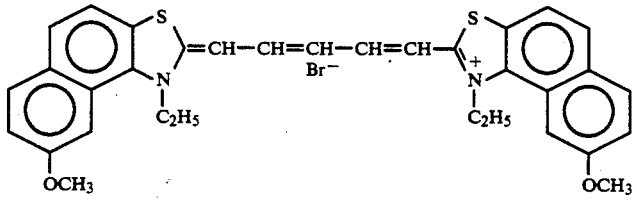
(V-10)
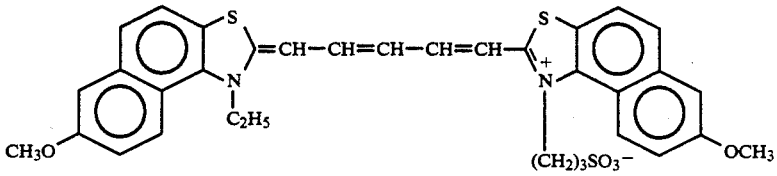

-continued
(V-11)
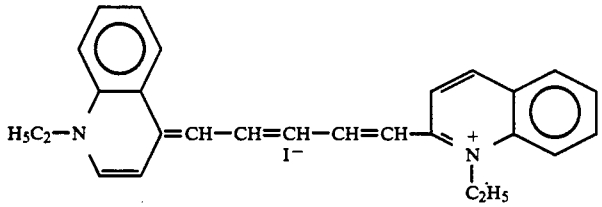
(V-12)
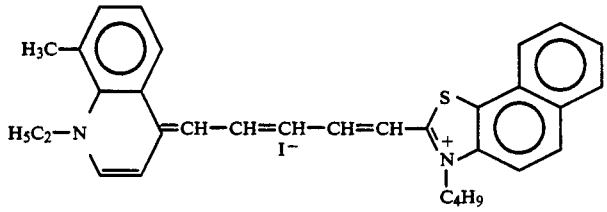
(V-13)
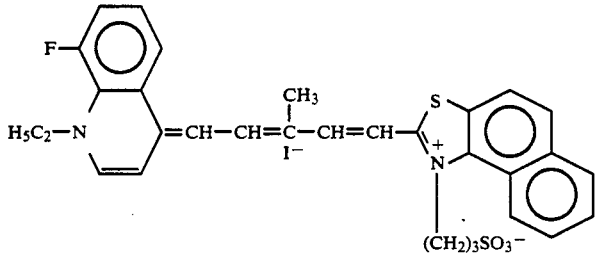
(V-14)
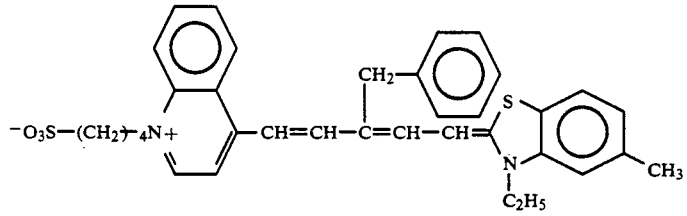
(V-15)
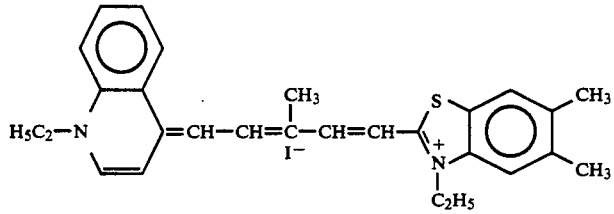
(V-16)
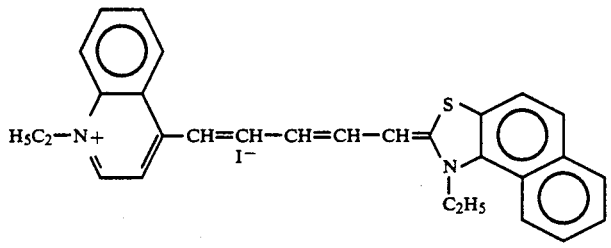

-continued
(V-17)
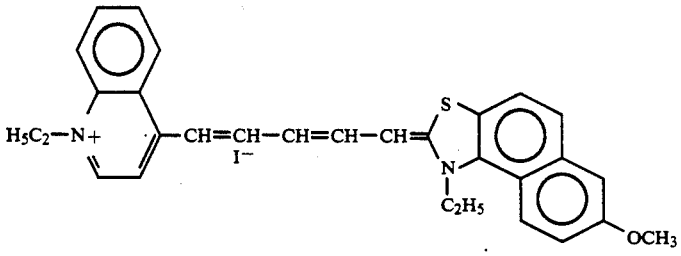
(V-18)
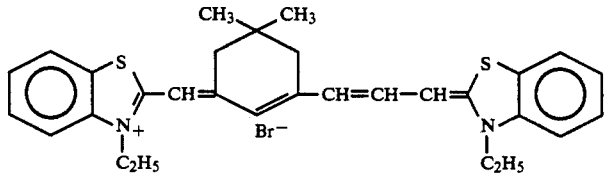
(V-19)
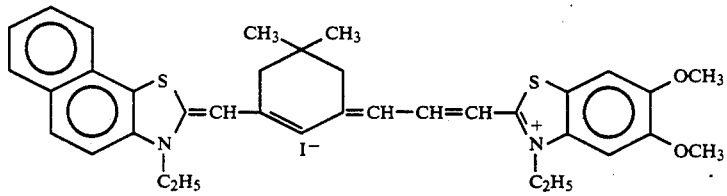
(V-20)
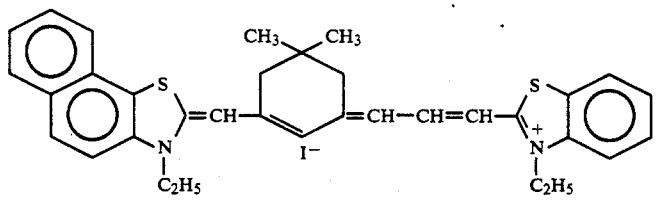
(V-21)
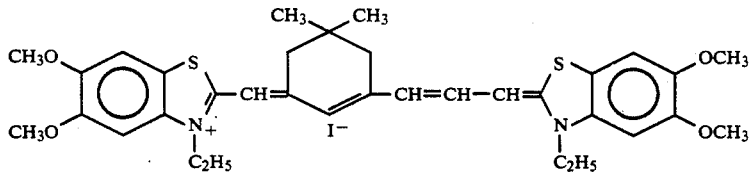
(V-22)
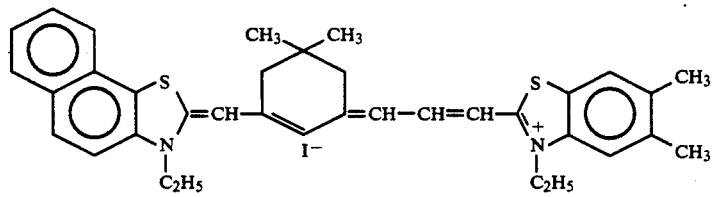
(V-23)
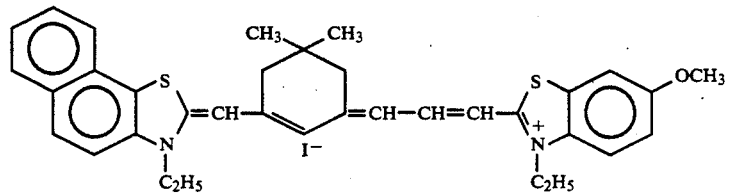

-continued
(V-24)
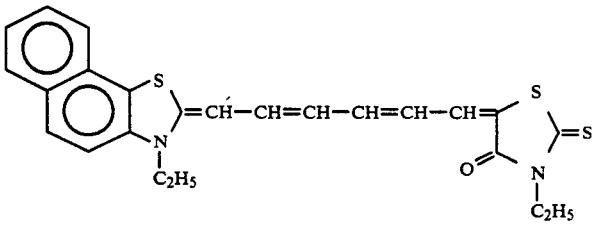
(V-25)
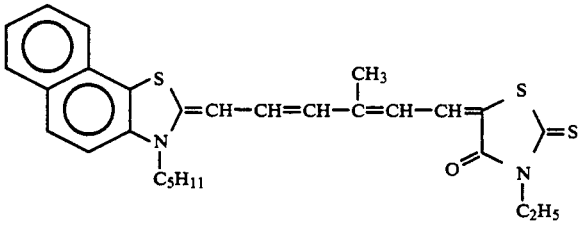
(V-26)
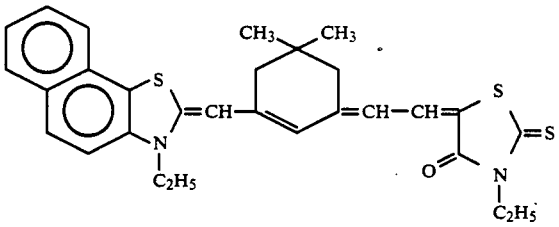
(V-27)
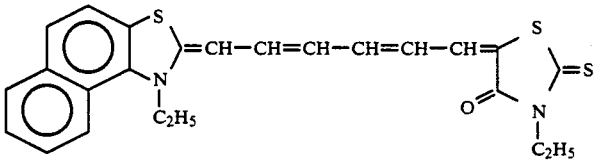
(V-28)
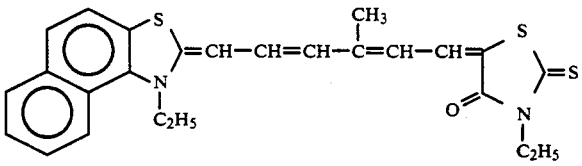
(V-29)
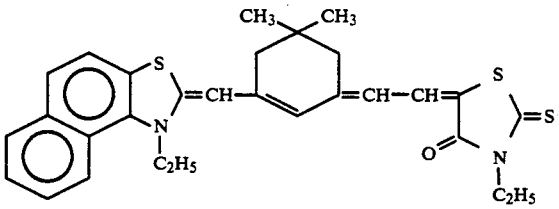
(V-30)
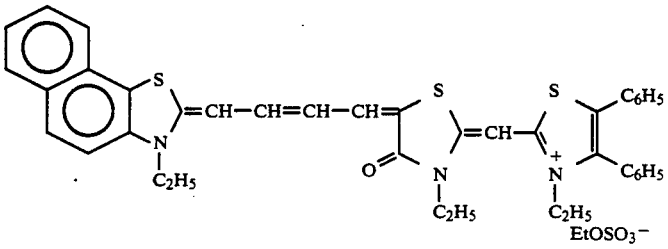

-continued
(V-31)
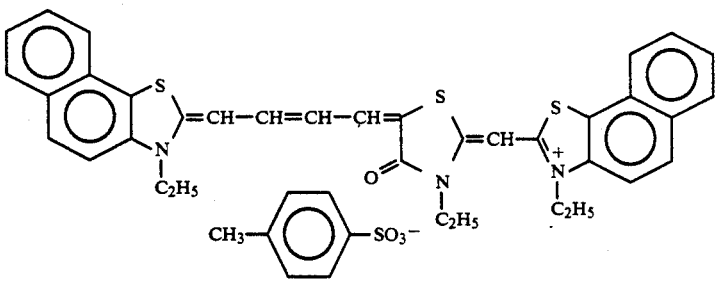
(V-32)
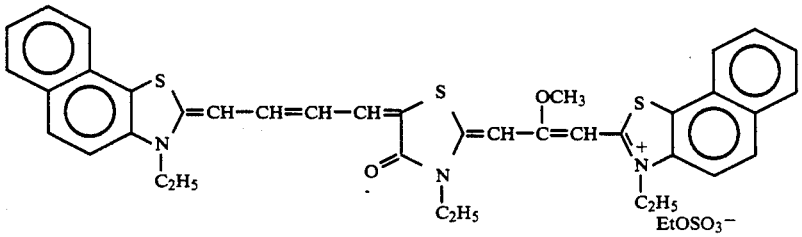
(V-33)
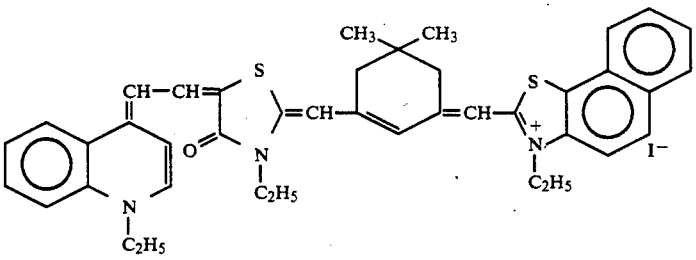
(V-34)
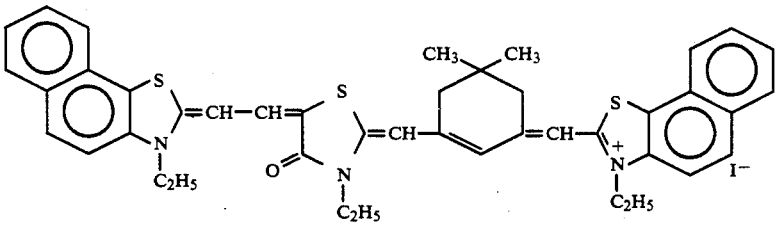
(V-35)
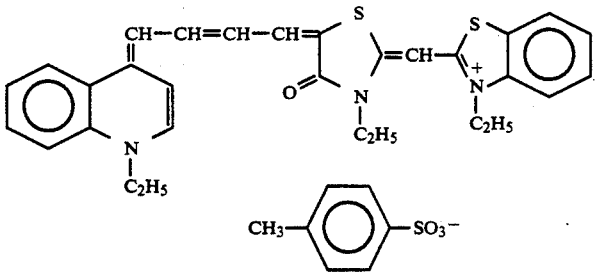
(V-36)
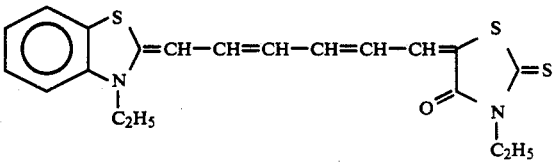

-continued
(V-37)
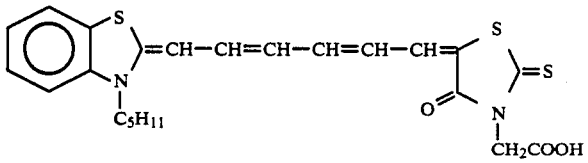
(V-38)
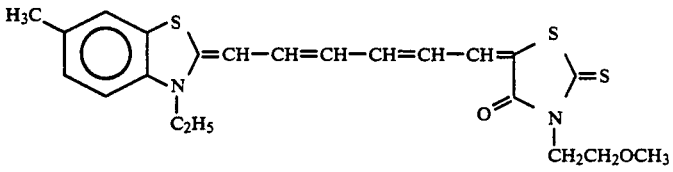
(V-39)
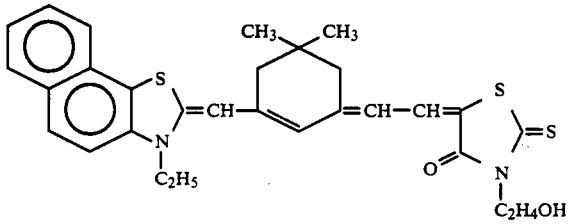
(V-40)
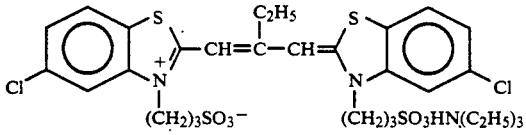
(V-41)
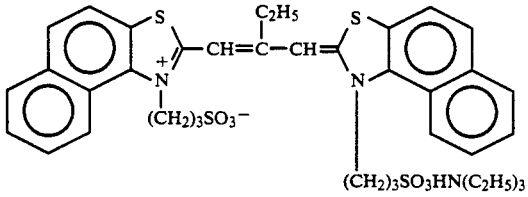
(V-42)
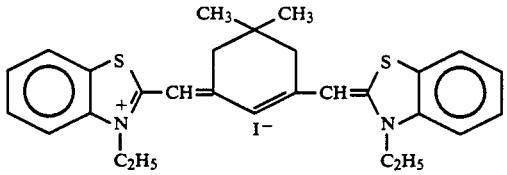
(V-43)
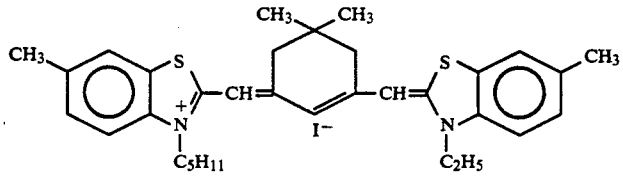
(V-44)
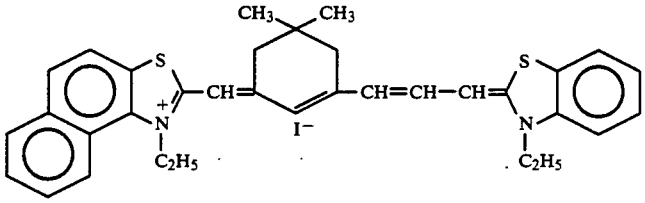

-continued (V-45)

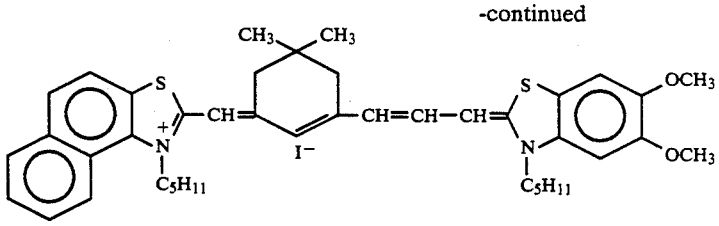

The sensitizing dyes used in the present invention are included in the silver halide photographic emulsion in an amount of from $5\times10^{-7}$ to $5\times10^{-3}$ mol, preferably in an amount of from $1\times10^{-6}$ to $1\times10^{-3}$ mol, and most preferably in an amount of from $2\times10^{-6}$ to $5\times10^{-4}$ mol, per mol of silver halide.

The sensitizing dyes used in the present invention can be dispersed directly into the emulsion. Furthermore, they can be dissolved in a suitable solvent, such as methyl alcohol, ethyl alcohol, methylcellosolve, acetone, water or pyridine, or in a mixture of such solvents, and added to the emulsion in the form of a solution. Furthermore, ultrasonics can be used for dissolution purposes. In addition, the infrared sensitizing dyes can be added using methods in which the dye is dissolved in a volatile organic solvent. The solution so obtained is dispersed in a hydrophilic colloid and the dispersion so obtained is dispersed in the emulsion, as disclosed, for example, in U.S. Pat. No. 3,469,987. Methods in which a water insoluble dye is dispersed in a water soluble solvent without dissolving and the dispersion is added to the emulsion are disclosed, for example, in JP-B-46-24185. Methods in which the dye is dissolved in a surfactant and the solution so obtained is added to the emulsion are disclosed in U.S. Pat. No. 3,822,135. Methods in which a solution is obtained using a compound which causes a red shift and in which the solution is added to the emulsion are disclosed in JP-A-51-74624. Methods in which the dye is dissolved in an essentially water free acid and the solution is added to the emulsion are disclosed in JP-A-50-80826. (The term "JP-B" as used herein signifies an "examined Japanese patent publication"). Furthermore, the methods disclosed, for example, in U.S. Pat. Nos. 2,912,343, 3,342,605, 2,996,287 and 3,429,835 can also be used for making the addition to an emulsion. Also, the above-mentioned infrared sensitizing dyes can be uniformly dispersed in the silver halide emulsion prior to coating on a suitable support. The addition can be made prior to chemical sensitization or during the latter half of silver halide grain formation.

It is preferred that couplers giving color developed couplers in a high molar ratio to developed silver halide are used in the silver halide color photographic material of the present invention so as to be adapted to rapid color development, whereby the amount of sensitive silver halide to be used can be reduced. Two equivalent type couplers are particularly preferred. Furthermore, one equivalent type couplers may be used in combination therewith. In this method, the quinone diimine derivative of an aromatic amine of a color developing agent is coupled with a color coupler, and a one electron oxidation color formation stage subsequent to said coupling reaction is carried out using an oxidizing agent other than silver halide.

Generally, color couplers which provide a maximum developed color density of at least 3 in terms of transmission density and of at least 2 in terms of reflection density are used in color photographic materials. In the image forming method using the exposure unit in the present invention, if color correction processing in combination with color gradation conversion processing is carried out in the image processing device an excellent color image is obtained at a maximum developed color reflection density of at least about 1.2, and preferably about 1.6 to 2.0. Therefore, the amount of the color couplers and sensitive silver halide used in the color photographic material of the present invention can be reduced.

In the color photographic materials, particularly in the reflection color photographic material of the present invention, a yellow coupler, a magenta coupler and a cyan coupler preferably are used in an amount of 2.5 to $10\times10^{-4}$ mol/m$^2$, 1.5 to $8\times10^{-4}$ mol/m$^2$ and 1.5 to $7\times10^{-4}$ mol/m$^2$, respectively.

Couplers for use in the color photographic material of the present invention are illustrated below.

Cyan couplers, magenta couplers and yellow couplers which are preferably used in the present invention are represented by the following general formulae (C-I), (C-II), (M-I), (M-II) and (Y).

(C-I)

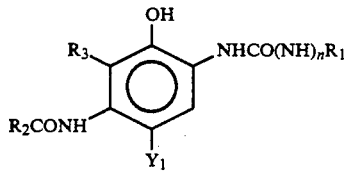

(C-II)

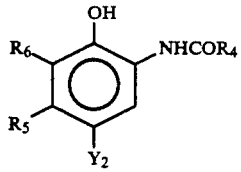

(M-I)

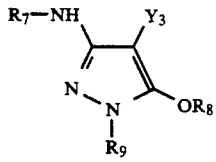

(M-II)

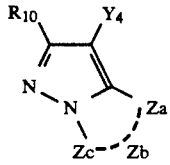

-continued

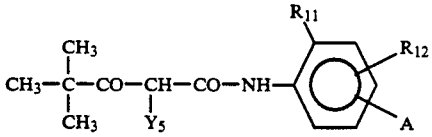

(Y)

In general formulae (C-I) and (C-II), $R_1$, $R_2$, and $R_4$ each represents a substituted or unsubstituted aliphatic group, aromatic group or heterocyclic group, $R_3$, $R_5$ and $R_6$ each represents a hydrogen atom, a halogen atom, aliphatic group, aromatic group or acylamino group and $R_3$ may also represent a group of non-metal atoms which forms a nitrogen-containing 5-membered ring or 6-membered ring together with $R_2$. $Y_1$ and $Y_2$ each represents a hydrogen atom or a group which is released upon coupling with the oxidized product of the developing agent. n represents 0 or 1.

The following are preferred as examples of cyan couplers represented by the above noted general formulae (C-I) or (C-II).

The preferred $R_1$ in general formula (C-I) is an aryl group or heterocyclic group, and further preference is given when $R_1$ is an aryl group substituted with a halogen atom, alkyl group, alkoxy group, aryloxy group, acylamino group, acyl group, carbamoyl group, sulfonamido group, sulfamoyl group, sulfonyl group, sulfamido group, oxycarbonyl group or a cyano group.

In general formula (C-I), when $R_3$ and $R_2$ do not form a ring, $R_2$ is preferably a substituted or unsubstituted alkyl group or aryl group, and particularly preferably an alkyl group substituted with a substituted aryloxy group, while $R_3$ is preferably a hydrogen atom.

The preferred $R_4$ in general formula (C-II) is a substituted or unsubstituted alkyl group or aryl group, and particularly preferably an alkyl group substituted with a substituted aryloxy group.

The preferred $R_5$ in general formula (C-II) is an alkyl group having 2–15 carbon atoms and a methyl group having a substituent group with one or more carbon atoms, preferable substituent groups being the arylthio group, alkylthio group, acylamino group, aryloxy group and alkyloxy group.

In general formula (C-II), $R_5$ is more preferably an alkyl group having 2–15 carbon atoms, and it is particularly preferably an alkyl group having 2–4 carbon atoms. In general formula (C-II), aliphatic groups are preferred for $R_5$, examples of which include a methyl group, ethyl group, propyl group, butyl group, pentadecyl group, tert-butyl group, cyclohexyl group, cyclohexylmethyl group, phenylthiomethyl group, dodecyloxyphenylthiomethyl group, butanamidomethyl group and methoxymethyl group.

The $R_6$ which is preferred in general formula (C-II) is a hydrogen atom or a halogen atom, and the chlorine atom and fluorine atom are particularly preferred.

The $Y_1$ and $Y_2$ which are preferred in general formulae (C-I) and (C-II) are respectively the hydrogen atom, halogen atom, alkoxy group, aryloxy group, acyloxy group and sulfonamido group.

In general formula (M-I), $R_7$ and $R_9$ each represents an aryl group, $R_8$ represents a hydrogen atom, aliphatic or aromatic acyl group or aliphatic or aromatic sulfonyl group, and $Y_3$ represents a hydrogen atom or a splitting group. Substituent groups for the aryl group (preferably the phenyl group) for $R_7$ and $R_9$ are the same as those for substituent group $R_1$ and, when there are 2 or more substituent groups, the substituent groups may be the same or different. $R_8$ is preferably a hydrogen atom, aliphatic acyl group or sulfonyl group, and it is particularly preferably a hydrogen atom. $Y_3$ is preferably a splitting group including a sulfur, oxygen or nitrogen atom and, by way of example, particular preference is given to the sulfur atom type splitting group described in U.S. Pat. No. 4,351,897 and International Disclosure WO 88/04795.

In general formula (M-II), $R_{10}$ represents a hydrogen atom or splitting group. $Y_4$ represents a hydrogen atom or splitting group, and particular preference is given to halogen atoms and the arylthio group. Za, Zb and Zc represent methine, substituted methine, =N— or —NH—, wherein one of the Za—Zb bond or Zb—Zc bond is a double bond and the other a single bond. When the Zb—Zc bond is a carbon-carbon double bond, this group may be part of an aromatic ring. In cases in which a dimer or higher polymer is formed by $R_{10}$ Or $Y_4$, and when Za, Zb or Zc is a substituted methine, include cases in which a dimer or higher polymer is formed by the substituted methine.

Of the pyrazoloazole-based couplers represented by general formula (M-II), preference is given to the imidazo[1,2-b]pyrazoles described in U.S. Pat. No. 4,500,630, and particular preference is given to the pyrazolo[1,5-b][1,2,4]triazole described in U.S. Pat. No. 4,540,654 due to the small amount of yellow side absorption by the chromogenic dye, and due to the fastness to light.

In addition, preference is given to the use of the pyrazolotriazole coupler in which a branched alkyl group has been directly bonded to the 2-, 3- or 6-position of the pyrazolotriazole ring as described in JP-A-61-65245, the pyrazoloazole couplers which contain sulfonamido group as described in JP-A-61-65246, the pyrazoloazole couplers having alkoxyphenylsulfonamido ballast groups as described in JP-A-61-147254 and the pyrazolotriazole couplers having an alkoxy group or aryloxy group in the 6-position as described in European Patents (laid-open) 226,849 and 294,785.

In general formula (Y), $R_{11}$ represents a halogen atom, alkoxy group, trifluoromethyl group or aryl group, and $R_{12}$ represents a hydrogen atom, a halogen atom or alkoxy group. A represents $—NHCOR_{13}$, $—NHSO_2—R_{13}$, $—SO_2NHR_{13}$, $—COOR_{13}$ or $$—SO_2\underset{\underset{R_{14}}{|}}{N}—R_{13}$$

where $R_{13}$ and $R_{14}$ each represents an alkyl group, aryl group or acyl group. $Y_5$ represents a splitting group. The substituent groups for $R_{14}$, $R_{13}$ and $R_{12}$ are the same as those for $R_1$, and the splitting group $Y_5$ is preferably a splitting group including an oxygen atom or nitrogen atom, the nitrogen atom splitting type being particularly preferred.

Examples of the couplers represented by the general formulae (C-I), (C-II), (M-I), (M-II) and (Y) include the following compounds.

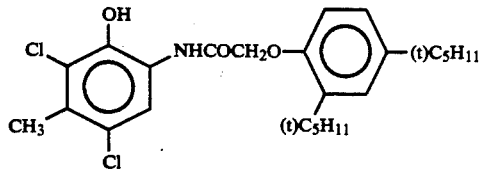
(C-1)
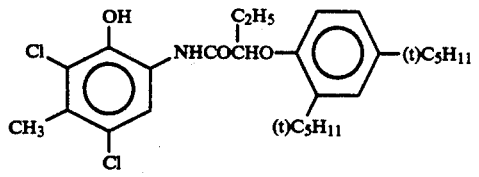
(C-2)
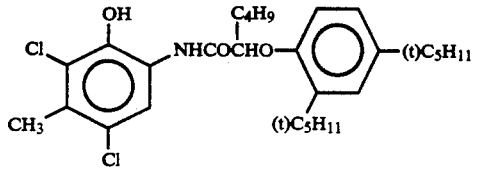
(C-3)
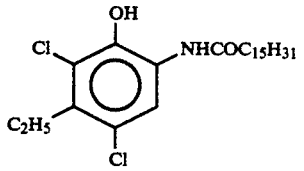
(C-4)
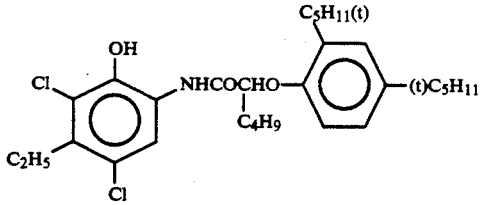
(C-5)
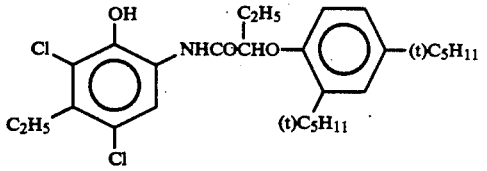
(C-6)
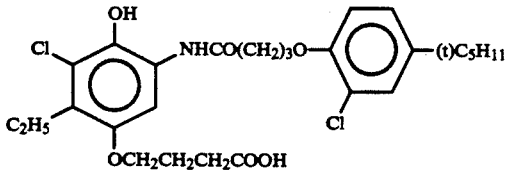
(C-7)
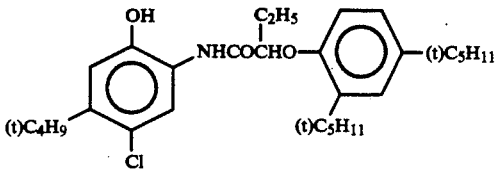
(C-8)

-continued
(C-9)
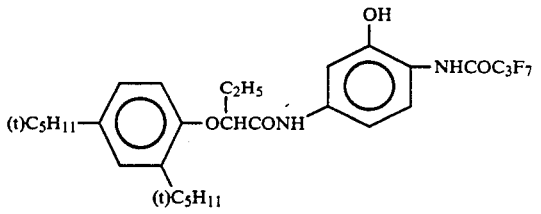
(C-10)
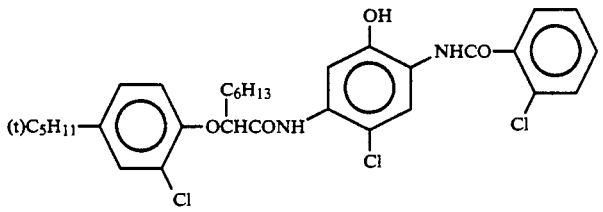
(C-11)
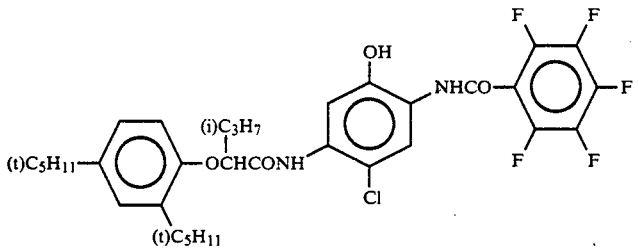
(C-12)
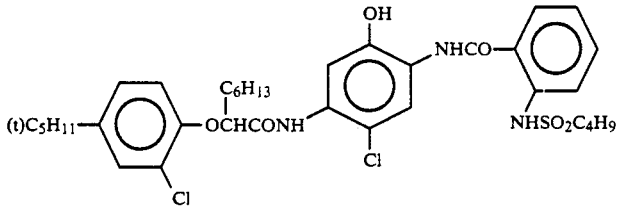
(C-13)
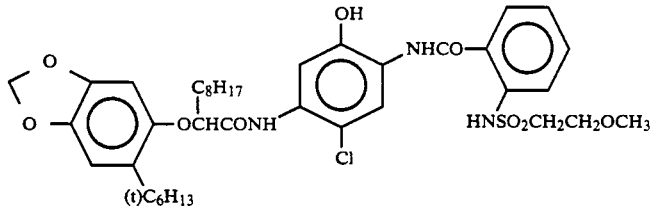
(C-14)
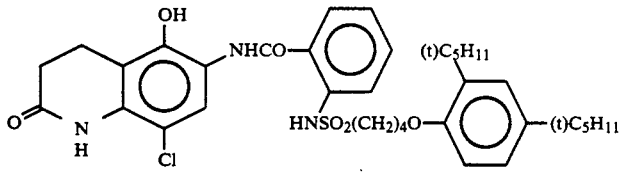
(C-15)
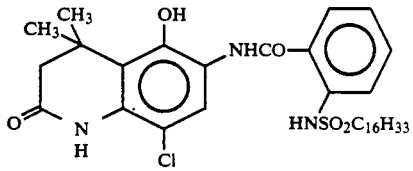

-continued
(C-16)
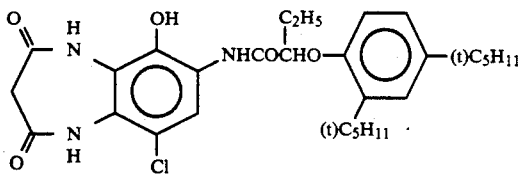
(C-17)
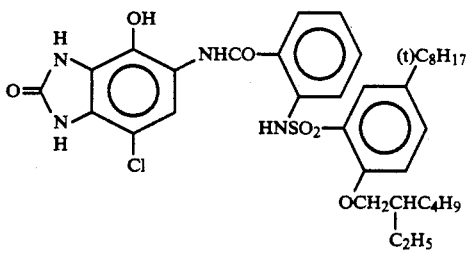
(C-18)
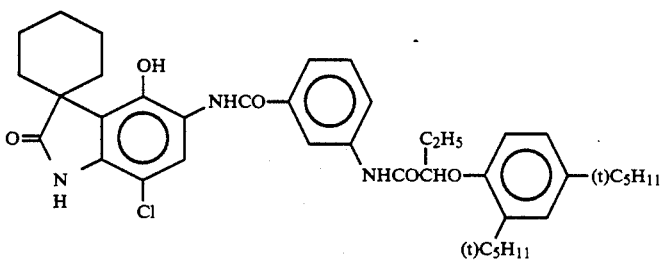
(C-19)
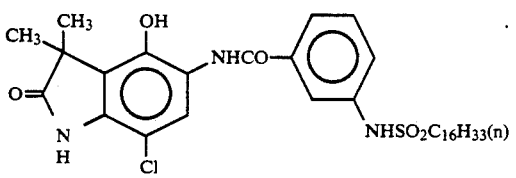
(C-20)
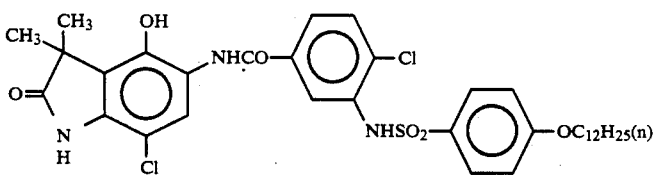
(C-21)
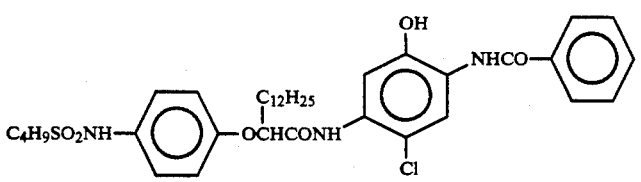
(C-22)
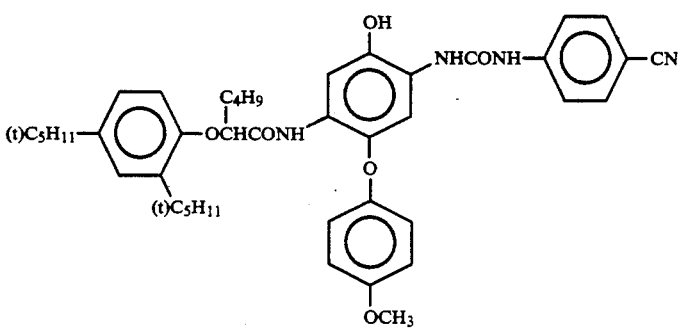

-continued
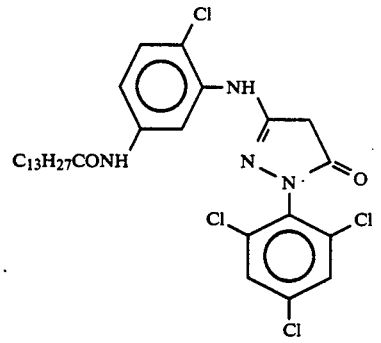
(M-1)
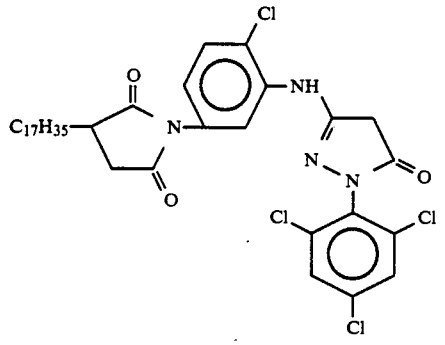
(M-2)
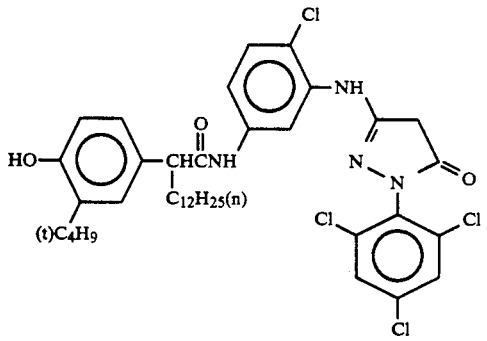
(M-3)
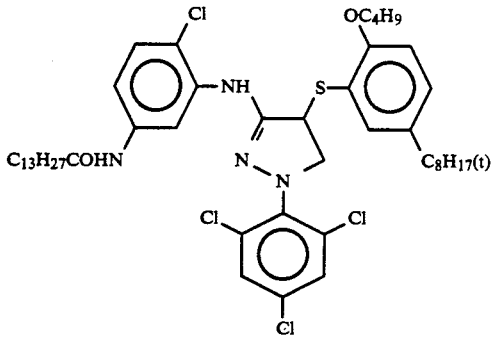
(M-4)

-continued
(M-5)
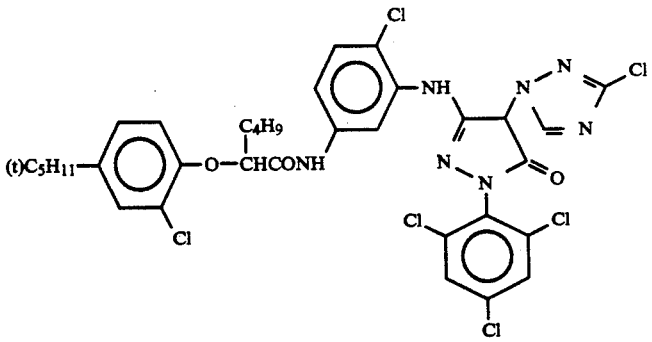
(M-6)
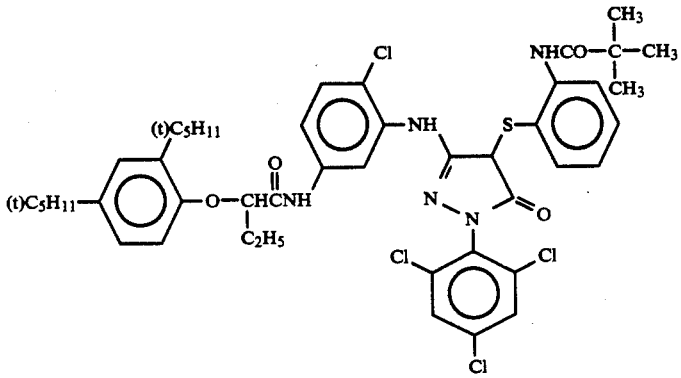
(M-7)
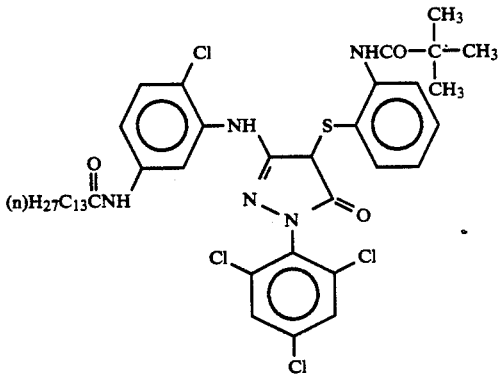
(M-8)
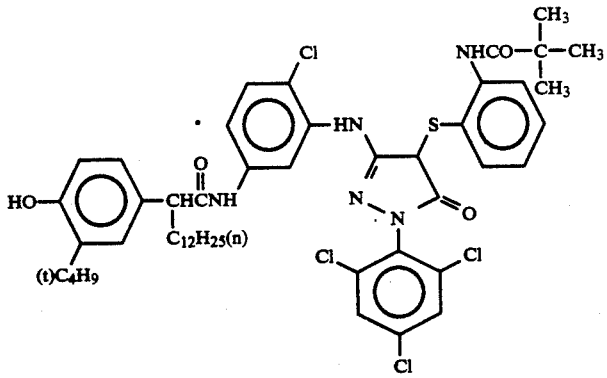

| Compound | $R_{10}$ | $R_{15}$ | $Y_4$ |
|---|---|---|---|
| | | 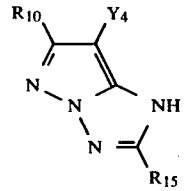 | |
| M-9 | $CH_3$— | 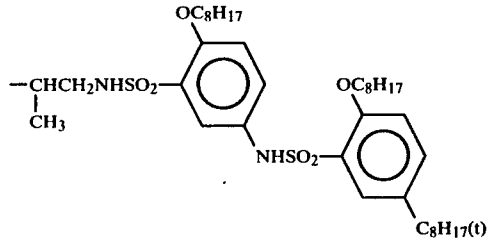 | Cl |
| M-10 | as above | 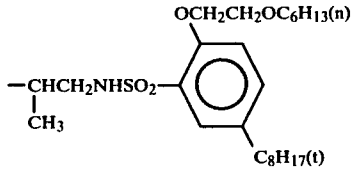 | as above |
| M-11 | $(CH_3)_3C$— | 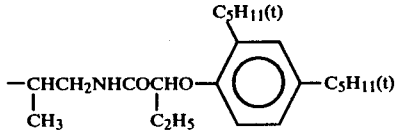 | 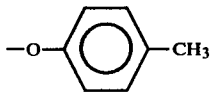 |
| M-12 | 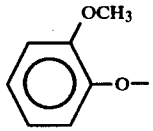 | 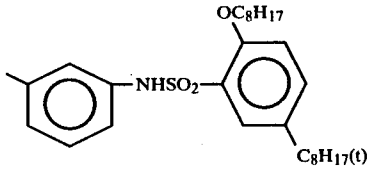 | 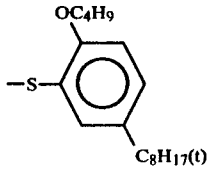 |

-continued
| Compound | $R_{10}$ | $R_{15}$ | $Y_4$ |
|---|---|---|---|
| M-13 | $CH_3$— | 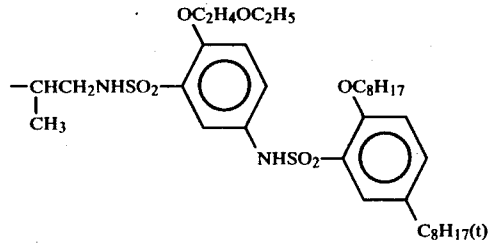 | Cl |
| M-14 | as above | 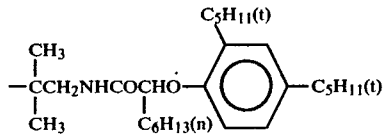 | as above |
| M-15 | $CH_3$— | 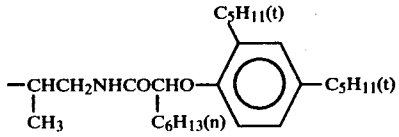 | Cl |
| M-16 | as above | 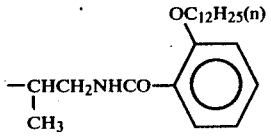 | as above |
| M-17 | as above | 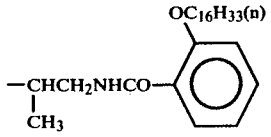 | as above |

-continued
| Compound | $R_{10}$ | $R_{15}$ | $Y_4$ |
|---|---|---|---|
| M-18 | 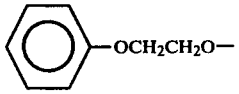 | 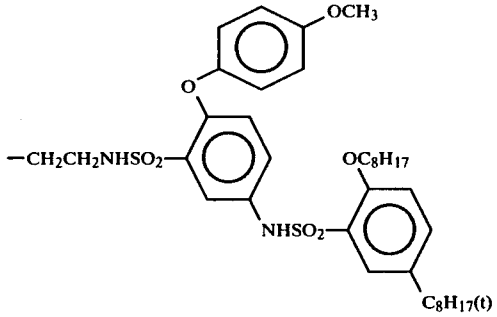 | 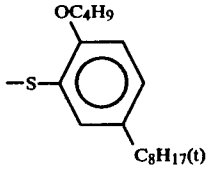 |
| M-19 | $CH_3CH_2O-$ | as above | as above |
| M-20 | 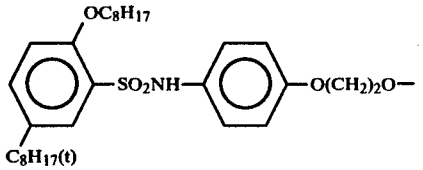 | 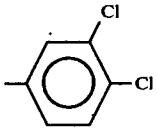 | 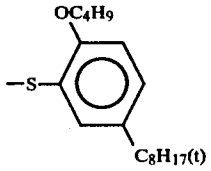 |
| M-21 | 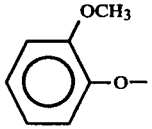 | 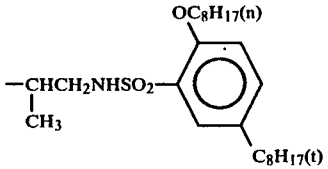 | Cl |
| | | 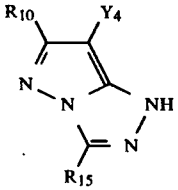 | |
| M-22 | $CH_3-$ | 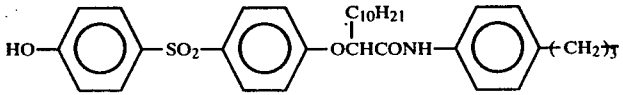 | Cl |

-continued

| Compound | $R_{10}$ | $R_{15}$ | $Y_4$ |
|---|---|---|---|
| M-23 | as above | $(n)C_6H_{13}$ \ $CHCH_2SO_2(CH_2)_2$ / $(n)C_8H_{17}$ | as above |
| M-24 | $CH_3$ \ $CH-$ / $CH_3$ | $OC_4H_9$; $SO_2(CH_2)_3$; $C_8H_{17}(t)$ | as above |
| M-25 | $(CH-CH_2)_{50}(CH_2-C(CH_3))_{50}$; $COOCH_2CH_2OCH_3$; $CONH-$ | $CH_3-CH-$ / $CH_2NHSO_2CH_3$ | as above |
| M-26 | $-O-$ | $OC_8H_{17}$; $(CH_2)_2NHSO_2$; $C_8H_{17}(t)$ | Cl |
| M-27 | $CH_3-$ | $CH_3$; $CH_3$; $CH_3$; $NHCOCHO$ / $(n)C_{10}H_{21}$; $SO_2$; $OCH_2$ | as above |
| M-28 | $(CH_3)_3C-$ | $CH_3$; $CH_3$; $CH_3$; $C_5H_{11}(t)$; $NHCOCHO$ / $C_4H_9(n)$; $C_5H_{11}(t)$ | as above |

-continued
| Compound | $R_{10}$ | $R_{15}$ | $Y_4$ |
|---|---|---|---|
| M-29 | 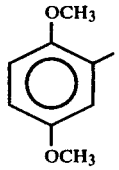 | 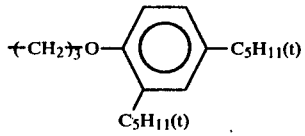 | Cl |
| M-30 | $CH_3$— | $-CH(C_2H_5)-N(n\text{-}C_{18}H_{37})COCH_2CH_2COOH$ | as above |
(Suffixes of parenthesis show weight ratio)

(Y-1)
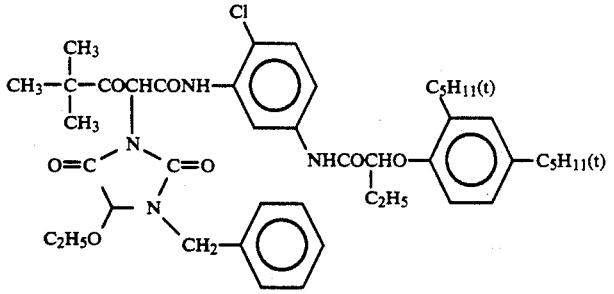
(Y-2)
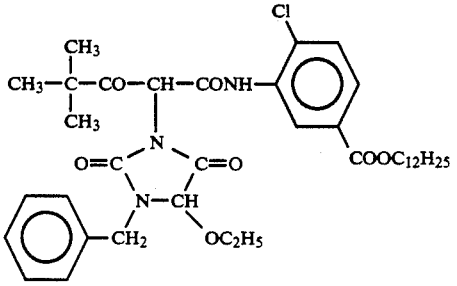
(Y-3)
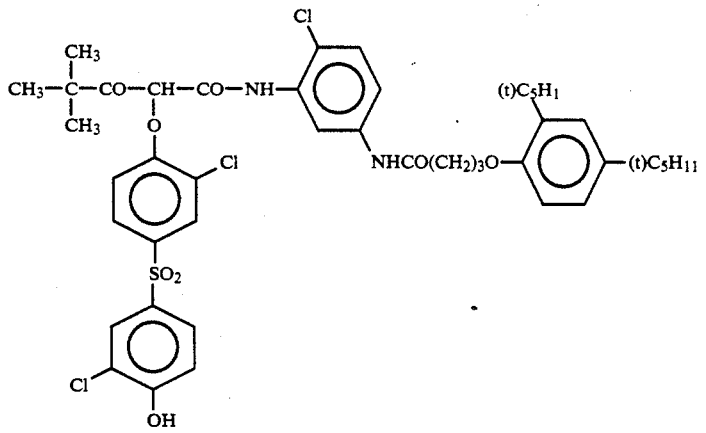
(Y-4)
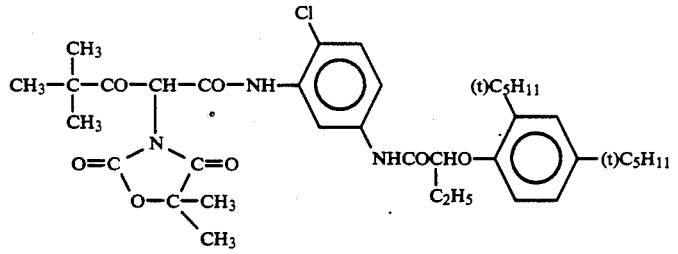
(Y-5)
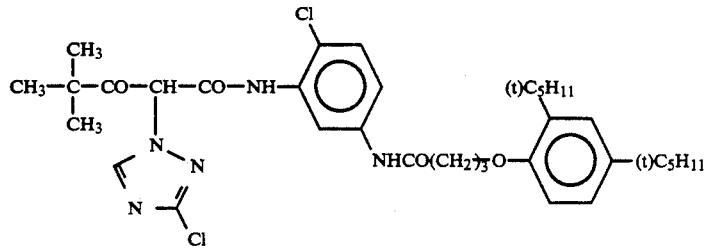

-continued (Y-6)

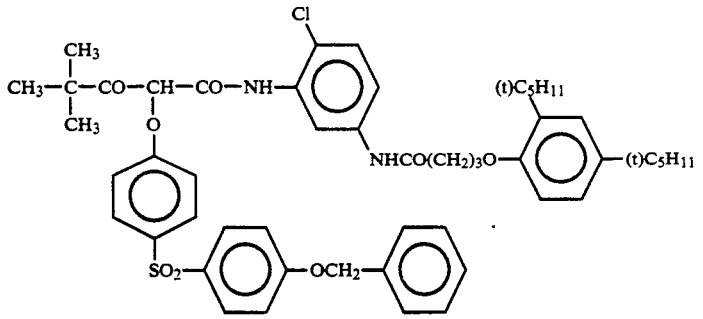

(Y-7)

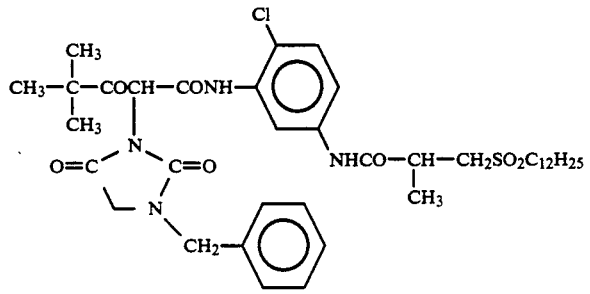

(Y-8)

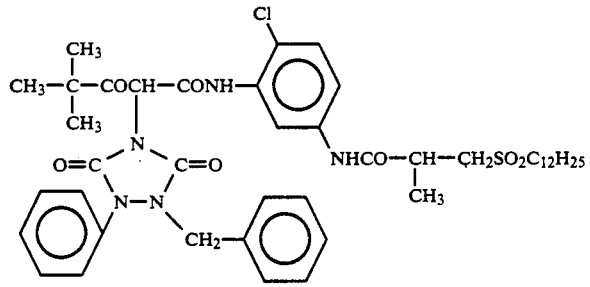

(Y-9)

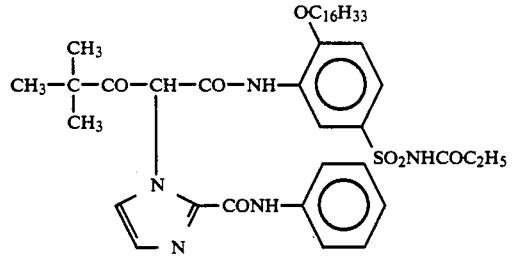

(Y-10)

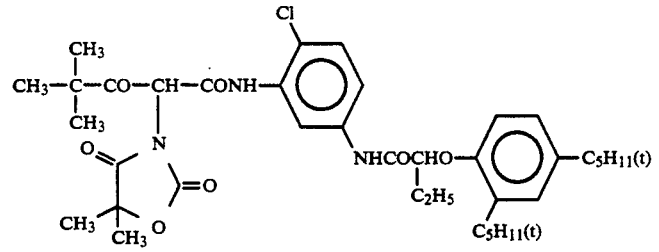

The couplers represented by the above formulas (C-I) to (Y) are generally used in an amount of 0.1 to 1.0 mol, and preferably from 0.1 to 0.5 mol per mol of silver halide in the silver halide emulsion constituting the sensitive layers of the present invention.

The couplers can be added to the sensitive layers by various conventional methods. Generally, the couplers can be added by the oil-in-water dispersion method known as oil protect method. The couplers are dissolved in a solvent and the resulting solution is emulsified and dispersed in an aqueous gelatin solution containing a surfactant. Alternatively, water or an aqueous gelatin solution is added to a coupler solution containing a surfactant, and an oil-in-water dispersion is formed by phase inversion. Alkali-soluble couplers can be dispersed by Fischer's dispersion method. After low-boiling organic solvents are removed from the coupler dispersion by distillation, noodle washing or ultrafiltration, the coupler dispersion may be mixed with the photographic emulsions.

High-boiling organic solvents having a dielectric constant (25° C.) of from 2 to 20 and a refractive index (25° C.) of 1.5 to 1.7 and/or water-insoluble high-molecular weight compounds are preferred as the dispersion medium for these couplers. Preferably, the high-boiling organic solvents represented by the following formulae (A) to (E) are used.

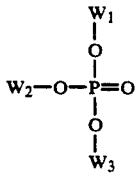
(A)

$W_1-COO-W_2$ (B)

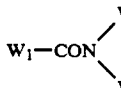
(C)

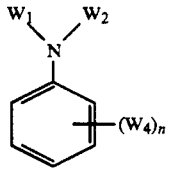
(D)

$W_1-O-W_2$ (E)

In the above formulae, $W_1$, $W_2$ and $W_3$ each represent a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or more, the $W_4$ groups may be the same or different. In the formula (E), $W_1$ and $W_2$ may combine together to form a condensed ring.

In addition to the compounds of the formulae (A) to (E), water-immiscible compounds having a melting point of not higher than 100° C. and a boiling point of not lower than 140° C. can be used as the high-boiling organic solvent in the present invention, as long as the compounds are good solvents for the couplers. The high-boiling organic solvent preferably has a melting point not higher than 80° C. and a boiling point not lower than 160° C., and more preferably not lower than 170° C.

Useful high-boiling organic solvents are described in detail in the disclosure of JP-A-62-215272 (page 137, the lower light column to page 144, the upper right column).

Furthermore, these couplers can be impregnated into a loadable latex polymer (for example, U.S. Pat. No. 4,203,716) with or without the use of the aforementioned high boiling point organic solvents, or they can be dissolved in a water insoluble, organic solvent soluble polymer and emulsified and dispersed in an aqueous hydrophilic colloid solution.

Use of the homopolymers and copolymers disclosed on pages 12 to 30 of International Patent laid open WO88/00723 is preferred, and the use of acrylamide polymers is especially preferred from the point of vie of colored image stabilization etc.

Photosensitive materials of the present invention may contain hydroquinone derivatives, aminophenol derivatives, gallic acid derivatives and ascorbic acid derivatives as anti-color fogging agents.

Various anti-color fading agents can be used in the photosensitive materials of the present invention. Hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines and ether and ester derivatives in which the phenolic hydroxyl groups of these compounds have been silylated or alkylated are typical organic anti-color fading agents which can be used for cyan, magenta and/or yellow images. Furthermore, metal complexes as typified by (bis-salicylaldoximato)nickel and (bis-N,N-dialkyldithiocarbamato)nickel complexes, for example, can also be used for this purpose.

Actual examples of organic anti-color fading agents are disclosed in the patents indicated below.

Hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028. 6-Hydroxychromans, 5-hydroxychromans and spirochromans are disclosed, for example, in U.S. Pat. Nos. 3,432,300, 3,573,050, 3,574,627, 3,698,909 and 3,764,337, and JP-A-52-152225. Spiroindances have been disclosed in U.S. Pat. No. 4,360,589. P-alkoxyphenols are disclosed, for example, in U.S. Patent 2,735,765, British Patent 2,066,975, JP-A-59-10539 and JP-B-57-19765. Hindered phenols are disclosed, for example, in U.S. Pat. No. 3,700,455, JP-A-52-72224, U.S. Pat. No. 4,228,235, and JP-B-52-6623. Gallic acid derivatives, methylenedioxybenzenes and aminophenols are disclosed, for example, in U.S. Pat. Nos. 3,457,079 and 4,332,886, and JP-B-56-21144 respectively. Hindered amines are disclosed, for example, in U.S. Pat. Nos. 3,336,135 and 4,268,593, British Patents 1,32 ,889, 1,354,313 and 1,410,846, JP-B-51-1420, JP-A-58-114036, JP-A-59-53846 and JP-A-59-78344, and metal complexes are disclosed, for example, in U.S. Pat. Nos. 4,050,938 and 4,241,155, and British Patent 2,027,731(A). These compounds can be used effectively by addition to the photosensitive layer after co-emulsification with the corresponding color coupler, usually at a rate of from 5 to 100 wt % with respect to the coupler. The inclusion of ultraviolet absorbers in the layers on both sides adjacent to the cyan color forming layer is effective for preventing degradation of the cyan dye image by heat, and especially by light.

Ultraviolet absorbers can be included in the hydrophilic colloid layers in the photosensitive materials of the present invention. For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzoxadol compounds (for example, those disclosed in U.S. Pat. Nos. 3,406,070, 3,677,762 and 4,271,307) can be used for this purpose. Ultraviolet absorbing couplers (for example, α-naphthol based cyan dye forming couplers) and ultraviolet absorbing polymers, for example, can also be used for this purpose. These ultraviolet absorbers can be mordanted in a specified layer.

Among them, the afore-mentioned aryl group-substituted benztriazole compounds are preferred.

The compounds described below are preferably used together with the above-described couplers, particularly pyrazoloazole couplers.

Namely, a compound (F) and/or a compound (G) are used alone or in combination. The compound (F) is chemically bonded to the aromatic amine developing agent remaining after color development, to form a compound which is chemically inactive and substantially colorless The compound (G) is chemically bonded to the oxidation product of the aromatic amine developing agent remaining after color development For example, staining due to the formation of a color resulting from the reaction of the coupler with the remaining developing agent or oxidation product thereof in the film during storage after processing is prevented. Other undesirable side effects are also be prevented.

Compounds having a second-order reaction constant $k_2$ (in trioctyl phosphate at 80° C.) in terms of the reaction of p-anisidine of from 1.0 to $1\times10^{-5}$ l/mol·sec are preferred as the compound (F). The second-order reaction constant can be measured by the method described in JP-A-158545.

When $k_2$ is larger than the above upper limit, the compound becomes unstable and tends to react with gelatin or water. When $k_2$ is smaller than the above lower limit, the reaction rate of the compound with the remaining aromatic amine developing agent is reduced, and the side effect caused by the remaining aromatic amine developing agent is not fully prevented.

Compounds represented by the following formulae (FI) and (FII) are preferred as the compounds (F).

$$R_1-(A)_n-X \quad \text{(FI)}$$

$$R_2-\underset{\underset{B}{|}}{C}=Y \quad \text{(FII)}$$

In the above formulae, $R_1$ and $R_2$ each represents an aliphatic group, an aromatic group or a heterocyclic group; n represents 0 or 1; A is a group which forms a chemical bond by the reaction with an aromatic amine developing agent; X is a group which is eliminated by the reaction with the aromatic amine developing agents; B represents a hydrogen atom, an aliphatic group, an aromatic group, a heterocyclic group, an acyl group or sulfonyl group; and Y represents a group which accelerates the addition of the aromatic amine developing agent to the compound having the formula (FII). $R_1$ and X, or Y and $R_2$ or B may combine together to form a ring.

Typical reactions for chemically bonding the remaining aromatic amine developing agent include a substitution reaction and an addition reaction.

Preferred examples of the compounds represented by the formulae (FI) and (FII) are described in JP-A-63-158545, JP-A-62-283338 and European Patent Laid-Open Nos. 298321 and 277589.

Compounds represented by the following formula (GI) are preferred as the compound (G) which chemically bonds to the oxidation product of the aromatic amine developing agent remaining after color development to form a chemically inactive and substantially colorless compound.

$$R-Z \quad \text{(GI)}$$

In the above formula, R represents an aliphatic group, an aromatic group or a heterocyclic group; and Z represents a nucleophilic group or a group which is decomposes in the photographic material to release a nucleophilic group. With regard to the compounds having the formula (GI), compounds where Z is a group having a Pearson's nucleophilic $^{n}CH_3I$ value [R. G. Pearson, et al., *J. Am. Chem. Soc.*, 90 319 (1968)] of 5 or more or a group derived therefrom, are preferred.

Preferred examples of the compounds of the formula (GI) are described in European Patent Laid-Open No. 255722, JP-A-62 143048, JP-A-62-229145, Japanese Patent Application Nos. 63-136724 and 62-214681 and European Patent Laid-Open Nos. 298321 and 277589.

Combinations of the compounds (G) with the compounds (F) are described in more detail in European Patent Laid-Open No 277589.

Colloidal silver and dyes can be used in the full color recording materials of the present invention for anti-irradiation purposes, for anti-halation purposes, and especially for separating the spectral sensitivity distributions of the photosensitive layers and ensuring safety under safelights in the visible wavelength region.

Usually, a dye for an anti-irradiation or anti-halation purposes is used for a yellow dye forming emulsion layer and/or a magenta dye forming emulsion layer. The dye is generally incorporated into a ultraviolet absorbing layer. A filter dye is used for a cyan dye forming emulsion layer.

For an anti-irradiation purpose, a dye having a spectral absorption within the range of the principal sensitivity wavelength of the emulsion layer is used. It is preferred that the dye is water soluble. The use of such a dye improve storage stability after exposure up to development.

For an anti-halation purpose, a dye having a spectral absorption within the range of the principal sensitivity wavelength of the emulsion layer is used. It is preferred that the dye is incorporated as a non-diffusible state in a specified layer.

As a filter dye, a dye having a maximum absorption wavelength outside the range of the principal sensitivity wavelength of the emulsion layer is used. The dye is incorporated as a nondiffusible state in a specific layer.

Oxonol dyes, hemi-oxonol dyes, styryl dyes, merocyanine dyes, cyanine dyes and azo dyes can all be used for this purpose. Of these, the oxonol dyes, hemioxonol dyes and the merocyanine dyes are especially useful.

The decolorizable dyes or dyes for backing layers disclosed, for example, in JP-A-62-3250, JP-A-62-181381, JP-A-62-123454 and JP-A-63-197947 (preferably dyes represented by formula (VI) or (VII)), and the dyes disclosed in JP-A-62-39682, JP-A 62-123192, JP-A-62-158779 and JP-A-62-174741, or dyes obtained by introducing water solubilizing groups into these dyes so that the dyes can be washed out during processing, can be used as red - infrared dyes. The infrared dyes used in the present invention may be colorless with essentially no absorption at all in the visible wavelength region.

There is a problem in that when the infrared dyes used in the present invention are mixed with a silver halide emulsion spectrally sensitized to the red-infrared region, desensitization or fogging may occur, and when the dyes themselves are adsorbed on the silver halide grains, weak and broad spectral sensitization occurs. Hence the inclusion of these dyes in just colloid layers other than the photosensitive layers is preferred. For this reason, the inclusion of dyes in a state in which they are fast to diffusion in a specified colored layer is preferred. First, the dyes can be rendered fast to diffusion by the introduction of ballast groups. However, this is liable to result in the occurrence of residual coloration and process staining. Second, anionic dyes can be mordanted by a polymer or polymer latex which provides cation sites. Third, dyes which are insoluble in water at pH levels below 7 and which are decolorized and washed out during processing can be used in the form of fine particle dispersions. In this case, the dyes can be dissolved in a low boiling point organic solvent or rendered soluble into a surfactant and the solution so obtained can be dispersed in a hydrophilic protective colloid, such as gelatin, for use. Most desirably, the solid dye is milled with an aqueous surfactant solution and formed into fine particles mechanically in a mill, and these fine particles are dispersed in an aqueous solution of a hydrophilic colloid, such as gelatin, for use.

Gelatin is useful as a binder or protective colloid to use in the photosensitive layers of the photosensitive materials of the present invention, but other hydrophilic colloids, either alone or in conjunction with gelatin, can be use for this purpose.

The gelatin used in the invention may be a lime treated or acid treated gelatin. Details of the preparation of gelatins have been disclosed by Arthur Weise in *The Macromolecular Chemistry of Gelatin* (published by Academic Press, 1964).

The color photographic materials of the present invention may contain conventional photographic additives and materials which are generally used in commercially available color paper comprising a high silver chloride content emulsion (grains have an average silver halide content of not lower than 96 mol %) in particular. The additives and the materials may be selected from those described in the following *Research Disclosure* (RD) publications.

| Additives | RD 17643 | RD 18716 |
|---|---|---|
| 1. Chemical Sensitizing Agent | Page 23 | Page 648, right column |
| 2. Sensitivity Increasing Agent | Page 23 | Page 648, right column |
| 3. Spectral Sensitizing Agent | Pages 23 to 24 | Page 648, right column to page 649, right column |
| 4. Supersensitizing Agent | Pages 23 to 24 | Page 648, right column to page 649, right column |
| 5. Brightening Agents | Page 24 | Page 648, right column to page 649, right column |
| 6. Anti-fogging Agent, Stabilizer | Pages 24 to 25 | Page 649, right column |
| 7. Coupler | Page 25 | Page 649, right column |
| 8. Organic Solvent | Page 25 | Page 649, right column |
| 9. Light Absorbing Agent, Filter Dye | Page 25 to 26 | Page 649 right column to page 650 left column |
| 10. Ultraviolet Light Absorber | Page 25 to 26 | Page 649 right column to page 650 left column |
| 11. Stain Inhibitor | Page 25 right col. | Page 650 left and right columns |
| 12. Dye Image Stabilizer | Page 25 | Page 650 left and right columns |
| 13. Hardening Agent | Page 26 | Page 651 left column |
| 14. Binder | Page 26 | Page 651 left column |
| 15. Plasticizer, Lubricant | Page 27 | Page 650 right column |
| 16. Coating Aid Surfactant | Pages 26 to 27 | Page 650 right column |
| 17. Antistatic Agent | Page 27 | Page 650 right column |

The color photosensitive materials of the present invention is prepared by providing on a support, a photosensitive layer (YL) containing an yellow coupler, a photosensitive layer (ML) containing a magenta coupler and a photosensitive layer (CL) containing a cyan coupler, a protective layer (PL) and inter-layers (IL), and colored layers which can be decolorized during development processing, and especially anti-halation layers (AH), can be established as required. The YL, ML and CL have spectral sensitivities corresponding to at least three light sources which have different principal wavelengths. The principal wavelengths of the YL, the ML and the CL are separated from one another by at least preferably 30 nm, and more preferably from 40 nm to 80 nm, and at the principal wavelength of any one sensitive layer there is preferably a difference in photographic speed of at least 0.8 LogE (exposure) from the other layers. It is preferred that each of all the photosensitive layers is sensitive in the region of wavelengths longer than 670 nm, most desirably at least one layer is sensitive in the region of wavelengths longer than 750 nm.

For example, any photosensitive layers such as those indicated in the following table can be adopted. In this table, R signifies red sensitization and IR-1 and IR-2 signify layers which have been spectrally sensitized to different infrared wavelength regions.

| | (1) | (2) | (3) | (4) | (5) | (6) | (7) | (8) | (9) |
|---|---|---|---|---|---|---|---|---|---|
| Protective layer | PL | PL | PL | PL | PL | PL | PL | PL | PL |
| Photosensitive layer (Unit) | YL = R<br>ML = IR-1<br>CL = IR-2 | YL = IR-2<br>ML = IR-1<br>CL = R | YL = R<br>CL = IR-1<br>ML = IR-2 | ML = R<br>YL = IR-1<br>CL = IR-2 | CL = R<br>YL = IR-1<br>ML = IR-2 | CL = R<br>ML = IR-1<br>YL = IR-2 | CL = IR-2<br>MI = IR-1<br>YL = R | ML = IR-2<br>CL = IR-1<br>YL = R | ML = R<br>CL = IR-1<br>YL = IR-2 |
| Support | (AH) | (AH) | (AH) | (AH) | (AH) | (AH) | (AH) | (AH) | (AH) |

In the present invention, the photosensitive layer which has a spectral sensitivity in the wavelength region above 650 nm can be exposed imagewise using a laser light beam. Hence, the spectral sensitivity distribution is preferably in a wavelength range of ±25 nm of the principal wavelength, and most desirably of ±15 nm of the principal wavelength. On the other hand, the spectral sensitivity of the present invention at wavelengths longer than 670 nm, especially in the infrared wavelength region is liable to become comparatively broad. Hence, the spectral sensitivity distribution of the photosensitive layer should be corrected using dyes, and preferably, dyes which are fixed in a specified layer. Dyes which can be included in a colloid layer in a non-diffusive form, and which can be decolorized during development processing, are used for this purpose. First, fine particle dispersions of solid dyes which are essentially insoluble in water at pH 7 and dissolve out during the processing to decoloration. Second, acidic dyes can be used together with a polymer, or polymer latex, which provides cation sites. Dyes represented by the general formulae (VI) and (VII) in the specification of JP-A-63-197947 are useful in the first and second methods described above. Dyes which have carboxyl groups are especially useful in the first method.

A second feature of the color photographic material of the present invention resides in the coating weight of silver halide and the composition of each sensitive layer. The total amount of silver halide in the sensitive layers of the color photographic material of the present invention is not more than 0.78 g/m$^2$, preferably not more than 0.64 g/m$^2$, and more preferably from 0.55 to 0.42 g/m$^2$ in terms of silver. The total amount of silver halide in a conventional color paper is from 1.2 to 0.78 g/m$^2$, and the continuous color development time (excluding drying time) thereof is at least 130 seconds.

The total amount of silver halide contained in each sensitive layer, that is, in each of the yellow coupler-containing sensitive layer, the magenta coupler-containing sensitive layer and the cyan coupler-containing sensitive layer of the present invention depends on the type of the coupler employed and the constitution of the layer, but the total amount of silver halide contained in each of the sensitive layers is from 0.27 to 0.18 g/m$^2$, from 0.25 to 0.20 g/m$^2$ and from 0.20 to 0.14 g/m$^2$ in terms of silver, respectively. Preferably, the amount of silver halide used in the sensitive layer farthest from the support is less than that used in the sensitive layer nearest to the support. These amounts are advantageous in promoting the rapid and uniform development of each of the sensitive layers.

Silver halide grains used in the color photographic material of the present invention are exposed by a sufficient quantity of light to obtain maximum color density, such that the development ratio of the grains developed to the amount of grains contained therein is as high as 95 to 100%. The development ratio in conventional color print photographic materials is from 80 to 95%, and the ratio in conventional color photographic materials containing silver iodobromide emulsions for photographing is from 20 to 35%. When the silver halide grains of the present invention are used together with a heterocyclic compound having a water-soluble group such as a carboxyl, sulfo or sulfuric acid group (or a salt thereof) is used, a development ratio of from 95 to 100% can be obtained by high temperature development at 40° C. or higher to raise sensitivity thereof, without causing either fogging or deteriorating the graininess. A development ratio of 100% or higher, for example, 100 to 105% can sometimes be obtained by a utilizing physical development effect (e.g., using a silver salt other than silver halide).

When the photographic material of the present invention processed at the temperature of processing solution is set to from 40° to 60° C., the color development time can be shortened to 30 seconds or less. It is preferably 20 seconds or less, and more preferably 9 seconds or less. Furthermore, the desilverization time can be shortened to 20 seconds or less. It is preferably 9 seconds or less. The rinsing or stabilizing time can be shortened to be 60 to 10 seconds. Therefore, the total processing time excluding the drying time can be shortened to 90 seconds or less. It is preferably 50 seconds or less and, more preferably 30 seconds or less.

A reproduction apparatus provided with a processing part having the above-described slit-form processing tanks can be advantageously used for high-temperature color development.

The total amount of silver halide of the color photographic material can be set to from 0.55 to 0.3 g/m$^2$ in terms of silver if gradation conversion processing (look up table system) is carried out in the image processing device of the exposure part of the present invention, and Reproduction is made by compressing color gradation at each maximum color density of, for example, the magenta dye image and cyan dye image to about 1.2 to 2.0. In this case, the desilverization processing stage can be substantially omitted.

The time for image reading, image processing and exposure may be 30 seconds or less and preferably it is 10 seconds or less using paper of A4 size.

In order to expedite the overall process including the introduction of the color original, exposure and color development in accordance with the present invention, the photographic material is preferably conveyed to the developing part in a short time as possible after exposure, substantially subsequent to exposure. The conveying time in accordance with the present invention is preferably less than 20 seconds, and more preferably less than 5 seconds.

When the amount of the color coupler is reduced in proportion to the amount of silver halide used in each sensitive layer, the amount of hydrophilic colloid in each sensitive layer can also be reduced. In conventional color paper, the ratio of the hydrophilic component to non-hydrophilic component is from 2.0 to 13, while the ratio in the present invention can be set to from 0.8 to 1.1. As a result, the drying time of the photographic material of the present invention can be shortened to 30 seconds or less. It is preferably 20 seconds or less, and most preferably substantially 10 seconds or less. The term "substantially" as used herein means that the material can be practically handled as a practically dried material. It is advantageous that the amount of the hydrophilic colloid component of the non-sensitive layer in contact with each sensitive layer is larger than that of the sensitive layer in the rapid color development of the color photographic material of the present invention. It is preferred that the ratio of the hydrophilic component of the non-sensitive layers to that of all of the sensitive layers is from 0.5 to 1.2. It is advantageous that the amount of the hydrophilic component of the non-sensitive layer nearest the support is larger.

A third feature of the silver halide color photographic material of the present invention relates to the support. The support for use in the photographic material of the present invention is a reflective support comprising a base paper impregnated with a synthetic polymer, and which is coated with a water-resistant resin layer containing a white pigment. The synthetic polymer is impregnated through the surface of the base paper.

The base paper for use in the present invention is paper prepared by adding the reagents described below to a main ingredient comprising a natural pulp derived from needle-leaf trees, broadleaf trees, etc.

Synthetic pulp may be used in place of natural pulp, or a mixture of natural pulp and synthetic pulp may be used in a ratio which is not particularly restricted. It is preferred that pulp derived from broadleaf trees is used in an amount of at least 60 wt %.

Examples of the reagents to be added to the pulp include fillers such as clay, talc, calcium carbonate and fine particles of urea resin; sizing agents such as rosin, alkyl ketene dimers, salts of higher fatty acids, paraffin wax and alkenylsuccinic acids; paper strengthening agents such as polyacrylamide; and fixing agents such as aluminum sulfate.

If desired, a dye, a fluorescent dye, a slime controlling agent, an anti-foaming agent, etc. may be added. Furthermore, a softening agent may also be added. Examples of useful softening agents include those described in *New Paper Processing Handbook* (edited by Shigyo Times Sha), pp. 554–555 (1980). Softening agents having a molecular weight of at least 200 are particularly preferred. Namely, these softening agents have a hydrophobic group having 10 or more carbon atoms (preferably from 15 to 37), and preferably the agent is an amine salt or a quaternary ammonium salt which is self-fixing to cellulose. Examples thereof include reaction products of maleic anhydride copolymers with polyalkylenepolyamines, reaction products of higher fatty acids with polyalkylenepolyamines, reaction products of urethane alcohols with alkylating agents and quaternary ammonium salts of higher fatty acids. Among them, the reaction products of maleic anhydride copolymers with polyalkylenepolyamines and the reaction products of urethane alcohols with alkylating agents are particularly preferred.

Among the above-described additives to the pulp, a paper strengthening agent is particularly important. Synthetic polymers generally called paper strengthening agent are internally added to a pulp composition and mixed upon producing of paper as additive for base paper for the purpose of increasing rigidity and to prevent peeling of the layers of base paper during coating of the base paper with the polyolefin. However, it has been found that excellent conveyability and smoothness are exhibited in rapid processing, particularly rapid processing adaptable to a scanning exposure system in accordance with the present invention, and that high print quality (high density, high sensitivity and free of processing stain) is achieved when the amount of the internally added synthetic polymer (paper strengthening agent) is limited, and when the base paper is impregnated through the surface thereof with the synthetic polymer after preparing a web of the paper.

It is thought that when the above described paper strengthening agent is internally added to the base paper, the resulting mass distribution within base paper is made nonuniform due to the agglomeration thereof, and the final smoothness of the support is thereby deteriorated. However, when the amount of the internally added paper strengthening agent is minimized and the base paper is impregnated through the surface thereof with the synthetic polymer, the desired smoothness and rigidity is obtained, while peeling is also prevented. When the paper strengthening agent is incorporated in the base paper of a thin photographic material only by internal addition, a larger amount of the compound must be added. Therefore, the impregnation is particularly effective when the support of the present invention is thin.

The difference between concentration distribution of the synthetic polymer in the support which is internally added and that of the synthetic polymer impregnated into the base .can be seen at the cross section of each base paper. The density of the impregnated synthetic polymer at the interior of the base paper preferably is not more than 80%, more preferably not more than 50% based on the density of the synthetic polymer at the surface of the base paper.

The synthetic polymer used in the present invention as a strengthening agent is characterized by causing hydrogen bonding to the pulp fiber, and the synthetic polymer molecules agglomerate. Polymers having an amido group, carboxyl group, or hydroxyl group are preferred.

It is particularly effective to impregnate the base paper through the surface thereof with a synthetic polymer (i.e., a paper strengthening agent) selected from the group consisting of anionic polyacrylamides, cationic polyacrylamides, amphoteric polyacrylamides, polyvinyl alcohol, carboxyl-modified polyvinyl alcohols and silica-modified polyvinyl alcohols.

Useful examples of the anionic polyacrylamide include partial hydrolyzates of polyacrylamide and copolymers of acrylamide with acrylic acid as described in *Resins for Paper and Fiber Processing and Test Method Thereof,* page 283, Shokodo (1968). Methacrylic acid or maleic anhydride may be used in place of acrylic acid. Further terpolymers wherein a portion of acrylamide are replaced with acrylonitrile or an acrylic ester as a third monomer can be used. Among these anionic polyacrylamides, polymers having a molecular weight of 100,000 to 2,000,000 are preferred and those having a molecular weight of 500,000 to 1,000,000 are particularly preferred.

The cationic polyacrylamides for use in the present invention include those generally used as paper strengthening agents. The polymers described in *Monographs on High Molecular Materials,* Vol. 33, No. 6, pp. 309–310 (1970), JP-B-52-47043 (the term "JP-B" as used herein means an "examined Japanese patent publication"), JP-B-53-45411 and JP-A-55-6556 are preferred. Examples thereof include Mannich-modified products of polyacrylamide, Hofmann degradated products of polyacrylamide, reaction products of polyacrylamide with polyethyloeneimine and copolymers of acrylamide with cationic monomers such a dimethylaminoethyl methacrylate. Among these cationic polyacrylamides, those having a molecular weight of 100,000 to 2,000,000 are preferred, and those having a molecular weight of 200,000 to 500,000 are particularly preferred. Useful polyvinyl alcohol include polyvinyl alcohol generally, and carboxyl-modified polyvinyl alcohols and silica-modified polyvinyl alcohols are effective. Among them, the carboxyl-modified polyvinyl alcohols are particularly preferred.

The carboxyl-modified polyvinyl alcohols for use in the present invention are preferably those having a degree of saponification of 80 to 98% and a carboxyl group unit of 1 to 20 mol %. Suitable carboxyl-modified polyvinyl alcohols include those having a viscosity of a 5% aqueous solution thereof in the range of about 5 to 100 cps (at 20° C.). Furthermore, those having a degree of polymerization of about 1000 to 3000, particularly about 1600 to 1800 are preferred. The carboxyl-modified polyvinyl alcohols are generally prepared by (1) saponification of vinyl ester copolymers and (2) modification of polyvinyl alcohol.

The carbonyl-modified polyvinyl alcohols for use in the present invention can be prepared by the following methods.

(1) Saponification of vinyl ester copolymers

The carboxyl-modified polyvinyl alcohols are prepared by saponifying a copolymer of a vinyl ester such as vinyl acetate, vinyl formate or vinyl propionate with an ethylenically unsaturated carboxylic acid or an ethylenically unsaturated carboxylic acid ester such as acrylic acid, methacrylic acid, crotonic acid, maleic anhydride, itaconic acid, .an acrylic ester, a methacrylic ester, a crotonic ester or a maleic ester. Comonomers containing vinyl monomers such as acrylamide, methacrylamide and methylol acrylamide can also be used.

(2) Modification of polyvinyl alcohol

A carboxyl group is introduced into the polyvinyl alcohol by the esterification of a dibasic acid such as maleic acid or anhydride thereof, carboxyalkylation with a halogenoalkylcarboxylic acid such as monochloroacetic acid or acetalization with glyoxylic acid. Furthermore, an ethylenically unsaturated carboxylic acid such as acrylic acid may be polymerized in the presence of polyvinyl alcohol to obtain a graft polymer. The carboxyl-modified polyvinyl alcohol obtained by saponifying a copolymer of vinyl acetate with an ethylenically unsaturated carboxylic acid such as maleic acid or itaconic acid are particularly preferred.

When they are used as surface treating agents to impregnate to the paper support according on the present invention, an antistatic agent (e.g., an inorganic salt such as sodium sulfate or calcium chloride, or a surfactant), a fluorescent dye, an anti-foaming agent, etc. may be mixed with an aqueous solution of, for example, the carboxyl-modified polyvinyl alcohol. Alternatively, the paper may be separately coated or impregnated with these additives. Preferably, surface treatment is carried out by means of an on-machine size press or an on-machine tab size system. However, bar, gravure, air knife coating, etc. may be carried out by means of off-machine.

The amount of the synthetic polymer for use as a paper strengthening agent that is impregnated into the paper through the surface thereof varies depending on the amount of the synthetic polymer internally added, but is preferably 30 to 90% by weight based on the total weight of the synthetic polymer in the base paper, and preferably 0.5 to 2% by weight, and particularly preferably 1.0 to 1.5% by weight based on the amount of pulp. When the amount is less than 0.5%, a sufficient rigidity is difficult to be obtained, on the other hand, when the amount exceeds 2%, a problem with respect to stain tends to arise during production steps of the support.

To provide a greater degree of smoothness, the amount of the paper internally added strengthening agent is minimized. The paper strengthening agent is used in such an amount such that when the paper is cut by means of cutter, etc., the bead of pulp does not come out from the cut end of the cross section. Preferably, the paper strengthening agent is internally added in an amount 0.1 to 1.0% by weight, and particularly preferably 0.2 to 0.5% by weight based on the amount of pulp.

For impregnation of the synthetic polymer, usually an aqueous solution or dispersion of the synthetic polymer is used. A preferred concentration of the synthetic polymer in the solution or dispersion is about 0.5 to 5%.

The base paper is impregnated with the synthetic polymer solution or dispersion through the surface of at least one side of the base paper.

The impregnated base paper is dried, usually at about 80° to 120° C. for about 1 minute to a water content of 7 to 9%. When it is dried to a water content less than 7%, problems due to electrostatic tends to occur, on the other hand, when it is dried to a water content more than 9%, the paper tends to form unevenness. After drying the base paper subjected to machine calendering and/or supercalendering to provide the desired thickness. The base paper for use as the support in the present invention preferably has a weight of not more than 300 g/m$^2$. Thin base paper having a basis weight of 50 to 150 g/m$^2$ is effectively used in the present invention. Preferably, the density of base paper is adjusted to from 1.0 to 1.2 g/cm$^3$ by calendering.

Neutral paper is particularly preferred as base paper for use in the present invention. The term "neutral paper" as used herein refers to paper having a pH of not lower than 5, and preferably a pH of from 5 to 9 when water is applied to the surface of base paper, or on the central portion of the thickness of a broken base paper. The pH may be measured using a plate glass electrode GST-5313F manufactured by Toa Denpa Kogyo K.K.

Water-resistant resins for use in the support of the present invention are resins preferably having a water absorption rate (% by weight) of 0.5, preferably not more than 0.1. The absorption rate is measured according to ASTM D570-81 (reapproved: 1988). In this method a sample is dried, immersed into water at 23°±1° C. for 24 hours and then the water content in the sample is measured. When the rate is higher than 0.5 stain tends to occur and fastness of dye images is interiorated due to impregnation of processing solutions.

Examples of useful resins include polyalkylenes (e.g., hompolymers or copolymers of ethylene and propylene), homopolymers or copolymers of vinyl compounds (e.g., homopolymers or copolymers of styrene and acrylates) and polymers or copolymers of esters. Polyalkylene resins such as a low-density polyethylene, a high-density polyethylene, polypropylene and blends thereof are preferred. A fluorescent brightener, antioxidant, antistatic agent, release agent, etc. may be added. The thickness of the resin layer is preferably in the range of from about 5 to 50 μm, and particularly from 10 to 40 μm. Generally, the resin is melt-mixed with a white pigment, and the mixture is kneaded and melt-extruded on the support by means of a melt extruder to laminate the resin containing the white pigment onto the support.

Unsaturated compounds having at least one polymerizable carbon-carbon double bond per molecule such as the methacrylic ester compounds described in JP-A-57-27257, JP-A-49946 and JP-A-61-262738; and the di-, tri- or tetraacrylic esters represented by the general formulae in the disclosure of JP A-61-262738 may be used as the resin of the present invention. The above noted compounds are coated on the support and cured by irradiation with an electron beam to form a water-resistant resin layer. The white pigment, etc. is dispersed in the unsaturated organic compound. If desired, the pigment may be mixed with another resin and then dispersed.

The water-resistant resin layer of the present invention can be coated onto the support using the lamination methods described in *New Laminate Processing Handbook* edited by Kako Gijutsu Kenkyukai, such as, for example, dry lamination and solventless type dry lamination. Coating may be carried out by gravure roll coating, wire bar coating, doctor blade coating, reverse roll coating, dip coating, air knife coating, calender coating, kiss-roll coating, squeeze coating or fountain coating.

The white pigment is used in an amount of preferably at least 12% by weight, but not more than 60% by weight of the water-resistant resin, is substantially uniformly dispersed therein. Examples of the white pigment for use in the present invention include rutile type titanium oxide, anatase type titanium oxide, barium sulfate, calcium sulfate, silicon oxide, zinc oxide, titanium phosphate and aluminum oxide. The surfaces of a fine particles of a titanium oxide pigment, alone or together with an inorganic oxide such as silica or aluminum oxide, may be treated with a dihydric to tetrahydric alcohol such as 2,4-dihydroxy-2-methylpentane, or with trimethylol ethane, as described, for example, in JP-A-58-17151.

Preferably, the surface of the support is subjected to corona discharge treatment, glow discharge treatment or flame treatment, and layers comprising protective colloid for the silver halide photosensitive material is provided thereon.

The support has a weight per unit ares (total thickness) of from 30 to 350 g/m$^2$ (about 30 to 400 μm), and preferably from about 5.0 to 200 g/m$^2$ (about 50 to 220 μm. The thickness of the water-resistant resin layer provided on the support is preferably from about 5 to 50 μm, and more preferably from about 10 to 40 μm.

The glossy surface of the support for the photographic paper of the present invention is coated with photographic emulsion layers and dried to obtain a photographic paper. A printing preservation layer may be arranged on the opposite surface as described, for example, in JP-A-62-6256, or other types of layers may also be arranged thereon.

In the present invention, the base paper of the support is impregnated through the surface thereof wit a synthetic polymer as described above to thereby fix natural pulp fiber densely at the surface of the support, and sparsely at the inside thereof. Preferably, the surface is further subjected to a smoothing treatment (e.g., a mechanical smoothing treatment such as machine calendering) to smooth the surface and to thereby obtain a thin (e.g., 50 μm to 200 μm) surface-treated base paper that is sufficiently flexible. The thus obtained base paper is also protected with the water-resistant resin layer to impart excellent smoothness and rigidity, to thereby provide a support having excellent conveyability. A second characteristic of the support of the present invention is that edge staining which tends to occur during rapid color development is prevented. In particular, fibrous beard is prevented from being formed on the cut section of the support, because neutral paper is used as base paper. A third characteristic of the support of the present invention is that fluctuation in the light beam used in the scanning exposure can be reduced, and the sharpness of image is improved, because the water-resistant resin layer containing from 12 to 60% by weight, and preferably 15 to 50% by weight of the white pigment particles (the white pigment particles preferably having a diameter of from 0.1 to 0.3 μm) is substantially uniformly provided on the smooth surface of base paper, wherein the water-resistant resin layer is relatively thin (e.g., 5 to 20 μm). The term "fluctuation in the light beams used in scanning exposure" as used herein refers to the fluctuation in the diffusion of the reflected light and the intensity of reflected light on the surface of the support.

When the reproduction apparatus such as that described above and the color photographic material of the present invention are used together, the printing (either negative image or positive image) of the originals can be made stably and substantially continuously by conducting automatic feeding of the color photographic material, exposing, continuous color development, and delivering of print to discharge and take-off trays. The term "substantially continuously" as used herein means that the conveying speed of the color photographic material of the present invention during scanning exposure is from 0.8 to 1.25 times that of the color development thereof. Most preferably, the conveying speed during scanning exposure is set so that it is the same as the conveying speed in color development. When the value of the above-described speed ratio is lower than 0.8, the scanning exposure stage is idle, while the value is larger 1.25, the color development stage is idle. Furthermore, when the speed ratio value is outside the above-described range, the reproduction apparatus requires a complicated mechanism, the production cost is increased and the printing time is increased.

Components for addition to the developing solution for use in the present invention are illustrated below.

The color developing solution for use in the present invention is preferably an aqueous alkaline solutions containing an aromatic primary amine color developing agent as a major component. Aminophenol compounds are useful as the color developing agent and p-phenylenediamine compounds are preferred. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate.

These developing agents may be used alone or in combination thereof.

Generally, the color developing solutions contain pH buffering agents such as alkali metal carbonates, borates and phosphates, restrainers or anti-fogging agents such as bromides, iodides, benzimidazoles, benzothiazoles and mercapto compounds. If desired, the color developing solution may contain organic solvents such as ethylene glycol and diethylene glycol; development accelerators such as benzyl alcohol, polyethylene glycol, quaternary ammonium salts and amines; color forming couplers, competitive couplers and fogging agents such as sodium boron hydride; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethylimidinodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid), and salts thereof.

Mercapto compounds having a water-soluble group (JP-A-51-27935), 5-mercapto-1,3,4-tiadiazole (JP-A-51-102639), mercaptohydrotriazine (JP-A-55-79436) and 3-mercaptobenzoic acid (German Patent Laid-Open No. 3226231) are particularly effective anti-fogging agents at elevated processing temperatures. Compounds which are generally used as anti-fogging agents can be effectively used in high-temperature development.

Compounds which have a relatively high activity and high selective action on the surface layer of the photographic material may be incorporated in the photographic material or pre-bath solution, initial developing solution (in the above described apparatus having slits) or developing solution to adjust the balance of development between the surface layer and deeper portions during high-temperature development. For this purpose, the 3-mercapto-5-amidotriazole derivatives described in U.K. Patent 1,457,664, the mercaptotriazoles described in JP-B-46-19039, the benzthiazoliums described in U.S. Pat. No. 3,342,596, the mercaptotetraazaindenes described in U.S. Pat. No. 3,833,376 and the thiazolium salts and selenazolium salts described in JP-B-64-43332 may be used.

The pH of the color developing solution preferably is in the range of from 9 to 12, and the pH value of the initial developing solution and the latter developing solution (in the above-described apparatus) is preferably different.

When sulfites are used as preservatives, the density of developed color image is reduced. Hence, sulfite is preferably not used. However, when sulfite is not added, the developing agent becomes oxidized by air in contact with the developing solution, and a tar component is formed.. As a result, dirt is deposited on the processed photographic material, or the material is stained.

Accordingly, the amount of the sulfite in the developing solution is reduced as much as possible. The amount of the sulfite in the developing solution used in the present invention is preferably set to not more than 0.004 mol/l, more preferably not more than 0.002 mol/l, most preferably not more than 0.001 mol/l of the development solution and other preservatives such as hydroxylamine derivatives (excluding hydroxylamine; the same applies hereinbelow), hydroxamic acids, hydrazines, hydrazides, phenols, α-hydroxyketones, α-aminoketones, saccharide, monoamines, diamines, polyamines, quaternary ammonium salts, nitroxy radicals, alcohols, oximes, diamide compounds and condensed cyclic amines are used in combination. These compounds are described in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP A-63-44657, JP-A-63-44656, U.S. Pat. Nos. 3,615,503 and 2,494,903, JP-A-52-143020 and JP-B-48-30496.

Useful examples of the above-described organic preservatives include, but are not limited to, the compounds described below.

The organic preservatives represented by formulae (P-I) to (P-III) are added to the color developing solution in an amount of 0.005 to 0.5 mol/l, and preferably 0.03 to 0.1 mol/l of the development solution.

Hydroxylamine derivatives represented by the following formula are preferred.

$$R_{61}-\underset{\underset{OH}{|}}{N}-R_{62} \qquad \text{(P-I)}$$

In the above formula, $R_{61}$ and $R_{62}$ each represents a hydrogen atom, an unsubstituted or substituted alkyl group, an unsubstituted or substituted alkenyl group, a unsubstituted or substituted aryl group or a heteroaromatic group. Both $R_{61}$ and $R_{62}$ can not be hydrogen atoms. $R_{61}$ and $R_{62}$ may be combined together with the nitrogen atom to form a heterocyclic ring. The ring structure of the heterocyclic ring is a 5-membered or 6-membered ring which is composed of atoms selected from carbon, hydrogen, halogen, oxygen, nitrogen and sulfur atoms. The ring may saturated or unsaturated.

$R_{61}$ and $R_{62}$ are each preferably an alkyl or alkenyl group having from 1 to 10 carbon atoms, and preferably from 1 to 5 carbon atoms. Examples of the nitrogen-containing ring formed by combining $R_{61}$ and $R_{62}$ include a piperidyl ring, pyrrolidyl ring, N-alkylpiperazyl ring, morpholino ring, indolinyl ring and benztriazole ring. Examples of a heteroaromatic group include pyridinyl ring and a triazinyl ring.

Preferred examples of substituent groups for $R_{61}$ and $R_{62}$ include a hydroxyl group, an alkoxy group, an alkyl- or arylsulfonyl group, an amido group, carboxyl group, cyano group, sulfo group, nitro group and an amino group.

Hydroxamic acids represented by the following formula are preferred.

$$A_{71}-X_{71}-\underset{\underset{R_{71}}{|}}{N}-O-Y_{71} \qquad \text{(P-II)}$$

In the above formula, $A_{71}$ represents a hydrogen atom, a substituted or unsubstituted alkyl group, a substituted or unsubstituted aryl group, a substituted or unsubstituted amine group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, carboxyl group, hydroxy amino group and hydroxyamino carbonyl group. Examples of substituent groups include halogen, an aryl group, an alkyl group and alkoxy group.

Preferably, $A_{71}$ is a substituted or unsubstituted alkyl, aryl, amino, alkoxy or aryloxy group. More preferably $A_{71}$ is a substituted or unsubstituted amino, alkoxy or aryloxy group and preferably having from 1 to 10 carbon atoms.

$X_{71}$ represents $$-\underset{\underset{O}{\|}}{C}-,\ -\underset{\underset{S}{\|}}{C}-,$$

$-SO_2-$ or $-SO-$. Preferably $X_{71}$ is $$-\underset{\underset{O}{\|}}{C}-.$$

$R_{71}$ represents a hydrogen atom, a substituted or unsubstituted alkyl group or a substituted or unsubstituted aryl group. $A_{71}$ and $R_{71}$ may be combined together to form a ring. Examples of substituent groups are those already described above in the definition of the substituent groups for $A_{71}$. Preferably, $R_{71}$ is a hydrogen atom. Y represents a hydrogen atom or a group which becomes a hydrogen atom by a hydrolysis reaction.

Hydrazines or hydrazides represented by the following formula are preferred.

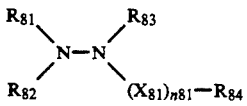

(P-III)

In the above formula, $R_{81}$, $R_{82}$ and $R_{83}$ each represents a hydrogen atom or a substituted or unsubstituted alkyl, aryl or heterocyclic group; $R_{84}$ represents a hydroxyl group, hydroxyamino group or a substituted or unsubstituted alkyl, aryl, heterocyclic, alkoxy, aryloxy, carbamoyl or amino group. The heterocyclic group is a 5-membered or 6-membered ring selected from C, H, O, N, S and halogen and may be a saturated or unsaturated group. $X_{81}$ is a bivalent group selected from the group consisting of —CO—, —$SO_2$— and

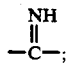

and $n_{81}$ is 0 or 1. When $n_{81}=0$, $R_{84}$ is a group selected from the group consisting of an alkyl group, an aryl group and a heterocyclic group and $R_{83}$ and $R_{84}$ may be combined together to form a heterocyclic ring.

In the formula (P-III), $R_{81}$, $R_{82}$ and $R_{83}$ are each preferably a hydrogen atom or an alkyl group having from 1 to 10 carbon atoms. Particularly preferably, $R_{81}$ and $R_{82}$ are hydrogen.

In the formula (P-III), $R_{84}$ is preferably an alkyl group, an aryl group, an alkoxy group, a carbamoyl group or an amino group, and an alkyl group and a substituted alkyl group is particularly preferred. Preferred examples of substituent groups for the substituted alkyl group include carboxyl group, sulfo group, nitro group, amino group and phosphono group. Preferably, $X_{81}$ is —CO— or $SO_2$, with —CO— being most preferred.

Examples of the compounds represented by the formulae (P-I) to (P-III) are shown below.

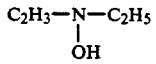

I-1

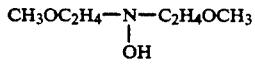

I-2

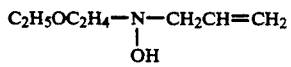

I-3

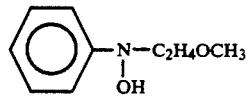

I-4

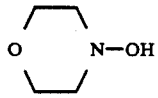

I-5

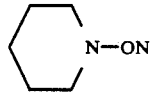

I-6

-continued

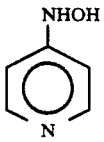

I-7

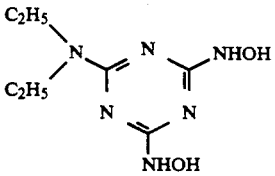

I-8

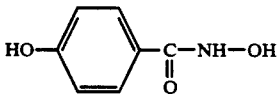

II-1

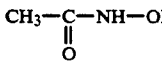

II-2

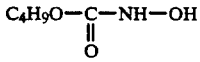

II-3

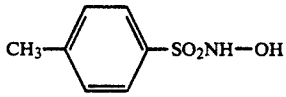

II-4

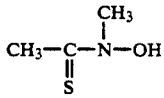

II-5

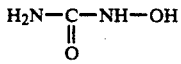

II-6

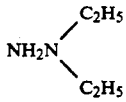

III-1

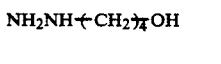

III-2

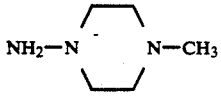

III-3

III-4

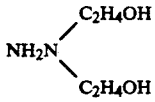

III-5

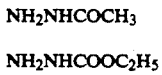

III-6

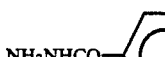

III-7

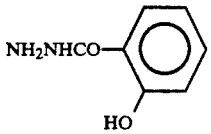

III-8

-continued

III-9

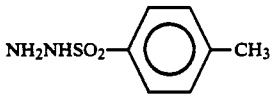

III-10

$NH_2NHCONH_2$

III-11

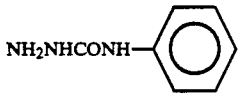

III-12

$NH_2NHSO_3H$

III-13

$NH_2NHC(=NH)NH_2$

III-14

$NH_2NHCOCONHNH_2$

III-15

$NH_2NHCH_2CH_2CH_2SO_3H$

III-16

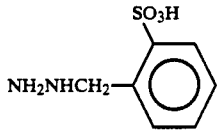

III-17

$NH_2NHCH(C_4H_9(n))COOH$

III-18

$NH_2NHCH_2CH_2COOH$

III-19

$NH_2N(CH_2COOH)_2$

III-20

$NH_2N(CH_2CH_2CH_2SO_3H)_2$

III-21

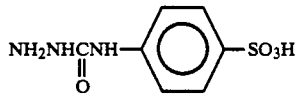

III-22

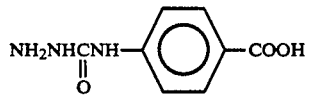

The processing temperature of the color developing solution of the present invention is preferably from 30° to 60° C., and more preferably from 40° to 50° C. A low rate of replenishment of the color developing solution is preferred. Generally, the replenishment rate is from 1 to 3 l per $m^2$ of a conventional color photographic material thus processed. However, when the color photographic material of the present invention is used, the replenishment rate can be reduced to 20 to 600 ml/$m^2$, and preferably from 50 to 300 ml/$m^2$ of the photographic materials thus processed. When the replenishment is reduced, it is desirable to minimize contact of the developing solution with air to prevent evaporation or oxidation by the air. The replenishment rate can be reduced by using a means for inhibiting the accumulation of bromide ion in the developing solution.

The color developing solution of the present invention may be formulated for exclusive use at high-temperature application. Alternatively, conventional processing may be used by adjusting the time and temperature, by using antifogging agents and restrainers, and by adjusting concentrations of the components of the developing solution such as the development agent, etc. to adapt the developing solution to high-temperature processing.

The above described slit-form processing tank and stream development is preferably used to reduce the replenishment rate, to carry out high-temperature development, to prevent the developing solution from being evaporated, to adjust the concentration of each component in the development stage, and to adjust the pH.

After color development, the photographic emulsion layer is generally bleached. Bleaching may be carried out simultaneously with fixing (bleaching-fixing treatment) or may be carried out separately. After bleaching, a bleaching-fixing treatment may be conducted to expedite processing. Bleaching-fixing treatment may be conducted in a bleaching-fixing bath composed of two consecutive baths. After the bleaching-fixing treatment, bleaching may be conducted as required for particular applications. Bleaching agents for use in the present invention include compounds of polyvalent metals such as iron(III), cobalt(III), chromium(VI) and copper(II), peracids, quinones and nitro compounds. Useful examples of the bleaching agent include ferricyanides; dichromates; organic complex salts of iron(III) and cobalt(III) such as complex salts of aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc.; persulfates; bromates; permanganates; and nitrobenzenes. Among them, iron(III) complex salts of aminopolycarboxylic acids such as (ethylenediaminetetraacetonato)iron(III) complex and persulfates are preferred for rapid processing and the prevention of environmental pollution. Furthermore, iron(III) complex salts of aminopolycarboxylic acids are useful for bleaching solutions and bleaching-fixing solutions. The pH of a bleaching solution containing the iron(III) complex salts of aminopolycarboxylic acids and the bleaching-fixing solution containing said iron(III) complex salts is generally in the range of from 5.5 to 8. A lower pH may be used to expedite processing.

If desired, the bleaching solution, the bleaching-fixing solution and a pre-bath thereof may contain bleaching accelerators. Examples of useful bleaching accelerators include compounds having a mercapto group or disulfide group as described in U.S. Pat. No. 3,893,858, West German Patents 1,290,812, JP-A-53-95630, and *Research Disclosure* No. 17129 (July 1978); the thiazolidine derivatives described in JP-A-50-140219; the thiourea derivatives described in U.S. Pat. No. 3,706,561; the iodides described in JP-A-58-16235; the polyoxyethylene compounds described in West German Patent 2,748,430; the polyamine compounds described in JP-B-45-8836; and bromide ion. Among them, the compounds having a mercapto group or disulfide group are preferred for providing high accelerating effect. Particularly, the compounds described in U.S. Pat. No. 3,893,858, West German Patent 1,290,812 and JP-A-53-95630 are preferred. Furthermore, the compounds described in U.S. Pat. No. 4,552,834 are preferred. The bleaching accelerators may also be incorporated in the photographic materials of the present invention. The bleaching accelerators are particularly effective in conducting the bleaching-fixing of the color photographic material for photographing.

Examples of useful fixing agent include thiosulfates, thiocyanates, thioether compounds, thioureas and a large amount of an iodide. Thiosulfates are widely used as the fixing agent. Particularly, ammonium thiosulfate is most widely used. Sulfites, bisulfites and carbonyl bisulfite adducts are preferred as preservatives for the bleaching-fixing solution.

The silver halide color photographic materials of the present invention is usually subjected to the washing and/or a stabilization stage after desilverization.

The amount of wash water used in a washing process can be fixed within a wide range, depending on the characteristics of the photosensitive material (such as couplers used) and their application, the wash water temperature, the number of water washing tanks (the number of water washing stages), the replenishment system (i.e. whether a counter-flow or sequential flow system is used), and various other factors. The relationship between the amount of water used and the number of washing tanks in a multi-stage counter-flow system can be obtained using the method outlined on pages 248 to 253 of the *Journal of the Society of Motion and Television Engineers,* Vol. 64 (May 1955).

The amount of wash water can be greatly reduced by using the multi-stage counter-flow system noted in the aforementioned literature, but bacteria proliferate due to the increased residence time of the water in the tanks, and problems with the suspended matter which is produced becoming attached to the photosensitive material occur. The method in which the calcium ion and magnesium ion concentrations are reduced, as disclosed in JP-A-62-288838, can be used very effectively as a means of overcoming this problem when processing color photographic photosensitive materials of the present invention. Furthermore, the isothiazolone compounds disclosed in JP-A-57-8542, thiabendazoles, chlorinated disinfectants such as chlorinated sodium isocyanurate, and benzotriazole, for example, and the disinfectants disclosed in "*The Chemistry of Biocides and Fungicides*" by Horiguchi, in "*Killing Microorganisms, Biocidal and Fungicidal Techniques*" published by the Health and Hygiene Technical Society, and in "*A Dictionary of Biocides and Fungicides*" published by the Japanese Biocide and Fungicide Society, can also be used in this connection.

The pH value of the wash water when processing photosensitive materials of the present invention is from 4 to 9, and preferably from 5 to 8. The washing water temperature and the washing time can be adjusted in accordance with the characteristics and application of the photosensitive material but, in general, washing conditions of from 20 seconds to 10 minutes at a temperature of from 15° C. to 45° C. are selected, and preferably of from 30 seconds to 5 minutes at a temperature of from 25° C. to 40° C., are selected.

Moreover, the photosensitive materials of the present invention can be processed directly in a stabilizing bath instead of being subjected to a water wash as described above. The known methods disclosed in JP-A-57-8543, JP-A-58-14834, and JP-A-60-220345 can all be used in such a stabilization process. Stabilizing baths which contain 1-hydroxyethylidene-1,1-diphosphonic acid, 5-chloro-2-methyl-4-isothiazolin-3-one, bismuth compounds and ammonium compounds, for example, are especially desirable.

Furthermore, in some cases, a stabilization process is carried out following the aforementioned water washing process. Examples of such baths include the stabilizing baths which contain formalin and surfactant which are used as final baths when processing camera color photosensitive materials. The stabilizing bath may contain various chelating agents and antifungal agents.

The overflow solution from the replenishment of rinsing water and/or stabilizing stage can be reused in other stages such as the desilverization stage.

The color developing agents may be incorporated in the silver halide color photographic material of the present invention for the purpose of simplifying and expediting processing. It is preferred that precursors of the color developing agents are used for the incorporation thereof in the photographic material. Examples of useful developing agent precursors include the indoaniline compounds described in U.S. Pat. No. 3,342,597; the Schiff base type compounds described in U.S. Pat. No. 3,342,599 *Research Disclosure No.* 14850 and ibid., No. 15159; the aldol compounds described in *Research Disclosure* No. 13924; the metal complex salts described in U.S. Pat. No. 3,719,492; and the urethane compounds described in JP-A-53-135628.

If desired, 1-phenyl-3-pyrazolidones may be incorporated into the silver halide color photographic material of the present invention for the purpose of accelerating color development. Useful examples of the compounds include those described in JP-A-56-64339, JP-A-57-144547 and JP-A-58-115438.

If desired, treatments using cobalt intensification or hydrogen peroxide intensification as described in West German Patent 2,226,770 and U.S. Pat. No. No. 3,674,499 may be conducted to conserve silver.

The present invention is illustrated below in greater detail by reference to the following examples which, however, are not to be construed as limiting the invention in any way.

EXAMPLE 1

The silver halide color photographic materials of Table 1 was prepared and was referred to as Sample 1.

The silver halide emulsions for the various layers and the dye dispersion for an antihalation layer were used as described below.

Emulsion for Cyan Coupler-Containing Layer 30 g of lime-processed gelatin was added to 100 ml of distilled water and dissolved therein at 40° C. The pH of the solution was adjusted to 3.8 using sulfuric acid. 5.5 g of sodium chloride and 0.02 g of dimethylimidazolidine-2-thione were added thereto. The temperature of the solution was elevated to 52.5° C. To this solution were added a solution of 62.5 g of silver nitrate in 750 ml of distilled water and a solution of 21.5 g of sodium chloride in 500 ml of distilled water over a period of 40 minutes, while keeping the temperature at 52.5° C. Furthermore, a solution of 62.5 g of silver nitrate in 500 ml of distilled water and a solution of 21.5 g of sodium chloride in 300 ml of distilled water were added thereto over a period of 20 minutes at a temperature of 52.5° C., and potassium iridium hexachloride in an amount of $1\times10^{-8}$ mol/mol of Ag based on the total amount of silver halide, was also added and mixed.

The resulting emulsion was inspected by electron microscope. It was found that the emulsion was composed of cubic grains having an average side length of about 0.46 μm and a coefficient of variation in grain size distribution of 0.09.

After the emulsion was desalted and washed with water, 0.2 g of nucleic acid and 1.0 mol % (in terms of silver halide) of a monodisperse silver bromide emulsion (containing dipotassium iridium hexachloride in an size of 0.05 μm were added thereto. The emulsion was chemically sensitized with triethylthiourea in an amount of about $2\times10^{-6}$ mol/mol of Ag. Additionally, the compound (V-20) in an amount of $7\times10^{-6}$ mol/mol of Ag, the compound (I-1) in an amount of $7\times10^{-4}$ mol/mol of Ag and the compound (F-1) in amount of $5\times10^{-3}$ mol/mol of Ag were added thereto to prepare the emulsion.

Emulsion for Magenta Coupler-Containing Layer 30 g of lime-processed gelatin was added to 1000 ml of distilled water and dissolved therein at 40° C. 5.5 g of sodium chloride and 0.02 g of N,N'-dimethylimidazolidine-2-thione were added thereto. The temperature of the solution was elevated to 50° C. To this solution were added a solution of 62.5 g of silver nitrate in 750 ml of distilled water and a solution of 21.5 g of sodium chloride in 500 ml of distilled water over a period of 40 minutes while keeping the temperature at 50° C. Additionally, a solution of 62.5 g of silver nitrate in 500 ml of distilled water and a solution of 21.5 g of sodium chloride in 300 ml of distilled water were added thereto over a period of 20 minutes at a temperature of 50° C., and dipotassium iridium hexachloride in an amount of $1\times10^{-8}$ mol/mol of Ag based on the .total amount of silver halide, was also added and mixed.

The resulting emulsion was inspected by electron microscope. It was found that the emulsion was composed of cubic grains having an average side length of about 0.44 μm and a coefficient of variation in grain size distribution of 0.08.

After the emulsion was desalted and washed with water, 0.2 g of nucleic acid and 0.5 mol % (in terms of silver halide) of a monodisperse silver bromide emulsion (containing dipotassium iridium hexachloride in an amount of $2\times10^{-5}$ mol/mol of Ag) having a mean grain size of 0.05 μm were added thereto. The emulsion was chemically sensitized with triethylthiourea in an amount of about $2.5\times10^{-6}$ mol/mol of Ag. Additionally the compound (V-5) in an amount of $1.1\times10^{-5}$ mol/mol of Ag, the compound (I-1) in an amount of $1.1\times10^{-3}$ mol/mol of Ag and the compound (F-1) in amount of $5\times10^{-3}$ mol/mol of Ag were added thereto to prepare the emulsion.

Emulsion for Yellow Coupler-Containing Layer

The procedure for the preparation of the emulsion for the magenta coupler-containing layer was repeated except that the compound (V-40) in an amount of $1.2\times10^{-4}$ mol/mol of Ag and the compound (V-41) in an amount of $0.2\times10^{-4}$ mol/mol of Ag were used in place of the compound (V-5). The compound (F-1) was also not used.

Dispersion of Fine Solid Particles of Dye in Anti-halation Layer

Dye crystals of the following composition were kneaded and crushed in a sand mill into fine particles (average diameter being not larger than 0.15 μm). The fine particles were dispersed in 25 ml of an aqueous solution of 10% lime-processed gelatin containing 0.1 g of citric acid. Sand was removed through a glass filter. The dyes adsorbed by sand on the glass filter were washed off by using hot water. A 100 ml of a 7% aqueous gelatin solution containing the dispersed fine solid particles of the dyes thus obtained, was used for coating the antihalation layer.

| Dispersion A | |
|---|---|
| Dye (D-7) | 0.8 g |
| Dye (D-8) | 1.5 g |
| Surfactant (W) 5% aqueous solution | 5 ml |

Dye (D-7)

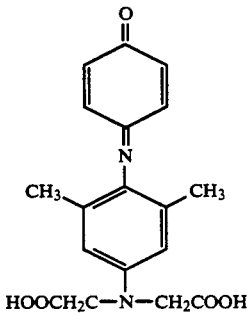

Dye (D-8)

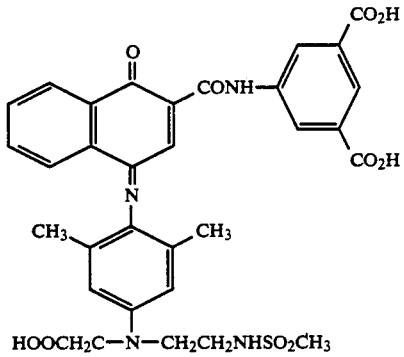

Surfactant (W)

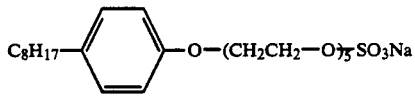

The sample was coated with the compounds (D-1), (D-2), (D-3), (D-4), (D-5) and (D-6) in an amount of 0.016 g/m², 0.006 g/m², 0.008 g/m², 0.013 g/m², 0.018 g/m² and 0.022 g/m² respectively, to improve safety to safelight and also to improve the sharpness of image. These compounds were included in the antihalation layer.

The following three compounds in a molar ratio of 3:2:1 were used as hardening agents for gelatin. These compounds are incorporated to the ninth layer.

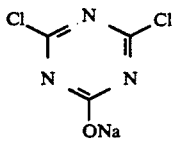

-continued $$\begin{array}{l} CH_2NHCOCH_2SO_2CH{=}CH_2 \\ | \\ CH_2NHCOCH_2SO_2CH{=}CH_2 \end{array}$$

-continued $$\begin{array}{l} OCH_2SO_2CH{=}CH_2 \\ | \\ OH_2SO_2CH{=}CH_2 \end{array}$$

TABLE 1

| Layer | Coated Material | Coating Weight ($g/m^2$) |
|---|---|---|
| Ninth Layer (Protective layer) | Gelatin | 1.00 |
| | Acrylic-modified polymer of polyvinyl alcohol (degree of modification: 17%) | 0.12 |
| | Liquid paraffin | 0.45 |
| Eighth Layer (Ultraviolet light absorbing layer) | Gelatin | 0.65 |
| | Ultraviolet light absorber (X-1) | 0.02 |
| | Ultraviolet light absorber (X-2) | 0.09 |
| | Ultraviolet light absorber | 0.10 |
| | Color mixing inhibitor (H-1) | 0.02 |
| | Solvent (S-5) | 0.11 |
| Seventh Layer (Cyan coupler containing layer) | The above-described emulsion for cyan coupler-containing layer (in terms of Ag) | 0.24 |
| | Gelatin | 1.76 |
| | Polymer (P-1) | 0.53 |
| | Cyan coupler (C-2) | 0.07 |
| | Cyan coupler (C-5) | 0.12 |
| | Cyan coupler (C-4) | 0.09 |
| | Cyan coupler (C-3) | 0.07 |
| | Dye image stabilizer (X-1) | 0.04 |
| | Dye image stabilizer (X-2) | 0.05 |
| | Dye image stabilizer (X-4) | 0.05 |
| | Dye image stabilizer (A-1) | 0.01 |
| | Dye image stabilizer (B-1) | 0.01 |
| | Dye image stabilizer (H-4) | 0.01 |
| | Dye image stabilizer (H-2) | 0.04 |
| | Solvent (S-6) | 0.11 |
| | Solvent (S-7) | 0.11 |
| Sixth Layer (Ultraviolet light absorbing layer) | Gelatin | 1.60 |
| | Ultraviolet light absorber (X-1) | 0.06 |
| | Ultraviolet light absorber (X-2) | 0.27 |
| | Ultraviolet light absorber (X-3) | 0.29 |
| | Color mixing inhibitor (H-1) | 0.06 |
| | Solvent (S-5) | 0.26 |
| Fifth Layer (Magenta coupler containing layer) | The above-described emulsion for magenta coupler-containing layer (in terms of Ag) | 0.15 |
| | Gelatin | 1.60 |
| | Magenta coupler (M-15) | 0.22 |
| | Magenta coupler (M-10) | 0.09 |
| | Dye image stabilizer (E-1) | 0.10 |
| | Dye image stabilizer (A-1) | 0.08 |
| | Dye image stabilizer (B-1) | 0.03 |
| | Dye image stabilizer (H-3) | 0.01 |
| | Dye image stabilizer (H-6) | 0.02 |
| | Solvent (S-1) | 0.44 |
| | Solvent (S-3) | 0.22 |
| Fourth Layer (Color mixing inhibiting layer) | Gelatin | 1.30 |
| | Color mixing inhibitor (H-1) | 0.06 |
| | Solvent (S-3) | 0.12 |
| | Solvent (S-4) | 0.12 |
| Third Layer (Yellow coupler containing layer) | The above-described emulsion for yellow coupler-containing layer (in terms of Ag) | 0.27 |
| | Gelatin | 1.66 |
| | Polymer (P-1) | 0.16 |
| | Yellow coupler (Y-4) | 0.14 |
| | Yellow coupler (Y-6) | 0.18 |
| | Yellow coupler (Y-1) | 0.35 |
| | Dye image stabilizer (H-4) | 0.01 |
| | Solvent (S-2) | 0.15 |
| | Solvent (S-6) | 0.14 |
| Second Layer (Interlayer) | Gelatin | 1.04 |
| | Color mixing inhibitor (H-1) | 0.05 |
| | Solvent (S-3) | 0.10 |
| | Solvent (S-4) | 0.10 |
| First Layer | Black colloidal silver | 0.08 |

TABLE 1-continued
| | | |
|---|---|---|
| (Black anti-halation layer) | Dye (D-7) | 0.016 |
| | Dye (D-8) | 0.03 |
| | Gelatin | 1.32 |
| | Ultraviolet absorber (X-1) | 0.02 |
| | Ultraviolet absorber (X-2) | 0.09 |
| | Ultraviolet absorber (X-3) | 0.10 |
| | Color mixing inhibitor (H-1) | 0.02 |
| | Solvent (S-5) | 0.11 |
| Support | Polyethylene-laminated paper containing 3 g/m$^2$ of $TiO_2$. | |
(D-1)
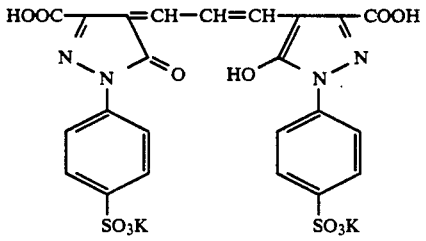
(D-2)
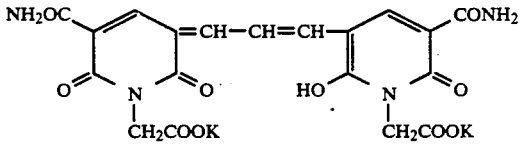
(D-3)
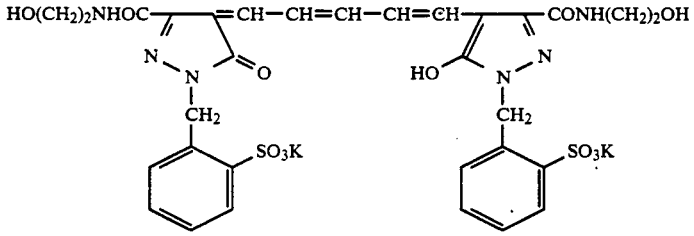
(D-4)
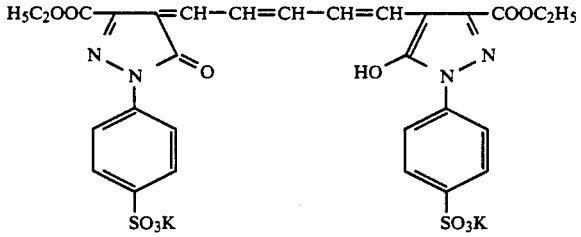
(D-5)
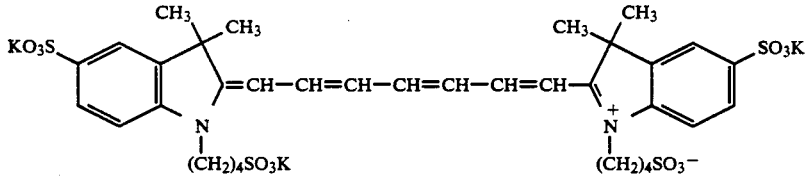
(D-6)
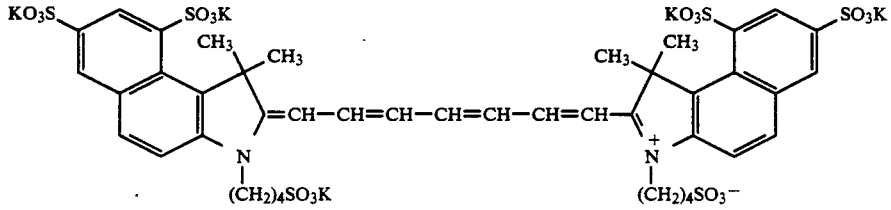
(I-1)

TABLE 1-continued
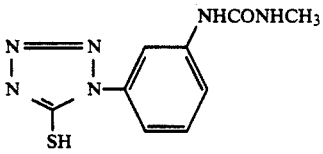
(F-1)
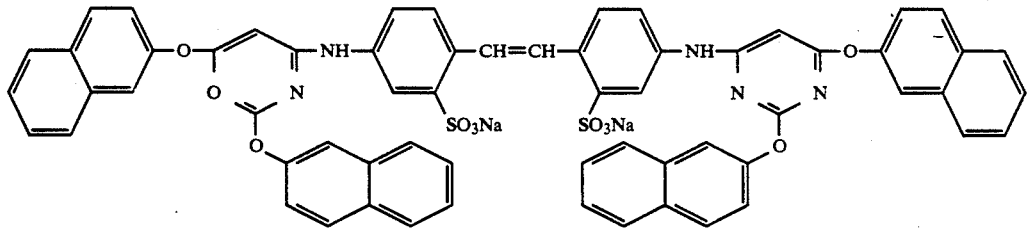
(S-1) (S-2)
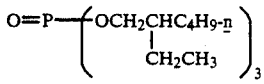
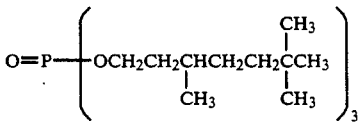
(S-3) (S-4)
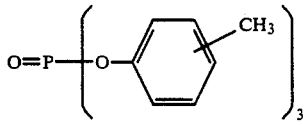
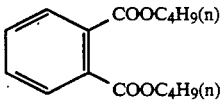
(S-5) (S-6)
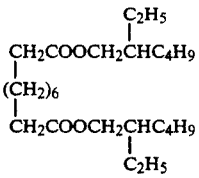
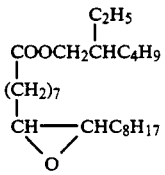
(S-7) (H-1)
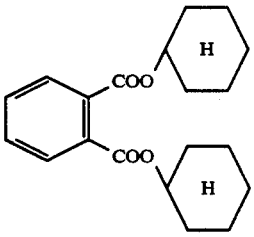
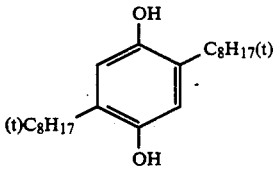
(H-2) (H-3)
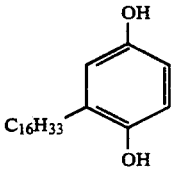
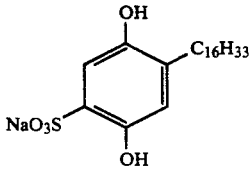
(H-4) (H-6)

TABLE 1-continued

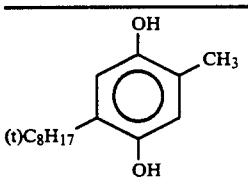

(X-1)

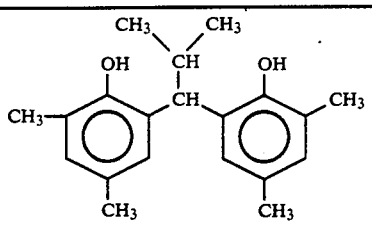

(X-2)

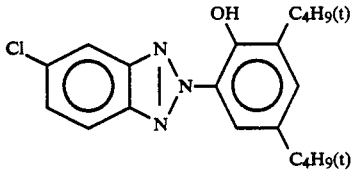

(X-3)

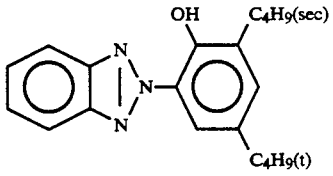

(X-4)

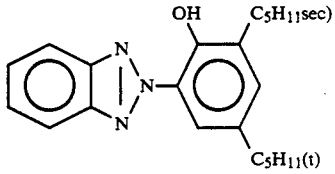

(A-1)

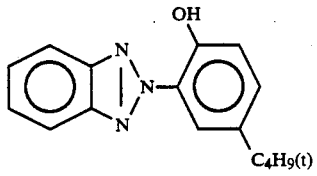

(B-1)

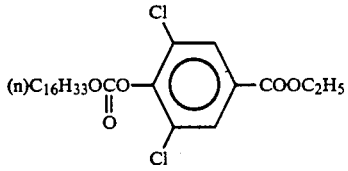

(P-1)

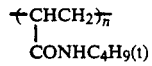

MW = about 60,000

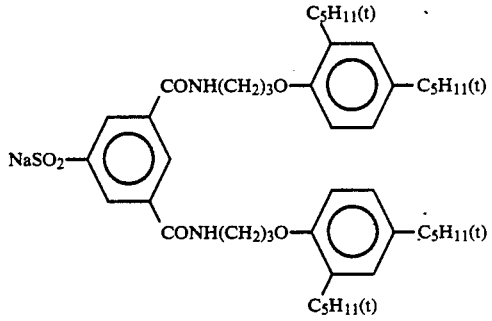

(E-1)

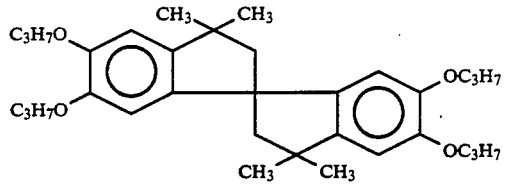

(V-5), (V-40), (Vk-41), C-2) to (C-5), (M-15), (M-10), (Y-4); (Y-6) and (Y-1) represent Nos. of the afore-mentioned exemplified compounds.

Samples 2 and 3 were prepared in the same way as Sample 1 except that the coating amounts of silver halide and the halogen compositions of the emulsions were altered as shown in Table 2.

TABLE 2

| Sample | Cyan Coupler-Containing Layer | Magenta Coupler-Containing Layer | Yellow Coupler-Containing Layer | Remarks |
|---|---|---|---|---|
| I-1 | 1.0 mol % Br<br>0.24 g/m$^2$ | 0.5 mol % Br<br>0.15 g/m$^2$ | 0.5 mol % Br<br>0.27 g/m$^2$ | Invention |
| I-2 | 10.0 mol % Br | 5.0 mol % Br | 5.0 mol % Br | Comp. Ex. |

TABLE 2-continued

| Sample | Cyan Coupler-Containing Layer | Magenta Coupler-Containing Layer | Yellow Coupler-Containing Layer | Remarks |
|---|---|---|---|---|
| | 0.24 g/m$^2$ | 0.15 g/m$^2$ | 0.27 g/m$^2$ | |
| I-3 | 1.0 mol % Br<br>0.24 g/m$^2$ | 0.5 mol % Br<br>0.30 g/m$^2$ | 0.5 mol % Br<br>0.27 g/m$^2$ | Comp. Ex. |

In Table 2, numerals in the upper row represent the halogen compositions (silver bromide content in mol % balance being AgCl) of the emulsions, and numerals in the lower row represent the coating amounts (in terms of Ag) of silver halide.

Each sample was subjected to scanning exposure through an optical wedge at 400 dpi (average exposure time per one picture element: $2\times10^{-7}$ seconds) by using laser diodes having light-emitting wavelengths of 670 nm, 750 nm and 810 nm. After 3 seconds, each sample was subjected to the following color development 1 (Processing Stage 1).

| Processing Stage 1 | Temperature | Time |
|---|---|---|
| Color development | 50° C. | 9 sec |
| Bleaching-fixing | 50° C. | 9 sec |
| Rinse 1 | 40° C. | 4 sec |
| Rinse 2 | 40° C. | 4 sec |
| Rinse 3 | 40° C. | 4 sec |
| Drying | 90° C. | 14 sec |
| Color Developing Solution | | |
| Ethylenediamine-N,N,N',N'-tetra methylenephosphonic acid | | 3.0 g |
| N,N-Di(carboxymethyl)hydrazine | | 4.5 g |
| N,N-Diethylhydroxylamine oxalate | | 2.0 g |
| Triethanolamine | | 8.5 g |
| Sodium sulfite | | 0.14 g |
| Potassium chloride | | 1.6 g |
| Potassium bromide | | 0.01 g |
| Potassium carbonate | | 25.0 g. |
| N-Ethyl-N-(β-methanesulfonamidoethyl)-3-methyl-4-aminoaniline sulfate | | 5.0 g |
| WHITEX-4 (manufactured by Sumitomo Chemical Co., Ltd) | | 1.4 g |
| Add water | | 1000 ml |
| pH | adjusted to 10.05 | |
| Bleaching-Fixing Solution | | |
| Ammonium thiosulfate (55 wt % aqueous solution) | | 100 ml |
| Sodium sulfite | | 17.0 g |
| Ethylenediaminetetraacetic acid iron (III) ammonium | | 55.0 g |
| Disodium ethylenediaminetetraacetate | | 5.0 g |
| Ammonium bromide | | 40.0 g |
| Glacial acetic acid | | 9.0 g |
| Add water | | 1000 ml |
| pH | adjusted to 5.80 | |

Rinsing Solution

Ion-exchanged water (the concentration of calcium ion being reduced to not more than 3 ppm, and that of magnesium ion being reduced to not more than 2 ppm).

Each sample exposed as described above was subjected to the following Processing Stage 2 (a modification of the Processing Stage 1).

| Processing Stage 1 | Temperature | Time |
|---|---|---|
| Color development | 35° C. | 45 sec |
| Bleaching-fixing | 35° C. | 45 sec |
| Rinse 1 | 25° C. | 30 sec |
| Rinse 2 | 25° C. | 30 sec |
| Rinse 3 | 25° C. | 30 sec |
| Drying | 80° C. | 90 sec |

The cyan density, magenta density and yellow density of each sample processed above was measured with a TCD densitometer manufactured by Fuji Photo Film Co., Ltd. The resulting sensitivity and maximum density (Dmax) are shown in Table 3. The sensitivity of each color forming layer of the Sample 1 processed by the Processing Stage 2 is referred to as being 100. Sensitivity is represented by relative sensitivity on the basis of this standard. Maximum density is represented by developed color density in an exposure amount 10 times that required to obtain a density of 1.0.

TABLE 3

| Processing | Sample | Cyan Sensitivity | Magenta Sensitivity | Yellow Sensitivity | Cyan Dmax | Magenta Dmax | Yellow Dmax | Remarks |
|---|---|---|---|---|---|---|---|---|
| Stage 1 | 1 | 126 | 115 | 110 | 2.62 | 2.32 | 2.22 | Invention |
| | 2 | 129 | 118 | 112 | 2.59 | 2.21 | 1.94 | Comp. Ex. |
| | 3 | 120 | 110 | 104 | 2.54 | 2.14 | 2.03 | Comp. Ex. |
| Stage 2 | 1 | 100 | 100 | 100 | 2.56 | 2.28 | 2.24 | Invention |
| | 2 | 105 | 102 | 102 | 2.55 | 2.28 | 2.22 | Comp. Ex. |
| | 3 | 100 | 98 | 95 | 2.53 | 2.26 | 2.24 | 2.22 |

When the Sample 1 of the present invention is processed by the processing stage 1, higher sensitivity is obtained as compared to when Sample 1 is processed by the processing stage 2. Furthermore, when comparative samples 2 and 3 are processed by the processing stage 1, high sensitivity is also obtained as compared to the processing stage 2. There is little difference in maximum density between the Comparative Samples and the Sample 1 of the present invention when processed by the processing stage 2. However, when processed by the processing stage 1, the maximum density of magenta and yellow of the Comparative Samples is reduced. Therefore, Sample 1 of the present invention which does not substantially result in a reduction of magenta and yellow maximum density is superior to the Comparative Samples.

In the processing stage 1, the processing time inclusive of the drying time was 44 seconds and the image is formed very rapidly, while in the processing stage 2, the processing time was 4.5 minutes. Therefore, results obtained with the photographic material of the present invention and image forming method of the Processing Stage 1 is especially preferred.

As described above, the photographic material of the present invention produce high sensitivity and rapid processability without detriment to the maximum density. Therefore the present invention provides excellent feature.

EXAMPLE 2

Samples 4 to 9 were prepared in the same way as Sample 1, except that the sensitizing dyes used in the third, fifth and seventh layers were changed to those given in Table 4 (sensitizing dyes being represented by the afore-mentioned Nos. of the exemplified compounds), respectively. The samples 4, 6 and 8 were exposed by scanning with laser diodes having emission wavelengths of 670 nm, 750 nm and 810 nm. The samples 5, 7 and 9 were exposed by scanning with laser diodes having emission wavelengths of 670 nm, 780 nm and 830 nm. Furthermore, all samples were exposed by scanning with laser diodes of 670 nm, 750 nm and 830 nm. The samples thus exposed were processed in the same way as in Example 1.

TABLE 4

| Sample | Cyan Coupler-Containing Layer | Magenta Coupler-Containing Layer | Yellow Coupler-Containing Layer | Remarks |
|---|---|---|---|---|
| 4 | V-20 | V-5 | V-40 | Invention |
| 5 | V-20 | V-15 | V-40<br>V-41 | Invention |
| 6 | V-19 | V-5 | V-40 | Invention |
| 7 | V-19 | V-15 | V-40<br>V-41 | Invention |
| 8 | V-26 | V-5 | V-40<br>V-41 | Invention |
| 9 | V-25 | V-15 | V-40 | Invention |

When these samples were processed by the Processing Stage 1, the samples were excellent in rapid processability, color density and sensitivity as in Example 1, to thereby confirm the superiority of the present invention.

EXAMPLE 3

In the Processing Stage 1 of Example 1, the amount of N-ethyl-N-(β-methanesulfonamidoethyl)-3-methyl-4-aminoaniline sulfate in the color developing solution was changed from 5 g to 13 g, and furthermore, the pH was raised from 10.05 to 11.2 with potassium hydroxide to prepare a color developing solution for the Processing Stage 3. The Samples 1 to 3 of Example 1 were processed at 50° C. for 5 seconds with the above described color developing solution. The bleaching-fixing stage and the subsequent stages were carried out in the same way as in the processing stage 1.

The results are shown in Table 5 in the same way as shown in Table 3 for Example 1.

TABLE 5

| Processing | Sample | Cyan Sensitivity | Magenta Sensitivity | Yellow Sensitivity | Cyan Dmax | Magenta Dmax | Yellow Dmax |
|---|---|---|---|---|---|---|---|
| Stage 3 | 1 | 141 | 120 | 107 | 2.71 | 2.38 | 2.26 |
| | 2 | 145 | 120 | 107 | 2.64 | 2.27 | 2.02 |
| | 3 | 141 | 112 | 102 | 2.61 | 2.29 | 2.08 |

In this Example, the processing was completed more rapidly All of the samples had higher sensitivity (except the sensitivity of the yellow color forming layer) in comparison with the case where the samples were processed by the processing stage 1. However, it is clear that the image forming method using the Sample 1 of the present invention is superior with respect to of magenta density and yellow density.

EXAMPLE 4

The processing solutions for the processing stage 1 of Example 1 was introduced into the apparatus of FIG. 1, and the Sample 1 was exposed and processed.

A rack having the same length as that of the rack of the bleaching-fixing tank 48 was set as the rack of the developing tank 46. Rinsing was carried out by using only two tanks. Line drive conditions were set such that the processing time of each tank was 9 seconds inclusive of crossover time. In the drying step, a drier having a high air flow was used such that drying was completed at the discharge part.

A good color image wa obtained in about a total of 57 seconds. The time to the color development completion after scanning exposure was about 7 seconds, the time from the color development completion to the completion of rinsing was 36 seconds, and the drying time being about 14 seconds.)

It is clearly seen that more rapid processing is achieved by using less processing solutions, and that the effect of the present invention is more pronounced when using a processing apparatus as shown in FIG. 2.

FIG. 1 is a cross-sectional view of the reproduction apparatus.

FIG. 2 is a cross-sectional view of the processing apparatus.

2: white color plate
11: main body of the apparatus
12: photographic material feed unit
14: exposure unit,
16: processing unit,
17, 117: processing part,
18: drying part,
19: stock solution reservoir
20, 22: magazine,
24, 26, 124: photographic material,
28: exposure part,
30: stand for original,
32: original,
34: press for original,
46, 146: developing tank,
48, 148: bleaching-fixing tank,
50, 52, 150: rinsing tank,
54: draw-off tray,
60, 100: frame
102: pin
200: image readout device,
250: image processing device,
300: exposure device,
208: light source,
210, 212, 214, 290: mirrors,
218: image forming lens
220: CCO sensor,
270: polygon mirror,
280: fθ lens

EXAMPLE 5

Silver halide color photographic materials similar to those shown in Table 1 were prepared by using the following silver halide emulsions.

Emulsion for Cyan Coupler-Containing Layer 30 g of lime-processed gelatin was added to 1000 ml of distilled water and dissolved therein at 40° C. The pH was adjusted with sulfuric acid to 3.8. 5.5 g of sodium chloride and 0.02 g of N,N-dimethylimidazolidine-2-thione were added thereto. The temperature of the solution was elevated to 52° C. To this solution, there were added a solution of 62.5 g of silver nitrate in 750 ml of distilled water and a solution of 21.5 g of sodium chloride in 500 ml of distilled water over a period of 40 minutes, while keeping the temperature at 52° C. Furthermore, a solution of 62.5 g of silver nitrate in 500 ml of distilled water and a solution of 21.5 g of sodium chloride in 300 ml of distilled water were added thereto over a period of 20 minutes while keeping the temperature at 52° C.

Dipotassium iridium hexachloride in an amount of $1.5\times10.8$ mol/mol of Ag based on the total amount of silver halide was also added.

The resulting emulsion was inspected by electron microscope. It was found that the emulsion was composed of cubic grains having an average side length of about 0.45 μm and a coefficient of variation in grain size distribution of 0.08.

After the emulsion was desalted and washed with water, 0.2 g of nucleic acid and 0.5 mol % (in terms of silver halide) of a monodisperse silver bromide emulsion (containing dipotassium iridium hexachloride in an amount of $2.4\times10^{-5}$ mol/mol of Ag) having a mean grain size of 0.05 μm were added thereto. The emulsion was chemically sensitized using triethylthiourea in an amount of about $1\times10^{-6}$ mol/mol of Ag and chloroauric acid in an amount of $1\times10^{-5}$ mol/mol of Ag. Additionally,, the compound (V-20) in an amount of $7\times10^{-6}$ mol/mol of Ag, the compound (I-1) in an amount of $7\times10^{-4}$ mol/mol of Ag and the compound (F-1) in an amount of $5\times10^{-3}$ mol/mol of Ag were added thereto to prepare the emulsion.

Emulsion for Magenta Coupler-Containing Layer 30 g of lime-processed gelatin was added to 1000 ml of distilled water and dissolved therein at 40° C. 5.5 g of sodium chloride and 0.02 g of N,N'-dimethylimidazolidine-2-thione were added thereto and the temperature of the solution was elevated to 52° C. To this solution, there were added a solution of 62.5 g of silver nitrate in 750 ml of distilled water and a solution of 21.5 g of sodium chloride in 500 ml of distilled water over a period of 40 minutes, while keeping the temperature at 52.5° C. Furthermore, a solution of 62.5 g of silver nitrate in 500 ml of distilled water and a solution of 21.5 g of sodium chloride in 300 ml of distilled water were added thereto over a period of 20 minutes while keeping the temperature at 52.5° C.

Dipotassium iridium hexachloride in an amount of $5\times10^{-9}$ mol/mol of Ag based on the total amount of silver halide was also added.

The resulting emulsion was inspected by electron microscope. It was found that the emulsion was composed of cubic grains having an average side length of about 0.45 μm and a coefficient of variation in grain size distribution of 0.08.

After the emulsion was desalted and washed with water, 0.2 g of nucleic acid and 0.5 mol % (in terms of silver halide) of a monodisperse silver bromide emulsion (containing dipotassium iridium hexachloride in an amount of $2.4\times10^{-5}$ mol/mol of Ag) having a mean grain size of 0.05 μm were added thereto. The emulsion was chemically sensitized with triethylthiourea in an amount of about $1.5\times10^{-6}$ mol/mol of Ag and chloroauric acid in an amount of $1.5\times10^{-5}$ mol/mol of Ag. Additionally, the compound (V-5) in an amount of $1.1\times10^{-5}$ mol/mol of Ag, the compound (I-1) in an amount of $1.1\times10^{-3}$ mol/mol of Ag and the compound (F-1) in an amount of $5\times10^{-3}$ mol/mol of Ag were added thereto to prepare the emulsion.

Emulsion for Yellow Coupler-Containing Layer

The procedure for the preparation of the emulsion for the magenta coupler-containing layer was repeated except that the compound (V-40) in an amount of $1.2\times10^{-4}$ mol/mol of Ag and the compound (V-41) in an amount of $0.2\times10^{-4}$ mol/mol of Ag were used in place of the compound (V-5) and the compound (F-1) was omitted.

These samples were coated with the compounds (D-1), (D-2), (D-3), (D-4), (D-5) and (D-6) in an amount of 0.016 g/m², 0.006 g/m², 0.008 g/m², 0.009 g/m² 0.012 g/m² and 0.011 g/m², respectively, by incorporating them into an antihalation layer.

The same three compounds as those used for the Sample 1 were used as hardening agents for gelatin.

The resulting sample is referred to as Sample 10. Samples 11 and 12 were prepared in the same way as Sample 10, except that the coating amount of silver halide for each layer was varied as shown in Table 6.

TABLE 6

| Sample | Cyan Coupler-Containing Layer | Magenta Coupler-Containing Layer | Yellow Coupler-Containing Layer | Remarks |
|---|---|---|---|---|
| 10 | 0.20 g/m² | 0.12 g/m² | 0.27 g/m² | Invention |
| 11 | 0.20 g/m² | 0.30 g/m² | 0.27 g/m² | " |
| 12 | 0.24 g/m² | 0.30 g/m² | 0.27 g/m² | Comp. Ex. |

*all in terms of silver

In the fifth layer of each of the samples 11 and 12, the coupler (M-1) (afore-mentioned exemplified compound) in an amount of 1.5 times by mol the combined amount of the couplers (M-15) and (M-10) was used in place of the couplers (M-15) and (M-10), the compound (H-5) was used in an amount of 20 mol % based on the amount of the coupler (M-1), and the compound (H-3) was omitted.

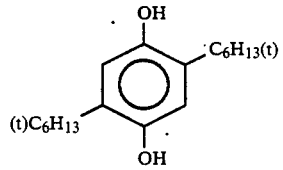

(H-5)

Each of these samples was subjected to scanning exposure with gradation modulation at 400 dpi (average exposure time per one picture element: $2\times10^{-7}$ seconds) by using laser diodes having light-emitting wavelengths of 670 nm, 750 nm and 810 nm. After 3 seconds, the samples were processed by the following color development 4 (Processing Stage 4).

| Processing Stage 4 | Temperature | Time |
|---|---|---|
| Color development | 45° C. | 14 sec |
| Bleaching-fixing | 45° C. | 14 sec |
| Rinse 1 | 38° C. | 6 sec |
| Rinse 2 | 38° C. | 6 sec |
| Rinse 3 | 38° C. | 6 sec |
| Drying | 90° C. | 13 sec |

The compositions of the color developing solution and the bleaching-fixing solution and the rinsing solution were the same as those used in the Processing Stage 1.

Cyan density, magenta density and yellow density of the Samples 10 to 12 processed by the above Processing Stage 4 and the Processing Stage 2 of Example 2 were measured with a TCD densitometer manufactured by Fuji Photo Film Co., Ltd. The resulting sensitivity and maximum density are shown in Table 7. The sensitivity of each color developed layer of the Sample 10 processed by the Processing Stage 2 is referred to as having a sensitivity of 100. Sensitivity is represented relative to this sample. Maximum density is represented by the color density obtained from an exposure amount of 10 times the exposure amount needed to provide a density of 1.0.

TABLE 7

| Processing | Sample | Cyan Sensitivity | Magenta Sensitivity | Yellow Sensitivity | Cyan Dmax | Magenta Dmax | Yellow Dmax |
|---|---|---|---|---|---|---|---|
| Stage 4 | 10 | 117 | 120 | 118 | 2.60 | 2.34 | 2.25 |
| | 11 | 117 | 138 | 115 | 2.59 | 2.14 | 2.21 |
| | 12 | 120 | 132 | 112 | 2.54 | 2.11 | 1.91 |
| Stage 2 | 10 | 100 | 100 | 100 | 2.57 | 2.30 | 2.26 |
| | 11 | 100 | 123 | 98 | 2.57 | 2.18 | 2.24 |
| | 12 | 104 | 118 | 95 | 2.53 | 2.19 | 2.22 |

When the Sample 10 and 11 of the present invention were processed by the Processing Stage 4, higher sensitivity was obtained in comparison with the Processing Stage 2. When the comparative Sample 12 was processed by the Processing Stage 4, higher sensitivity was obtained in comparison with the Processing Stage 2. However, when the Sample 12 was processed by the Processing Stage 4, a reduction in yellow maximum density resulted, even though it was high when it was processed by the Processing Stage 2. A reduction in yellow density for the Samples 10 and 11 of the present invention was not observed. Therefore, the comparative sample is inferior to the samples of the present invention. In the comparative sample, some residual silver was present after processing.

In the Processing Stage 4, the processing time inclusive of the drying time was 59 seconds such that the image was formed very rapidly in comparison with processing stage 2, wherein the processing time was 4.5 minutes. Therefore, the combination of the Processing Stage 4 high temperature, rapid processing with the sample according to the present invention is superior to the combination of the Processing Stage 2.

As described above, only the image forming method wherein rapid processing is carried out using the Samples 10 and 11 of the present invention makes it possible to obtain high sensitivity and a clear image, and rapid processing can be made without detriment to maximum density. Accordingly, it will be understood that the present invention has an excellent feature.

EXAMPLE 6

In the processing stage 4 of Example 5,- the amount of N-ethyl N-(8-methanesulfonamidoethyl)-3-methyl-4-aminoaniline sulfate in the color developing solution was changed from 5 g to 13 g, and furthermore the pH was raised from 10.05 to 11.2 using potassium hydroxide to prepare a color developing solution (i.e., the Processing Stage 3). The samples 10 to 12 used in Example 5 were processed at 50° C. for 5 seconds with the color developing solution thus prepared. The bleaching-fixing stage and the subsequent stages were carried out in the same way as in the Processing Stage 1.

It is clearly seen that the photographic material of the present invention and the image forming method used for developing it provide superior results as in Example 5.

EXAMPLE 7

Preparation of Support

Support I

Wood pulp composed of 30 part of LBSP (hardwood bleached sulfite pulp) and 70 parts of LBKP (hardwood bleached sulfate pulp) was beaten in a disc refiner to Canadian freeness of 300 cc. 1.0 parts of sodium stearate, 0.5 parts of (internally added) anionic polyacrylamide (molecular weight: 800,000), 1.5 parts of aluminum sulfate and 0.5 parts of an alkyl ketene dimer (a mixture of dimers of $C_{12}$–$C_{20}$ alkyl ketene) were added thereto, each amount being based on the absolute dry weight of wood pulp. Paper was made from the mixture using a Fourdrinier paper machine. After completion of primary drying, an impregnation treatment was carried out using a sizing bath to thereby impregnate raw paper with 1.7 wt % (based on the absolute dry weight of wood pulp) of anionic polyacrylamide (molecular weight: 400,000; degree of hydrolysis: 10%). A 2.5% aqueous solution of the anionic polyacrylamide was used. The impregnated product was re-dried and then machine-calendered. The paper weight was adjusted to 100 g/m$^2$, the thickness was adjusted to 95 μm and the water content was adjusted to 8.0%. The pH was 4.3.

Titanium oxide particles (having a particle diameter of 0.1 to 0.3 μm) were immersed in an ethanol solution of 2,4-dihydroxy-2-methylpentane. The mixture was heated to evaporate the ethanol to obtain a surface treated white pigment.

12 parts by weight of the titanium oxide white pigment thus prepared was added to 88 parts by weight of a polyethylene composition (containing a dye to provide bluish color to the support; polyethylene: density=0.920 g/cc, melt index (MI)=5.0 g/10 min). The mixture was kneaded, and coating was carried out by melt extrusion to thereby obtain a water-resistant resin layer having a thickness of 28 μm. Similarly, the back of base paper was coated with a second polyethylene composition (containing the same as above; polyethylene: density 0.950 g/cc, MI=8.0 g/10 min) to obtain a water-resistant resin layer of 20 μm. The resulting product is referred to as Support I.

Support II

Support II was prepared in the same way as Support I, except that carboxyl-modified polyvinyl alcohol (degree of polymerization of 1600) was used in place of the anionic polyacrylamide in the impregnation treatment of the support. The impregnation amount of the carboxyl-modified polyvinyl alcohol was 1.6% by weight based on the weight of wood pulp.

Support III

Support III was prepared in the same way as Support II, except that the amount of internally added anion polyacrylamide was 0.8% by weight based on the weight of wood pulp, and the amount of the carboxyl-modified polyvinyl alcohol added in the impregnation treatment was 1.3% by weight based on the weight of wood pulp.

Support IV

Support IV was obtained in the same way as in Support I, except that base paper used in Support I was coated with a polyethylene composition containing 15 parts by weight of titanium oxide white pigment kneaded therewith, and the surface of the pigment was treated with zinc stearate.

Support V

A composition consisting of 50 parts by weight of hexaacrylate ester of a dipentaerythritol propylene oxide (12 mol) adduct, 50 parts by weight of rutile type titanium oxide was mixed and dispersed by a ball mill for over 20 hours. The base paper of Support II was coated with the resulting dispersion in an amount to provide a dry film having a thickness of 20 μm. The coated base paper was then dried. The back thereof was coated with a polyethylene composition (containing the same as above; polyethylene: density=0.960 g/cc, MI=25 g/10 min) to form a layer of 20 μm.

The coated layers were irradiated with an electron beam at an absorbed dose of 5 Mrad and at an accelerating voltage of 200 KV in a nitrogen atmosphere to obtain the Support V.

Support VI (Support prepared with neutral paper)

Wood pulp composed of 20 parts by weight of LBSP and 80 parts by weight of LBKP was beaten in a disc refiner to Canadian freeness of 300 cc. 0.5% (by weight based on the absolute dry weight of pulp, the same applying hereinbelow) of polyamide-polyamine epichlorohydrin (trade name: Camein 557, a product of Dick Hercules) as fixing agent was added thereto. Thereafter, 0.5% of cationic polyacrylamide (trade name: Polystrone 705, a product of Arakawa Kagaku K.K.) and 0.5% of anionic polyacrylamide (trade name: Polyacrone ST-13, a product of Hamano Kogyo K.K.) were added thereto. Furthermore, 0.5% of alkyl ketene dimer (trade name: Aquapell, a product of Dick Hercules) was added thereto. 1.0% by weight (based on the weight of wood pulp) of carboxy-modified polyvinyl alcohol was incorporated into the pulp by impregnation treatment. Paper having a weight of 100 g/m$^2$ was prepared with a Fourdrinier paper machine. The density of the paper thus prepared was adjusted to 1.0 g/m$^3$ by machine calendering. The pH value was 5.5.

Support VI was obtained in the same way as in Support IV.

Support VII (Support obtained by using acidic paper)

Wood pulp composed of 20 parts of LBSP and 80 parts of LBKP was beaten in a disc refiner to a Candian freeness of 300 cc. 1.0 part of sodium stearate, 1.0 part of anionic polyacrylamide, 1.5 parts of aluminum sulfate and 0.5 parts of polyamide-polyamine epichlorohydrin were added thereto, each amount being based on the absolute dry weight of wood pulp. The pulp was impregnated with 1.0% by weight of carboxy-modified polyvinyl alcohol by an impregnation treatment (in the same manner as for the Support VI). Paper having a basis weight of 100 g/m$^2$ was made by Fourdrinier paper machine. The density was adjusted to 1.0 g/m$^3$ by machine calendering. The pH value was 4.3.

The support VII was prepared in the same way as the Support IV, using the base paper as described above.

Support VIII

Support VIII was prepared in the same way as Support I except that the amount of internally added polyacrylamide was 1.5% by weight, and the amount of the carboxy-modified polyvinyl alcohol added by impregnation treatment was 0.6% by weight, each amount being based on the weight of wood pulp.

Support IX

Support IX was prepared in the same way as Support I, except that the amount of the internally added polyacrylamide was 2.0% by weight, and the amount of the carboxy-modified polyvinyl alcohol added by impregnation treatment was 0.3% by weight, each amount being based on the weight of wood pulp.

Comparative Support A

Comparative Support A was prepared in the same way as Support I. except that no carboxy-modified polyvinyl alcohol was added thereto by impregnation. Peeling occurred frequently within the layer of raw paper during coating of the water-resistant resin layer.

Comparative Support B

Comparative Support B was prepared in the same way as Support IX, except that no carboxy-modified polyvinyl alcohol was added by impregnation treatment.

The dispersibility of the white pigment particles on the surface part of the water-resistant resin layer of each of the above-described supports was examined. The surface of the resin was etched in an amount of about 0.05 μm in depth by means of ion sputtering, and the white pigment particles were inspected by electron microscope. The ratio Ri of the projected area of each particle in six consecutive unit areas (one unit area being 6 μm×6 μm) was determined. The standard deviation S and the mean value R of the occupied area ratio (%) of the particles were determined.

$$s = \sqrt{\frac{\Sigma^{6}_{i=1} (Ri - \overline{R})^2}{n-1}} \quad \left( \text{wherein } \overline{R} = \frac{\Sigma^{6}_{i=1} Ri}{n} \right)$$

The smoothness of each of the thus-obtained supports I to IX (the invention) and Comparative Supports A and B was visually evaluated. Rigidity and total reflectance at 550 nm were determined.

The results are shown in Table 8. Total reflectance was in the range of 0.79 to 0.92.

Rigidity was measured according to the method of JIS-P-8125. Rigidity in the paper making direction of base paper was determined in terms of load in grams per 1 cm width.

TABLE 8

| Support Sample No. | Ratio of Impregnating Synthetic Polymer to Pulp (Impregnation Ratio) | Smoothness** | Rigidity (g/cm) | Ratio of White Pigment (wt %) | Coefficient of Variation of Grain** (S/R) |
|---|---|---|---|---|---|
| I | 1.7 (Use of acidic paper) (77%) | 5 | 4.7 | 12 | 0.08 |
| II | 1.6 (Use of acidic paper) | 5 | 4.4 | 12 | 0.08 |

TABLE 8-continued

| Support Sample No. | Ratio of Impregnating Synthetic Polymer to Pulp (Impregnation Ratio) | Smoothness** | Rigidity (g/cm) | Ratio of White Pigment (wt %) | Coefficient of Variation of Grain** (S/R) |
|---|---|---|---|---|---|
| | (76%) | | | | |
| III | 1.3 (Use of acidic paper) (62%) | 4.5 | 4.2 | 12 | 0.08 |
| IV | 1.7 (Use of acidic paper) (77%) | 5 | 4.6 | 15 | 0.06 |
| V | 1.6 (Use of acidic paper) (76%) | 5 | 4.4 | 50 | 0.04 |
| VI | 1.0 (Use of neutral paper) (40%) | 4.5 | 4.8 | 15 | 0.06 |
| VII | 1.0 (Use of acidic paper) (40%) | 4 | 4.3 | 15 | 0.06 |
| VIII | 0.6 (Use of acidic paper) (29%) | 3 | 4.1 | 12 | 0.08 |
| IX | 0.3 (Use of acidic paper) (13%) | 2.5 | 3.9 | 12 | 0.08 Partial peeling in base paper was observed. |
| A | 0 (Use of acidic paper) (0%) | 2 | 3.3 | 12 | 0.08 Peeling occurred in base paper. |
| B | 0 (Use of acidic paper) (0%) | 2 | 3.5 | 12 | 0.08 |

*The ratio of the amount of the impregnated polymer to the total amount of synthetic polymers used as paper strengthening agent.
**Criterion
5 excellent
4 good
3 slightly poor
2 bad, practically can not be used.

Evaluation of Smoothness

The surface of the support was subjected to corona discharge treatment and then provided a subbing layer. The subbing layer surface was coated with a conventional gelatin silver halide emulsion (0.3 g/m$^2$ in terms of silver, thickness: about 1.3 μm). The resulting material was uniformly exposed and developed to blacken the surface. The surface was visually evaluated.

EXAMPLE 8

Samples I-1, I-2 and I-3 were prepared in the same manner as Samples 1, 2 and 3, respectively, except that Support I was used as the support. The Samples were exposed and subjected to the developing processes in the same manner as in Example 1.

The same results with respect to photographic characteristics as in Example 1 were obtained. Further, the photographic material of the present invention has improved properties with regard to edge staining and conveyability.

EXAMPLE 9

Samples II-1, II-3, III-1, III-3, IV-1, IV-3, VI-1, VI-3, VII-1, VII-3, VIII-1, VIII-3, IX-1, IX-3, A-1, A-3, B-1 and B-3 were prepared in the same way as Sample I-1 and I-3 of Example 8, except that each of the Supports II to IX and comparative supports A and B were used in place of the support used in Samples I-1 and I-III.

Each sample was cut into a 12 cm width and rolled. The cut surface was rubbed under the same conditions in each sample. Each sample was exposed imagewisely and processed by the Processing Stage 1 but having two rinse baths each of 9 seconds) and the Processing Step 2.

Figure 3:
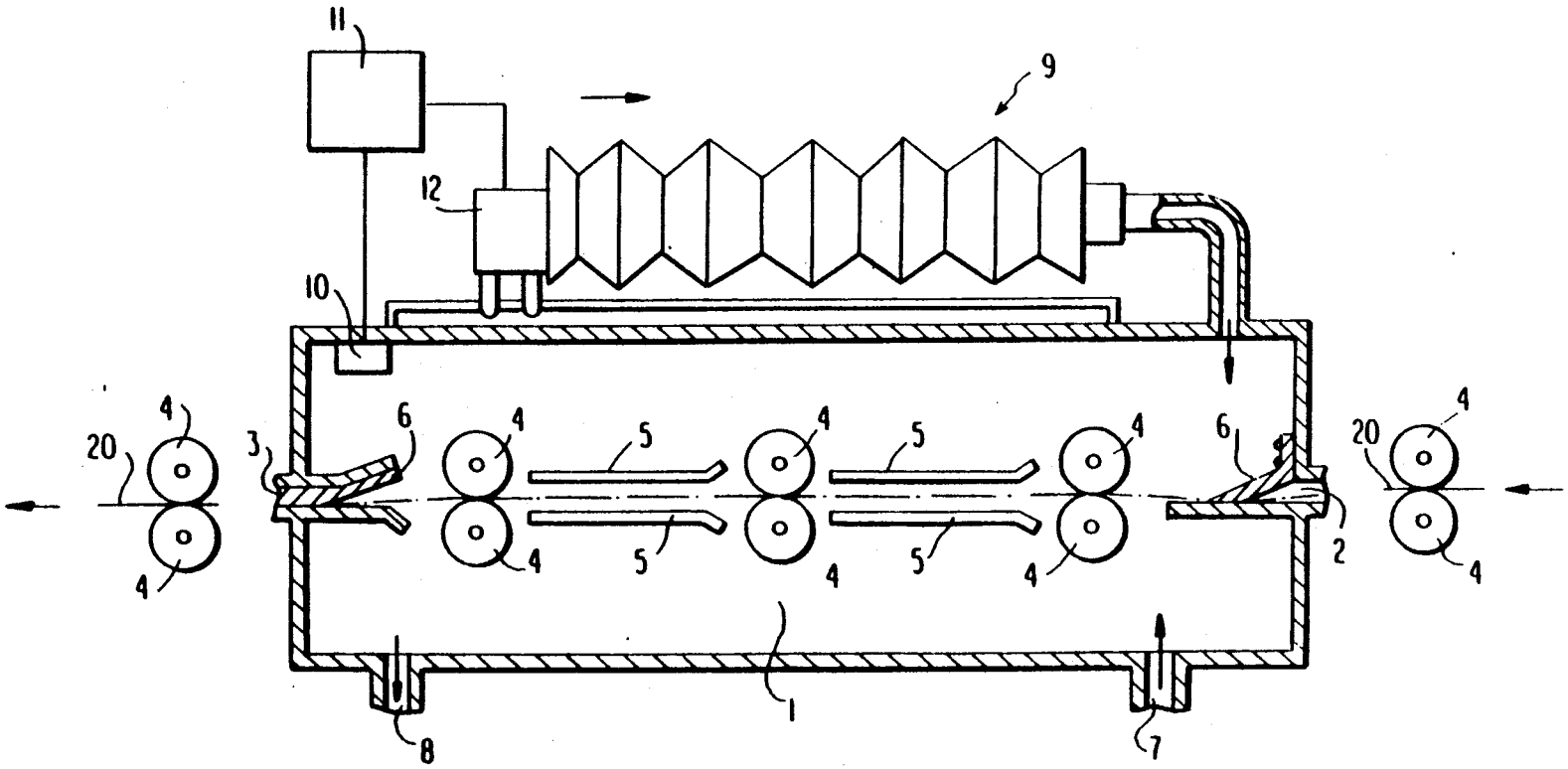
FIG. 3 is a cross-sectional view of a color development bath.

An experimental automatic processor as shown in FIG. 3 was used for the Processing Stage 1, said processor being provided with a developing tank, a bleaching-fixing tank and a rinse tank comprising two chambers. Processing time in each rinse tank was 9 seconds.

FIG. 3 is a cross-sectional view the processor. In FIG. 3 each numeral expresses the followings.

1: Color developing tank
2: Inlet for introducing photographic material
3 Outlet for taking out photographic material
4: Conveying roller
5; Guide
6: Squeezee
7, 8: Port of subtank (temperature conditioning with stirring)
9: Reservoir
10: Pressure sensor
11: Controlling means
12: Step motor
20: Photographic material Each color developed sample was wound up into a roll, without cutting the sample into prints. The roll-form print sample was stored at 40° C. for 5 days, and edge staining was visually evaluated from the side of the roll.

The results are shown in Table 9.

The evaluation criteria were as follows:

⊙: Staining not observed at all.

○: Staining substantially not observed.

Δ: Staining observed, but to an allowable extent.

x: Heavily stained.

xx: Stained at a distance 0.2 mm or more in depth from the cut surface.

The experimental processing tank used in the present invention was prepared by the method described in Japanese Patent Application No. 63-150883.

In reference to FIG. 3, a photographic material 20 introduced therein is conveyed by means of guides 5 and conveying rollers 4. Any shortage of the processing solutions due to brought out thereof is detected by a pressure sensor 10, and replenished from a reservoir 9. The processing solution whose temperature is adjusted in a subtank is introduced through a subtank port 7 and discharged through a subtank port 8, where the solution is stirred.

A tank similar to that described above is used as the bleaching-fixing tank. The rinsing tan is composed of two consecutive chambers.

TABLE 9

| Sample No. | Edge Staining Development 1 | Edge Staining Development 2 | Conveyability |
|---|---|---|---|
| I-1 | ○ | ⊙ | ○ |
| I-2 | Δ | Δ | ○ |
| I-3 | Δ | ○ | ○ |
| II-1 | ○ | ○ | ○ |
| II-3 | Δ | ○ | ○ |
| III-1 | ○ | ○ | ○ |
| III-3 | Δ | ○ | ○ |
| IV-1 | ⊙ | ⊙ | ○ |
| IV-3 | Δ | ○ | ○ |
| V-1 | ⊙ | ⊙ | ○ |
| V-3 | Δ | ○ | ○ |
| VI-1 | ⊙ | ⊙ | ○ |
| VI-3 | Δ | ○ | ○ |
| VII-1 | ○ | ○ | ○ |
| VII-3 | Δ | ○ | ○ |
| VIII-1 | ○ | ○ | Δ |
| VIII-3 | Δ | ○ | ○ |
| IX-1 | Δ | Δ | Δ |
| IX-3 | × | Δ | Δ |
| A-1 | × | × | × |
| A-3 | ×× | × | × |
| B-1 | × | Δ | × |
| B-3 | × | × | × |

With regard to edge staining the staining degree of the samples of the photographic material of the present invention is low in comparison with the Comparative Samples A-1 and A-3. Even when the Samples I-1, II-1, III-1, IV-1, V-1, VI-1, VII-1, VIII-1 are processed by the Processing Stage 1, the processed materials have superior characteristics similar to the materials processed by the Processing Stage 2. Particularly, the Samples IV-1, V-1 and VI-1 are superior. Comparative Samples A-1 and A-3 are inferior with respect to edge staining.

Evaluation of conveyability is made as follows:

○: Smoothly conveyed in the Processing Stage 1 as well as Processing stage 2.

Δ: Unevenness in the conveying speed was observed.

x: Another trial was required to enable conveying to be smoothly conducted.

It is clearly seen that the samples of the present invention are superior in conveyability.

EXAMPLE 10

Samples I-4 to I-9 were prepared in the same way as Sample I-1 of Example 8, except that sensitizing dyes were used in the same manner as Samples 4 to 9, respectively, in Example 2. The Samples were exposed and subjected to the tests the same as in Example 2 and the same results with respect to photographic characteristics were obtained.

When the Processing Stage 1 was carried out by using the experimental processor of FIG. 3, conveyability was good as in the Sample I-1 of Example 9.

EXAMPLE 11

Photographic materials (samples) were prepared in the same manner as in Example 5 except that the Supports I, IX and A obtained in Example 7 were used instead of the support used in Example 5. A processor similar to that of Example 9 was used. The processor was provided with the color developing tank and the bleaching-fixing tank of FIG. 3, and a processing tank wherein the processing tank of FIG. 3 was partitioned into two zones with a partition wall at the position where the central conveying rollers were provided, Squeeze pieces were provided at the top of the partition wall, such that they were in contact with the central conveying rollers.

The samples obtained by using the Supports I, IX and A were processed by the Processing Stage 4 (rinsing baths being about 7 seconds, 7 seconds, 7 seconds and 7 seconds). The sample obtained using the Support I was conveyed without difficulty. The sample obtained using the Support IX was not easily conveyed. The sample obtained using the Support A caused jamming at the conveying-out port.

It is clearly seen from the above experiments that samples which provide a clear image and having high sensitivity without detriment to maximum density and which are conveyed safely and rapidly without causing jamming are the samples I-10, I-11, IX-10 and IX-11, and preferably the samples I-10 and I-11.

While the invention has been described in detail and with reference to specific examples thereof, it will be apparent to one skilled in the art that various changes and modifications can be made therein without departing from the spirit and scope thereof.

What is claimed is:

1. A method for forming a color image using a silver halide color photographic material comprising a support having thereon at least three photosensitive layers containing a silver chloride emulsion or a silver chlorobromide emulsion having an average silver chloride content of at least 96 mol % and containing substantially no silver iodide, said at least three photosensitive layers comprising a cyan coupler-containing layer, a magenta coupler-containing layer and a yellow coupler-containing layer, wherein said at least three photosensitive layers each has a different spectral sensitivity peak in the sensitive wavelength regions of 650 to 690 nm, 720 to 790 nm and 770 to 850 nm, respectively, and the total coating weight of silver halide is not more than 0.78 $g/m^2$ in terms of silver, comprising the steps of exposing the silver halide color photographic material with at least three scanning laser beams each having different light-emitting wavelengths in the wavelength regions of 650 to 690 nm, 720 to 790 nm and 770 to 850 nm, an average exposure time per one picture element of the photographic material is not longer than $10^{-4}$ seconds, and then subjecting the exposed photographic material to processing comprising color developing and desilvering within 20 seconds after completion of the scanning exposure, wherein the color development time does not exceed 30 seconds, the entire processing time excluding drying time is not longer than 90 seconds, and the drying time is not longer than 30 seconds.

2. A method for forming a color image as in claim 1, wherein the silver halide color photographic material is conveyed in the scanning exposure step at a conveying rate of from 0.8 to 1.25 times that of the conveying rate in the color development step.

3. A method for forming a color image as in claim 1, wherein the entire processing time excluding drying time is not longer than 50 seconds.

4. A method for forming a color image as in claim 1, wherein the entire processing time excluding drying time is not longer than 30 seconds.

5. A method for forming a color image as in claim 1, wherein the drying time is not longer than 20 seconds.

6. A method for forming a color image as in claim 1, wherein the drying time is not longer than 10 seconds.

7. A method for forming a color image as in claim 1, wherein the average exposure time per one picture element in the exposure to laser beams is not longer than $10^{-6}$ seconds.

8. A method for forming a color image as in claim 1, wherein the color development time is not longer than 20 seconds.

9. A method for forming a color image as in claim 1, wherein the processing stage comprises at least a color development stage, a bleaching-fixing stage, a rinsing and/or stabilizing stage, and a drying stage.

10. A method for forming a color image as in claim 1, wherein the processing stage comprises at least a color development stage, a rinsing and/or stabilizing stage, and a drying stage.

11. A method for forming a color image as in claim 1, wherein the photographic material is introduced into the processing stage within 5 seconds after the scanning exposure with laser beams.

* * * * *